US010214018B2

(12) United States Patent
Nozawa et al.

(10) Patent No.: US 10,214,018 B2
(45) Date of Patent: Feb. 26, 2019

(54) CARTRIDGE AND PRINTING MATERIAL SUPPLY SYSTEM

(71) Applicant: SEIKO EPSON CORPORATION, Tokyo (JP)

(72) Inventors: Izumi Nozawa, Matsumoto (JP); Hidetoshi Kodama, Matsumoto (JP); Tadahiro Mizutani, Shiojiri (JP); Kazutoshi Matsuzaki, Shiojiri (JP); Kazumasa Harada, Matsumoto (JP); Satoshi Nakata, Matsumoto (JP); Hidetaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/969,977

(22) Filed: Dec. 15, 2015

(65) Prior Publication Data

US 2016/0129696 A1 May 12, 2016

Related U.S. Application Data

(63) Continuation of application No. 14/459,901, filed on Aug. 14, 2014, now Pat. No. 9,248,656, which is a (Continued)

(30) Foreign Application Priority Data

Jan. 12, 2012 (JP) ..... 2012-003652
Jan. 12, 2012 (JP) ..... 2012-003653
(Continued)

(51) Int. Cl.
*B41J 2/175* (2006.01)

(52) U.S. Cl.
CPC ..... *B41J 2/1752* (2013.01); *B41J 2/17526* (2013.01); *B41J 2/17546* (2013.01); *B41J 2/17553* (2013.01)

(58) Field of Classification Search
CPC .. B41J 2/1752; B41J 2/17553; B41J 2/17546; B41J 2/17526
See application file for complete search history.

(56) References Cited

U.S. PATENT DOCUMENTS 4,907,018 A 3/1990 Pinkerpell et al.
5,448,274 A 9/1995 Hirabayashi et al.
(Continued)

FOREIGN PATENT DOCUMENTS

DE 102006036716 B3 9/2007
EP 0698497 A3 3/1999
(Continued)

OTHER PUBLICATIONS

Office Action issued on Jan. 5, 2016 in Taiwanese Patent Application No. 101106802 and its English translation.
(Continued)

*Primary Examiner* — Patrick King
(74) *Attorney, Agent, or Firm* — Foley & Lardner LLP

(57) ABSTRACT

A printing material supply system includes a printing device and a cartridge. The printing device has a cartridge mounting structure. The cartridge is removably attached to the cartridge mounting structure. The cartridge mounting structure has a device-side terminal, a lever, a first device-side locking element and a second device-side locking element. The device-side terminal is configured to contact with a cartridge-side terminal. The first device-side locking element is configured as part of the lever. The second device-side locking element is configured to engage with a second locking surface of a second cartridge-side locking element. The cartridge-side terminal has a cartridge-side contact portion configured to be in contact with the device-side terminal. The cartridge-side contact portion is provided on the negative Z-axis side of the second locking surface.

26 Claims, 53 Drawing Sheets

Related U.S. Application Data continuation of application No. 13/410,618, filed on Mar. 2, 2012, now Pat. No. 8,807,721.

(30) Foreign Application Priority Data

Jan. 12, 2012 (JP) ..... 2012-003694
Jan. 12, 2012 (JP) ..... 2012-003698

(56) References Cited

U.S. PATENT DOCUMENTS 6,155,666 A 12/2000 Sugimoto et al.
6,276,780 B1 * 8/2001 Carrese ..... B41J 2/17503 347/49
6,361,158 B1 3/2002 Inoue et al.
6,488,369 B1 12/2002 Steinmertz et al.
6,502,917 B1 1/2003 Shinada et al.
6,811,246 B1 11/2004 Hayashi et al.
6,953,242 B2 * 10/2005 Yoshiyama ..... B41J 2/17513 347/86
6,955,422 B2 10/2005 Miyazawa et al.
6,979,079 B2 * 12/2005 Hashii ..... B41J 2/17503 347/84
7,213,914 B2 5/2007 Anma et al.
7,237,881 B2 7/2007 Hayasaki et al.
7,244,018 B2 7/2007 Hashii et al.
7,278,721 B2 10/2007 Shimizu et al.
7,401,909 B2 7/2008 Inoue et al.
7,452,066 B2 * 11/2008 Tsuji ..... B41J 2/1752 347/108
7,562,958 B2 7/2009 Asauchi
7,712,986 B2 5/2010 DeVore et al.
7,802,877 B2 9/2010 Hashii et al.
8,172,386 B2 5/2012 Petranek et al.
8,177,340 B2 5/2012 Harazim
8,297,738 B1 10/2012 Kodama et al.
8,297,739 B1 10/2012 Kodama et al.
8,439,482 B1 5/2013 Kodama et al.
2002/0135634 A1 9/2002 Lodal et al.
2002/0140778 A1 * 10/2002 Yoshiyama ..... B41J 2/17513 347/49
2005/0151811 A1 7/2005 Shimizu et al.
2005/0168546 A1 8/2005 Studholme et al.
2005/0179750 A1 8/2005 Hayasaki et al.
2005/0185034 A1 8/2005 Anma et al.
2005/0219303 A1 10/2005 Matsumoto et al.
2006/0139422 A1 6/2006 Hatasa et al.
2006/0250426 A1 11/2006 Wanibe et al.
2007/0195141 A1 8/2007 Anma et al.
2007/0273734 A1 * 11/2007 Nakata ..... B41J 2/1752 347/86
2007/0279464 A1 * 12/2007 Harazim ..... B41J 2/1752 347/86
2008/0049081 A1 2/2008 Hayashi et al.
2008/0068409 A1 * 3/2008 Harada ..... B41J 2/17513 347/9
2008/0204529 A1 8/2008 Matsumoto et al.
2008/0211892 A1 9/2008 Kolaki et al.
2008/0284830 A1 11/2008 Shinada et al.
2009/0051745 A1 2/2009 Watanabe et al.
2009/0096850 A1 4/2009 Sulser et al.
2009/0135237 A1 5/2009 Nakamura et al.
2010/0103230 A1 * 4/2010 Anderson, Jr. ..... B41J 2/17553 347/86
2010/0165062 A1 7/2010 Shimizu et al.
2010/0208015 A1 8/2010 Matsumoto et al.
2010/0302291 A1 12/2010 Matsumoto et al.
2010/0309265 A1 12/2010 Matsumoto et al.
2010/0309266 A1 12/2010 Matsumoto et al.
2010/0321451 A1 12/2010 Bianco et al.
2011/0012962 A1 1/2011 Nakano et al.
2011/0037815 A1 2/2011 Anma et al.
2011/0063386 A1 3/2011 Petranek et al.
2011/0273520 A1 11/2011 Shinada et al.
2012/0056954 A1 * 3/2012 Asauchi ..... B41J 2/17513 347/86
2012/0056955 A1 * 3/2012 Kodama ..... B41J 2/1752 347/86
2012/0056956 A1 3/2012 Kodama et al.
2012/0127247 A1 5/2012 Anma et al.
2012/0256991 A1 * 10/2012 Kodama ..... B41J 2/1752 347/86
2013/0182046 A1 7/2013 Kodama et al.
2013/0182047 A1 7/2013 Nozawa et al.
2013/0182048 A1 7/2013 Nozawa et al.
2013/0182049 A1 7/2013 Kodama et al.
2013/0182052 A1 7/2013 Matsuzaki et al.
2013/0182053 A1 7/2013 Kodama et al.
2013/0208044 A1 8/2013 Matsumoto et al.
2014/0152746 A1 6/2014 Kodama et al.
2014/0210917 A1 7/2014 Kodama et al.
2014/0320557 A1 10/2014 Matsumoto et al.
2014/0368585 A1 12/2014 Nozawa et al.
2016/0129696 A1 5/2016 Nozawa et al.
2016/0375688 A1 12/2016 Kodama et al.

FOREIGN PATENT DOCUMENTS

EP 1 114 726 A1 7/2001
EP 1 547 783 A2 6/2005
EP 1547782 A2 6/2005
EP 1547783 A2 * 6/2005 ..... B41J 2/1752
EP 1547783 A3 11/2006
EP 1892104 A1 2/2008
EP 2269827 A1 5/2011
JP H05-162301 A 6/1993
JP 10-100432 A 4/1998
JP 2000062212 A1 2/2000
JP 2000-127428 A 5/2000
JP 3177128 B2 6/2001
JP 2002-019142 A1 1/2002
JP 2002-200773 A 7/2002
JP 2003-011390 A 1/2003
JP 2003025599 A 1/2003
JP 2003053999 A 2/2003
JP 2004-209663 A 7/2004
JP 2004209663 A1 7/2004
JP 2005-022345 A 1/2005
JP 2005-144723 A 6/2005
JP 2005-205886 A 8/2005
JP 2006-043922 A 2/2006
JP 2007-230249 A 9/2007
JP 2009-132119 A 6/2009
JP 5218712 B1 3/2013
JP 5435149 B 12/2013
KR 1020060091275 A 8/2006
WO 2009/143422 A2 11/2009
WO WO-2009/143422 A2 11/2009

OTHER PUBLICATIONS

Office Action issued on Jan. 6, 2016 in Taiwanese Patent Application No. 101106812 and its English translation.
Notice of Reasons for Rejection issued in Japanese Patent Application No. 2013-247318 on Dec. 1, 2015 with English translation.
Examination Report issued on May 18, 2015 in Australian Patent Application No. 2014203079.
Extended European Search Report issued on Mar. 10, 2015 in European Patent Application No. 14195157.4.
Chinese Office Action and English translation of Chinese Office Action issued on Sep. 23, 2014 in Chinese Patent Application No. 201280003040.0.
Examiner's Report issued on Sep. 9, 2014 in Canadian Patent Application No. 2,807,789.
Extended European Search Report issued on Sep. 10, 2014 in European Application No. 13192668.5.
International Search Report and the Written Opinion of the International Searching Authority issued on Dec. 14, 2012 in International Application No. PCT/JP2012/001395, filed on Mar. 1, 2012.
International Search Report and the Written Opinion of the Inter-

(56) References Cited

OTHER PUBLICATIONS national Searching Authority issued on Dec. 17, 2012 in International Application No. PCT/JP2012/001397, filed on Mar. 1, 2012.
International Search Report and the Written Opinion of the International Searching Authority issued on Dec. 17, 2012 in International Application No. PCT/JP2012/001409, filed on Mar. 1, 2012.
International Search Report and the Written Opinion of the International Searching Authority issued on Dec. 17, 2012 in International Application No. PCT/JP2012/001410, filed on Mar. 1, 2012.
Office Action issued on May 25, 2012 in U.S. Appl. No. 13/410,461 (now U.S. Pat. No. 8,297,738), filed Mar. 2, 2012.
Office Action issued on May 25, 2012 in U.S. Appl. No. 13/410,478 (now U.S. Pat. No. 8,297,739), filed Mar. 2, 2012.
Combined Search and Examination Report issued on Jun. 3, 2013 in U.K. Patent Appln. No. GB1300618.4.
Notification of Reasons for Refusal issued on Jan. 12, 2017 in Japanese Patent Appln. No. 2013-039204.
Korean Office Action with English translation dated Apr. 3, 2017 in Korean Patent Application No. 10-2016-7015688.
Australian Office Action dated Jun. 26, 2017 in Australian Patent Application No. 2016201351.
Chinese Office Action with English Translation dated Jun. 20, 2017 in Chinese Patent Application No. 201610630627.4.
Extended European Search Report dated Jul. 13, 2017 in European Patent Application No. 12823217.0.
Taiwanese Office Action and English translation of Taiwanese Office Action dated May 9, 2017 in Taiwanese Patent Application No. 101106803.
Office Action dated Oct. 13, 2017 in related Chilean Application No. 201400624 with English-language comments regarding same (23 pgs.).
Non-Final Office Action dated Jul. 27, 2017 in related U.S. Appl. No. 15/259,549 (10 pgs.).
Office Action dated Sep. 29, 2017 in related Malaysian Appl. PI 2014700258 (3 pgs.).
Office Action dated Sep. 7, 2017 in related Taiwanese Appl. 105134322 with English-language translation (10 pgs.).
Philippine Office Action dated Feb. 22, 2018 in corresponding application No. 1/2014/500307.
Examination Report No. 3 dated May 25, 2018 in related Australian Appl. No. 2016201351 (3 pgs.).
Office Action dated Apr. 13, 2018 in related Chilean Appl. 00624-2014 with partial English-language translation (12 pgs.).
Examination Report dated Apr. 23, 2018 in related Indian Appl. No. 2585/DELNP/2013 (6 pgs.).
Examination Report No. 2 dated Dec. 6, 2017 in related Australian Appl. No. 2016201351 (4 pgs.).
Examination Report dated Jun. 11, 2018 in related Indian Appl. No. 2089/DELNP/2013 (8 pgs.).
Examination Report dated Jun. 19, 2018 in related Indian Appl. No. 2087/DELNP/2013 (7 pgs.).
Office Action dated Jul. 2, 108 in related European Appl. No. 12823217.0 (7 pgs.).
Office Action dated Sep. 19, 2018 in related Peruvian Appl. 000319-2014 with English-language translation (12 pgs.).
Examination Report dated Jul. 3, 2018 in related Australian Appl. No. 2018204402 (4 pgs.).
Examination Report dated Nov. 26, 2018 in related Australian Appl. No. 2018204402 (4 pgs.).
Office Action dated Oct. 26, 2018 in related Chilean Appl. 2014-000624 with English-language translation (4 pgs.).
Office Action dated Nov. 28, 2018 in related UAE Appl. UAE/P/0241/2014 (28 pgs.).
Office Action dated Nov. 8, 2018 in related European Appl. 14195157.4 (5 pgs.).

* cited by examiner

CARTRIDGE AND PRINTING MATERIAL SUPPLY SYSTEM

CROSS REFERENCE TO RELATED APPLICATIONS

The present application is a continuation application of U.S. patent application Ser. No. 14/459,901, filed Aug. 14, 2014, which itself is a continuation of U.S. patent application Ser. No. 13/410,618, filed on Mar. 2, 2012, which claims priority based on Japanese Patent Application Nos. 2012-3652, No. 2012-3653, No. 2012-3694 and No. 2012-3698 filed on Jan. 12, 2012, the entire contents of each of which are incorporated herein by reference.

BACKGROUND

Technical Field

The present invention relates to a cartridge, a combination of a cartridge and a printing device (or portion thereof) and/or a printing material supply system including the cartridge and a printing device.

Related Art

Latest cartridges generally have a circuit board with information regarding printing material (e.g., information on an remaining amount of printing material). For attachment of this cartridge to a printing device, the circuit board on the cartridge is electrically connected with the printing device through contact of cartridge-side terminals with terminals on the printing device. With size reduction of the terminals, it is of great importance to properly attach the cartridge at a designed attachment position.

Various mechanisms have been proposed for attachment and detachment of a cartridge to a printing device. Examples of such mechanisms are disclosed in U.S. Publication No. 2005/0151811 (which corresponds to JP-A-2007-230249), U.S. Pat. No. 7,008,053 (which corresponds to JP-A-2005-022345), U.S. Pat. No. 6,276,780 (which corresponds to JP-A-2002-019142), U.S. Pat. Nos. 6,955,422, 6,074,042, and 7,018,030.

U.S. Publication No. 2005/0151811 discloses a cartridge with a latching lever 3 and electric contact terminal pads 102. Lever 3 includes an anchoring portion 6 for engaging with the printer. The anchoring portion 6 is disposed far away from the contact pads 102. Because anchoring portion 6 is far away from the cartridge terminals, the engagement with the printer can offer only limited contribution to the accuracy and stability of positioning of the cartridge terminals with respect to the respective printer terminals.

In addition, lever 3 in U.S. Publication No. 2005/0151811 needs to be long enough to reach a location accessible by the user so the user can operate it. It also projects far away from the side wall of the cartridge. Such a large lever results in a larger cartridge, which can also result in a large-size printer, in which the cartridge is attached to and detached from, as well as bulky packaging for transportation and distribution of the cartridges, which in turn increases transportation and parts costs.

Also, the cartridge structure that connects the anchoring portion 6 to the cartridge-side terminals includes a flexible section of the lever 3. Even though the anchoring portion 6 might be securely engaged with the printer, vibration generated during printing operations can be transmitted through the flexible section of the lever 3 to the cartridge terminals, and so can influence the positioning of the cartridge terminals with respect to the printer terminals. This is particularly a concern for on-carriage type ink cartridges, such as those disclosed of U.S. Publication No. 2005/0151811, because they are mounted on a printer's carriage, to which the print head is attached. In on-carriage printers, the carriage is scanned back and forth over the print medium during printing operations. The ink cartridges in the carriage undergo great acceleration force with each change in scan direction, in addition to other vibration generated during printing operations.

The lever in U.S. Publication No. 2005/0151811 is formed integrally with the cartridge and is elastically deformable. With this configuration, the material used to produce the cartridge is limited to a material with sufficient moldibility for making this configuration, and also with sufficient flexibility and durability that is needed for the lever to elastically deform during engagement and disengagement with the printer.

The lever might plastically deform under operations by the user. Such plastic deformation of the lever may cause positional misalignment between cartridge-side terminals and printer terminals, which could result in poor electrical communication. Plastic deformation also reduces the durability of the lever. Also, special measures, such as those disclosed in U.S. Pat. No. 7,018,030, must be taken during packaging of the cartridge to prevent creep deformation of the lever while the cartridge is packaged, especially when the cartridge is packaged in a vacuum package.

U.S. Pat. No. 6,276,780 discloses a cartridge without any memory or electrical terminals. Because this type of cartridge requires no electrical connection with the printer, there is no need to include structure or configuration for maintaining stable positioning and alignment of cartridge terminals to printer terminals.

In addition, the cartridge is attached to the printer by a latch mechanism 132 (in FIGS. 9-16 of U.S. Pat. No. 6,276,780) that is disposed on the printer. Cartridge-side latch ramps 220 that engage the latch mechanism 132 are far away from the pivot axis of the latch mechanism 132, in the direction in which the cartridge is removed from the printer. As a result, when a resilient member 156 or compression force seal 152 applies to the cartridge a force (indicated by arrow X in FIG. 12 U.S. Pat. No. 6,276,780) in the direction in which to the cartridge is removed from the printer, this force can be easily converted into a force that releases engagement of the retainer portion 134 from the cartridge latch ramps 220, so that the cartridge might become separated from the printer during use of the printer. Because the engagement configuration disclosed in U.S. Pat. No. 6,276,780 includes this inherent risk of the cartridge becoming separated from the printer, it is not suitable for use with the configurations disclosed in U.S. Publication No. 2005/0151811, which require proper contact between the cartridge terminals and printer terminals. Moreover, contact between the cartridge and printer terminals in the configurations in U.S. Publication No. 2005/0151811 applies force from the terminals of the printer in lateral direction to the cartridge, so that the cartridge might move in the in lateral direction. The latch mechanism 132 of U.S. Pat. No. 6,276,780 is not suitable for the cartridge of U.S. Publication No. 2005/0151811 at least for the reason that it might not be able to match the lateral direction movement of the cartridge, so that the latch mechanism 132 becomes detached from the cartridge.

U.S. Pat. No. 6,074,042 discloses an ink cartridge with electrical contacts 54. As shown in FIGS. 12A to 13B thereof, the electrical contacts 54 are at the leading edge of the direction in which the cartridge is mounted into the printer. With this configuration, when the cartridge is mounted into the printer, the electrical contacts 54 of the cartridge press flat against spring biased electrical contacts 104 of the printer. Metal oxidation, oil, or other non-conductive matter at the outer surface of the metal electrical contacts 54 can become sandwiched between the conductive metal of the cartridge and printer electrical contacts, possibly hindering electrical communication between the cartridge and the printer.

U.S. Pat. No. 6,955,422 discloses, for example in FIGS. 2a to 2d thereof, a cartridge 1 that has a memory device 7 with electrodes 7a. The electrodes 7a are aligned substantially parallel to the direction of cartridge insertion into the printer. With this configuration, the printer electrodes 106 slide across the surface of the circuit board (on which the electrodes 7a are formed) for a long distance. The surface of the circuit board is typically covered with an electrically insulating resin material. When the printer electrodes 106 scrape against the circuit board, they can damage this insulation so that fragments of the insulation flake away from the circuit board. The insulation fragments can get caught between the printer electrodes 106 and the cartridge electrodes 7*a*, and become a cause of poor or otherwise unreliable electrical communication between the printer and the cartridge.

As shown in FIGS. 5 to 6B of U.S. Pat. No. 6,955,422, the printer is provided with a leaf spring 103 that exerts an urging force that presses the surface of memory device 7 against the printer electrodes 106 when the cartridge is mounted in the printer, and that moves the cartridge 1 upward when the cartridge is pulled out of the printer.

U.S. Pat. No. 7,008,053 discloses in FIG. 5 an elastic piece 40 provided on the printer. When the cartridge is fully mounted in the printer, the lower end 40*a* of the elastic piece 40 abuts against a flat surface 12*a* at the upper portion of the projecting portion 12 on which the electrodes 14 are located. The abutment between the lower end 40*b* and the flat surface 12*a* restricts upward movement of the projecting portion 12. However, the configuration of U.S. Pat. No. 7,008,053 includes no means located near the projecting portion 12 for restricting downward movement of the projecting portion 12. As a result, projecting portion 12 is fairly free to vibrate vertically during operation of the printer and therefore the electrodes can become misaligned or disconnected from the printer terminals.

In the presence of various mechanisms for attachment and detachment, there is a need to reduce the total size of a printer for better usability and ease of installation. For reducing the size of the printer, it is typically necessary to reduce the sizes of a large number of components forming the printer and relevant elements. These components and relevant elements include a cartridge attached to the printer and a cartridge mounting structure for attachment of the cartridge.

For improved use of the printer, information regarding the printing material contained in the cartridge (for example, information regarding the remaining amount of the printing material) is often displayed on the monitor of the printer. The cartridge attached to this printer would have a circuit board with a memory for storing the information regarding the printing material. The circuit board has terminals (cartridge-side terminals) used to send and receive information to and from the printer. The information regarding the printing material is transmitted between the memory and a controller of the printer through the contact of these cartridge-side terminals and terminals on the printer (device-side terminals). It is accordingly necessary to maintain stable electrical connection between the cartridge-side terminals and the device-side terminals.

As will be described below, there is no known mechanism to meet these requirements in a fully acceptable manner.

This problem is not limited to a cartridge containing ink for printing but is also commonly found in any of printing devices and/or cartridges configured to supply or eject various other printing materials (for example, toner) as well as ink.

Consequently, there is a need to ensure stable electrical connection between cartridge-side terminals and device-side terminals. There is also a need to attain size reduction of a cartridge, a printer and a printing material supply system including the cartridge attached to the printer.

SUMMARY

In order to achieve at least part of the foregoing, the invention provides various aspects and embodiments described below.

The first aspect of the invention is directed to a cartridge configured to be removably attached to a cartridge mounting structure of a printing device. The cartridge mounting structure is configured to receive a plurality of the cartridges attached thereto and to have a printing material supply tube, a device-side terminal, a lever, a first device-side locking element and a second device-side locking element provided for each of the cartridges. The printing material supply tube has a peripheral end to be connected with the cartridge. A Z axis represents an axis parallel to a central axis C of the printing material supply tube. An X axis represents an axis, along which the printing material supply tube and the device-side terminal are arrayed and which is orthogonal to the Z axis. A Y axis represents an axis orthogonal to both the Z axis and the X axis. A positive Z-axis direction represents a direction along the Z axis going from a base end to the peripheral end of the printing material supply tube. A negative Z-axis direction represents a reverse direction to the positive Z-axis direction. A positive X-axis direction represents a direction along the X axis going from the printing material supply tube to the device-side terminal. A negative X-axis direction represents a reverse direction to the positive X-axis direction.

The device-side terminal has a device-side contact portion configured to be in contact with the cartridge, and is configured to be elastically deformed about a pivotal center on a positive Z-axis side and on a positive X-axis side of the device-side contact portion and to be in contact with the cartridge while applying a pressing force including a positive Z-axis component to the cartridge, so as to be electrically connectable with the cartridge. The first device-side locking element is configured as part of the lever to lock the cartridge at a position on a positive Z-axis side and on a positive X-axis side of the device-side terminal. The second device-side locking element is configured to lock the cartridge at a position on a positive Z-axis side and on a negative X-axis side of the printing material supply tube. The lever is configured to turn about a pivotal center on a positive Z-axis side and on a positive X-axis side of a locking position where the first device-side locking element locks the cartridge, so as to move the first device-side locking element from the locking position in the positive X-axis direction and thereby allow the first device-side locking element to lock and unlock the cartridge.

In an attached state of the cartridge to the cartridge mounting structure, the X axis, the Y axis and the Z axis relative to the cartridge correspond to an X axis, a Y axis and a Z axis on the cartridge. The cartridge includes a first face, a second face, a third face, a fourth face, a fifth face, a sixth face, a sloped surface, a printing material supply port, a cartridge-side terminal, a first cartridge-side locking element and a second cartridge-side locking element. The first face is located on a negative Z-axis side and the second face is located on a positive Z-axis side, as two faces is opposed to each other in the Z-axis direction. The third face are located on a positive X-axis side and the fourth face is located on a negative X-axis side, as two faces are opposed to each other in the X-axis direction and intersecting the first face and the second face. The fifth face is located on a positive Y-axis side and the sixth face is located on a negative Y-axis side, as two faces are opposed to each other in the Y-axis direction and intersecting the first, second, third and fourth faces. The sloped surface is provided in a corner section arranged to connect the first face with the third face and inclined in the negative Z-axis direction and in the positive X-axis direction. The printing material supply port is provided on the first face and configured to be connectable with the printing material supply tube. The cartridge-side terminal is provided on the sloped surface and configured to be in contact with the device-side terminal while receiving the pressing force including the positive Z-axis component from the device-side terminal, so as to be electrically connected with the device-side terminal, in the attached state of the cartridge to the cartridge mounting structure. The first cartridge-side locking element is provided on the third face. The second cartridge-side locking element is provided on the fourth face. The first cartridge-side locking element has a first locking surface that faces in the positive Z-axis direction. The first locking surface is configured to engage with the first device-side locking element in the attached state of the cartridge to the cartridge mounting structure. The second cartridge-side locking element has a second locking surface that faces in the positive Z-axis direction. The second locking surface is configured to engage with the second device-side locking element in the attached state of the cartridge to the cartridge mounting structure. The cartridge-side terminal has a cartridge-side contact portion configured to be in contact with the device-side terminal in the attached state of the cartridge to the cartridge mounting structure. The cartridge-side contact portion is provided on the negative Z-axis side of the second locking surface.

According to the structure of the first aspect, the lever is provided not on the cartridge but on the cartridge mounting structure. This structure allows size reduction of the cartridge. This structure also shortens the distance between the side wall of the cartridge and the lever and allows size reduction of the lever, thus achieving the size reduction of the printing device and the overall printing material supply system. Since the lever is not provided on the cartridge, there is the high degree of freedom in selection of the materials for the housing of the cartridge and for the lever. The material with the relatively high rigidity can be selected as the materials for the housing and the lever. This lowers the possibility of plastic deformation explained above and enables the cartridge to be stably held at the designed attachment position.

According to the structure of the first aspect, the cartridge-side contact portion is provided on the negative Z-axis side of the second locking surface. In the course of attachment of the cartridge to the cartridge mounting structure, the rotation locus of the cartridge-side contact portion about the pivotal center on the second locking surface goes in the negative X-axis direction, while the rotation locus of the device-side contact portion goes in the positive X-axis direction. This allows attachment of the cartridge at the designed attachment position, while significantly increasing the amount of wiping between the cartridge-side terminal and the device-side terminal. The term "wiping" herein means that the cartridge-side terminal provided on the sloped surface is rubbed by the device-side terminal provided on the cartridge mounting structure in the course of attachment of the cartridge to the cartridge mounting structure. The "amount of wiping" means the length of the cartridge-side terminal that can be rubbed by the device-side terminal. Such wiping removes dust and foreign particles adhering to the top of the cartridge-side terminal and reduces the potential connection failure between the cartridge-side terminal and the device-side terminal.

According to the second aspect of the invention, the second cartridge-side locking element may be configured to engage with the second device-side locking element in the course of attachment and detachment of the cartridge to and from the cartridge mounting structure and thereby serve as a pivot point of rotation of the cartridge relative to the cartridge mounting structure. This structure according to the second aspect facilitates attachment and detachment of the cartridge to and from the cartridge mounting structure.

According to the third aspect of the invention, the first locking surface may be located on a negative Z-axis side of the second locking surface. According to the third aspect, in the attached state of the cartridge to the cartridge mounting structure, the pressing force applied from the cartridge mounting structure of the cartridge acts in the direction of enhancing the engagement of the first cartridge-side locking element with the first device-side locking element (i.e., direction including a positive X-axis component and a positive Z-axis component). This effectively prevents detachment of the cartridge from the designed attachment position and enables the cartridge to be stably held at the designed attachment position.

According to the fourth aspect of the invention, the first locking surface and the second locking surface may be provided at positions intersecting a plane that goes through center of a width or Y-axis direction length of the cartridge and be parallel to the Z axis and the X axis. The structure according to the fourth aspect effectively prevents the pressing force applied from the cartridge mounting structure to the cartridge from acting to tilt the cartridge in the Y-axis direction.

According to the fifth aspect of the invention, the first cartridge-side locking element may also have a third locking surface that faces in the positive X-axis direction. The third locking surface is configured to engage with the first device-side locking element in the attached state of the cartridge to the cartridge mounting structure. This structure according to the fifth aspect enables the cartridge to be more stably held at the designed attachment position.

According to the sixth aspect of the invention, the printing material supply port may be provided at a position closer to the fourth face than the third face. According to the seventh aspect, the printing material supply port is provided on the second locking surface, which is positioned relative to the cartridge mounting structure prior to the first locking surface. This structure enables the cartridge to be readily positioned relative to the cartridge mounting structure.

According to the seventh aspect of the invention, the fifth face and the sixth face may be configured to be engageable with the cartridge mounting structure. The structure according to the fifth aspect effectively prevents the positional misalignment of the cartridge-side terminal in the Y-axis direction relative to the cartridge mounting structure.

According to the eighth aspect of the invention, the cartridge may further include a seventh face and an eighth face. The seventh face is provided between the first face and the third face and formed to be extended from the first face in the positive Z-axis direction. The eighth face is provided between the first face and the third face and arranged to connect with the seventh face and with the third face. The sloped surface is provided on the eighth face. According to the eighth aspect, the cartridge-side terminal is provided on the positive Z-axis side of the first face with the printing material supply port. When the cartridge with its first face as the bottom face is mounted on the cartridge mounting structure, this structure effectively protects the cartridge-side terminal from potential damage by any foreign matter present on the mounting surface (for example, liquid such as printing material or water or metal product such as click or screw).

According to the ninth aspect of the invention, the cartridge may further include a pair of projections protruded on a positive Y-axis side and on a negative Y-axis side of the seventh face to be opposed to each other in the Y-axis direction. The pair of projections are configured to be engageable with a fitting member provided in the cartridge mounting structure. The structure according to the ninth aspect effectively prevents the positional misalignment of the cartridge-side terminal in the Y-axis direction relative to the cartridge mounting structure.

According to the tenth aspect of the invention, a plurality of the cartridge-side terminals may be configured to be arranged corresponding to a plurality of the device-side terminals, and each of the plurality of cartridge-side terminals may be located on the negative Z-axis side of the second locking surface. According to a tenth aspect, there is provided the cartridge, wherein a plurality of the cartridge-side terminals are arranged corresponding to a plurality of the device-side terminals, and each of the plurality of cartridge-side terminals is located on the negative Z-axis side of the second locking surface. The structure of the tenth aspect significantly increases the amount of wiping by each of the plurality of cartridge-side terminals.

According to the eleventh aspect of the invention, one of the plurality of cartridge-side terminals may be a cartridge-side ground terminal configured to be electrically connectable with a device-side ground terminal among the plurality of device-side terminals, which is connected to a ground line. The cartridge-side ground terminal may be provided on center of a width or Y-axis direction length of the cartridge and may be configured to be in contact with the device-side ground terminal before another cartridge-side terminal of the plurality of cartridge-side terminals is in contact with a corresponding one of the plurality of device-side terminals, in the course of attachment of the cartridge to the cartridge mounting structure. According to the eleventh aspect, the pressing force first applied from the cartridge mounting structure to the cartridge-side terminals is generated on the center of the width or the Y-axis direction length of the cartridge. This effectively prevents the pressing force applied to the cartridge-side terminals from acting to tilt the cartridge in the Y-axis direction and ensures attachment of the cartridge in the stable attitude. The cartridge-side ground terminal is in contact with the corresponding device-side ground terminal, prior to the contact of the other cartridge-side terminals with the corresponding device-side terminals. The grounding function of the cartridge-side ground terminal advantageously prevents or reduces a high voltage-induced trouble or failure, even when an unexpected high voltage is applied to the cartridge.

The twelfth aspect of the invention is directed to a printing material supply system and includes a printing device and a cartridge according to any of the aspects 1 to 11 described above. The printing device has a cartridge mounting structure. The cartridge is removably attached to the cartridge mounting structure. The cartridge mounting structure is configured to receive a plurality of the cartridges attached thereto and to have a printing material supply tube, a device-side terminal, a lever, a first device-side locking element and a second device-side locking element provided for each of the cartridges. The printing material supply tube has a peripheral end to be connected with the cartridge. A Z axis represents an axis parallel to a central axis C of the printing material supply tube. An X axis represents an axis, along which the printing material supply tube and the device-side terminal are arrayed and which is orthogonal to the Z axis. A Y axis represents an axis orthogonal to both the Z axis and the X axis. A positive Z-axis direction represents a direction along the Z axis going from a base end to the peripheral end of the printing material supply tube. A negative Z-axis direction represents a reverse direction to the positive Z-axis direction. A positive X-axis direction represents a direction along the X axis going from the printing material supply tube to the device-side terminal. A negative X-axis direction represents a reverse direction to the positive X-axis direction.

The device-side terminal has a device-side contact portion configured to be in contact with the cartridge, and is configured to be elastically deformed about a pivotal center on a positive Z-axis side and on a positive X-axis side of the device-side contact portion and to be in contact with the cartridge while applying a pressing force including a positive Z-axis component to the cartridge, so as to be electrically connectable with the cartridge. The first device-side locking element is configured as part of the lever to lock the cartridge at a position on a positive Z-axis side and on a positive X-axis side of the device-side terminal. The second device-side locking element is configured to lock the cartridge at a position on a positive Z-axis side and on a negative X-axis side of the printing material supply tube. The lever is configured to turn about a pivotal center on a positive Z-axis side and on a positive X-axis side of a locking position where the first device-side locking element locks the cartridge, so as to move the first device-side locking element from the locking position in the positive X-axis direction and thereby allow the first device-side locking element to lock and unlock the cartridge.

The structure according to the twelfth aspect has the similar advantageous effects to those of the first to eleventh aspects.

The thirteenth aspect of the invention is directed to a cartridge removably attached to a cartridge mounting structure of a printing device. The cartridge includes a printing material supply port, a cartridge-side terminal, a first cartridge-side locking element and a second cartridge-side locking element. The printing material supply port is provided to have an open surface with an opening formed on a protruded end and configured to supply printing material to the printing device via the open surface. The cartridge-side terminal is configured to be electrically connected with a device-side terminal provided on the cartridge mounting structure. The first cartridge-side locking element is configured to engage with a first device-side locking element provided in a pivotally rotatable manner on the cartridge mounting structure. The second cartridge-side locking element is provided at a position opposite to the first cartridge-side locking element across the printing material supply port and configured to engage with a second device-side locking element provided in the cartridge mounting structure. An X axis represents an axis that goes from the printing material supply port to the first cartridge-side locking element and is parallel to the open surface. A Y axis represents an axis parallel to the open surface and orthogonal to the X axis, a Z axis represents an axis orthogonal to both the X axis and the Y axis. A negative Z-axis direction represents a protruding direction of the printing material supply port. A positive Z-axis direction represents a reverse direction to the negative Z-axis direction. The first cartridge-side locking element and the second cartridge-side locking element are provided on a positive Z-axis side of the open surface of the printing material supply port. The first cartridge-side locking element has a first locking surface that faces in the positive Z-axis direction and engages with the first device-side locking element to restrict motion of the cartridge in the positive Z-axis direction. The second cartridge-side locking element has a second locking surface that faces in the positive Z-axis direction and engages with the second device-side locking element to restrict motion of the cartridge in the positive Z-axis direction. The cartridge-side terminal has a cartridge-side contact portion configured to be in contact with the device-side terminal. The cartridge-side contact portion is provided on the negative Z-axis side of the second locking surface.

The structure according to the thirteenth aspect has the similar advantageous effects to those of the first aspect.

In one embodiment of the invention, an ink cartridge for mounting on an ink jet printing apparatus is disclosed wherein the ink jet printing apparatus on which the ink cartridge is mounted includes a lever having an engagement portion. The printing apparatus preferably includes a plurality of apparatus-side contact forming members that are constructed and arranged to apply elastic force to the ink cartridge when the ink cartridge is pressed against said apparatus-side contact forming members after the cartridge is mounted on the printing apparatus. The ink cartridge preferably includes a cartridge body including a plurality of external surfaces. The ink cartridge includes an ink chamber for storing ink. The ink cartridge also preferably includes an electrical device. The ink cartridge also preferably includes an ink supply structure to supply ink from the ink chamber to the ink jet printing apparatus. The ink supply structure preferably defines a mounting direction leading edge which defines a leading edge plane of the ink cartridge. In one embodiment the ink supply structure is preferably configured to define a mounting direction from portions of the ink supply structure inside the cartridge body to an external leading edge of the ink supply structure on an ink supply surface of the cartridge body. The ink cartridge can also include a terminal bearing structure located at an external portion of the cartridge body the terminal bearing structure having a plurality of electrically conductive terminals coupled to the electrical device therein. The terminals are adapted and arranged on the terminal bearing structure to make contact with and receive elastic force from the contact forming members when the ink cartridge is mounted on the printing apparatus. The terminals are arranged substantially in a terminal plane which is neither parallel nor perpendicular to the leading edge plane. The ink cartridge preferably includes a first restriction portion that includes a first engagement portion having a first locking surface facing a direction opposite the mounting direction adapted and positioned to engage with the engagement portion of the lever so as to restrict movement of the ink cartridge in a direction opposite the mounting direction. The first engagement portion is preferably located adjacent the terminal bearing structure. The first engagement portion is preferably farther in a direction opposite the mounting direction than the terminal bearing structure. The ink cartridge can also include a second restriction portion on an opposite location of the ink cartridge than the first restriction portion. The second restriction portion including a second engagement portion having a second locking surface facing a direction opposite the mounting direction, adapted and positioned to engage with a respective portion of the printing apparatus, the second engagement portion located farther from the leading edge plane than the terminals when the distances are measured in a direction orthogonal to the leading edge plane.

In one embodiment, the terminal plane is at an angle of about 20 and 50 degrees, preferably from about 25 and 40 degrees to the leading edge plane.

The interaction at the terminal bearing structure to the printing apparatus is important for proper mounting of the cartridge. As described herein, by mating at an angle, the cartridge can receive both upwards and rearward forces. These forces help hold the cartridge in place.

In one embodiment, the terminal bearing structure is on or proximate to a first surface of the cartridge body and when the first surface of the cartridge body is viewed with the ink supply structure facing down, the first engagement portion is located to the left of a right edge of a rightmost terminal of the plurality of terminals and to the right of a left edge of a leftmost terminal of the plurality of terminals.

In one embodiment the distance between the second engagement portion and the leading edge plane is greater than the distance between the first engagement portion and the leading edge plane, when the distances are measured in an orthogonal direction to the leading edge plane. In one embodiment the distance from the first locking surface to the leading edge plane is less than the distance from the second locking surface to the leading edge plane, when the distances are measured in an orthogonal direction to the leading edge plane.

In one embodiment the first engagement portion and the second engagement portion are positioned on the cartridge body such that a plane can simultaneously intersect the ink supply structure, the first engagement portion, the second engagement portion and the widthwise center of the cartridge body.

In one embodiment, the first engagement portion also includes a third locking surface to engage with a respective portion of the printing apparatus and the third locking surface faces a direction orthogonal to the mounting direction and the first locking surface faces a direction orthogonal to the third locking surface. In one embodiment the first and third locking surfaces are in the shape of a letter "L". In one embodiment the first and third locking surfaces are in the shape of a letter "T".

In one embodiment the ink supply structure is closer to the first engagement portion than to the second engagement portion.

In one embodiment the second engagement portion is farther from the leading edge plane than the terminal bearing structure is from the leading edge plane when the distances are measured orthogonally from the leading edge plane.

In one embodiment, when viewing the ink cartridge from the side with the engagement portion of the first restriction portion to the right and the ink supply structure facing down, the distance between the first engagement portion and the leading edge plane is less than the distance between a pivot point of the lever and the leading edge plane when the distances are measured in an orthogonal direction to the leading edge plane. The lever may also have two ends where the pivot point is intermediate the two ends.

In one embodiment when viewing the ink cartridge from the side with the engagement portion of the first restriction portion to the right and the ink supply structure facing down, the engagement portion of the first restriction portion is to the left of a pivot point of the lever when the cartridge is mounted.

In one embodiment a first surface has the terminal bearing structure proximate thereto and when the first surface body is viewed with the ink supply structure facing down, at least a portion of the engagement portion of the first restriction portion is located substantially at the widthwise center of the ink cartridge.

In a preferred embodiment, the plane defined by the leading edge is below a bottom surface. In other embodiments, it is substantially flush with a bottom surface. In still other embodiments it can be recessed above a bottom surface.

In one embodiment an ink supply system for supplying ink to an ink jet printing apparatus is disclosed where the ink jet printing apparatus includes a plurality of apparatus-side contact forming members. The ink jet printing apparatus also preferably includes a lever having an engagement portion. The ink supply system preferably includes an ink chamber for storing ink and an ink supply structure, adapted and configured to supply ink from the ink chamber to the ink jet printing apparatus. The ink supply structure defines a mounting direction leading edge the mounting direction leading edge defining a leading edge plane. In one embodiment the ink supply structure is preferably configured to define a mounting direction from portions of the ink supply structure inside the cartridge body to an external leading edge of the ink supply structure on an ink supply surface of the cartridge body. The ink supply system preferably includes an electrical device. The ink supply system can also include a terminal bearing structure having a plurality of electrically conductive terminals coupled to the electrical device, the terminals adapted and arranged on the terminal bearing structure to make contact with and receive elastic force from the contact forming members at contact portions of said terminals when the ink supply system supplies ink to the printing apparatus. The ink supply system can also include a first restriction portion including an engagement portion having a first locking surface facing a direction opposite the mounting direction. The first engagement portion is preferably adapted to engage with the engagement portion of a lever on the printing apparatus so as to restrict movement of the terminal bearing structure in a direction opposite the mounting direction. The first engagement portion is preferably located adjacent the terminal bearing structure. The ink supply system can also include a second restriction portion on an opposite location of the ink cartridge than the first restriction portion. The second restriction portion including a second engagement portion having a second locking surface facing a direction opposite the mounting direction, adapted and positioned to engage with a respective portion of the printing apparatus, the second engagement portion located farther from the leading edge plane than the terminals when the distances are measured in a direction orthogonal to the leading edge plane. The terminals can be arranged substantially in a terminal plane which is neither parallel nor perpendicular to the leading edge plane when the ink supply system supplies ink to the printing apparatus. Alternatively, the terminal bearing structure determines the plane and/or the plane is defined by the terminals in contact with the respective structure on the printing apparatus.

In one embodiment of the system, the terminal plane is at an angle of between about 20 and 50 degrees, preferably from about 25 and 40 degrees to the plane defined by the leading edge when the ink supply system supplies ink to the printing apparatus.

In one embodiment of the system, when the ink supply system is in place to supply ink to the printing apparatus, the first engagement portion is located to the left of a right edge of a rightmost terminal of the plurality of terminals and to the right of a left edge of a leftmost terminal of the plurality of terminals.

In one embodiment the distance between the second engagement portion and the leading edge plane is greater than the distance between the first engagement portion and the leading edge plane, when the distances are measured in an orthogonal direction to the leading edge plane. In one embodiment, the first engagement portion also includes a third locking surface to engage with a respective portion of the printing apparatus and the third locking surface faces a direction orthogonal to the mounting direction and the first locking surface faces a direction orthogonal to the third locking surface. In one embodiment the first and third locking surfaces form the shape of a letter "L". In one embodiment the first and third locking surfaces form the shape of a letter "T".

In one embodiment the ink supply structure is closer to the first engagement portion than to the second engagement portion.

In one embodiment, the lever has a pivot point and the distance between the engagement portion of the first engagement portion and the leading edge plane is less than the distance between the pivot point of the lever and the leading edge plane when the ink supply system is assembled or supplies ink to the printing apparatus, when the distances are measured in an orthogonal direction to the plane defined by the leading edge.

In one embodiment the lever has a pivot point and when the ink supply system supplies ink to the printing apparatus, the first engagement portion is on the right and the ink supply structure is facing down, the first engagement portion is to the left of a pivot point of the lever.

In one embodiment at least a portion of the first engagement portion is located substantially at the widthwise center of the terminal bearing structure.

In one embodiment, the ink supply system can include an adapter where the ink supply structure, the terminal bearing structure and the first restriction portion are positioned on the adapter and the ink chamber is adapted and configured to be mated with the adapter. In another embodiment, the system can include an adapter where the terminal bearing structure and the first restriction portion are positioned on the adapter, the ink supply structure is positioned on the ink chamber and the ink chamber is adapted and configured to be mated with the adapter. Alternatively, the system can include an adapter, an ink tank external from the ink jet printing apparatus, a tube and an auxiliary adapter where the ink supply structure is positioned on the auxiliary adapter, the terminal bearing structure and the first restriction portion are positioned on the adapter and the tube supplies ink from the external tank to the auxiliary adapter when the ink supply system supplies ink to the printing apparatus.

In a preferred embodiment, the plane defined by the leading edge is below a bottom surface. In other embodiments, it is substantially flush with a bottom surface. In still other embodiments it can be recessed above a bottom surface.

The present invention is not limited to the cartridge, the combination of the ink cartridge with the printing apparatus or the printing material supply system described above but may be implemented by a diversity of other aspects, for example, a liquid cartridge, a liquid container, a printing material container, a cartridge adapter, a circuit board, a printing device, a liquid ejection device, and a liquid supply system including a liquid ejection device and a liquid cartridge. The invention is not limited to the above aspects, but a multiplicity of variations and modifications may be made to these aspects without departing from the scope of the invention. When addressing a combination of an ink cartridge with a printing apparatus and/or an ink jet printing apparatus, it should be understood that the ink cartridge is installed attached or mounted on the printing apparatus.

BRIEF DESCRIPTION OF THE DRAWINGS

The foregoing summary, as well as the following description of embodiments, will be better understood when read in conjunction with the appended drawings wherein like reference numerals refer to like components. For the purposes of illustrating the device of the present application, there is shown in the drawings certain embodiments. It should be understood, however, that the application is not limited to the precise arrangement, structures, features, embodiments, aspects, and devices shown, and the arrangements, structures, features, embodiments, aspects and devices shown may be used singularly or in combination with other arrangements, structures, features, embodiments, aspects and devices.

The drawings are not necessarily drawn to scale and are not in any way intended to limit the scope of this invention, but merely to clarify a single illustrated embodiment of the invention. In the drawings.

DESCRIPTION OF THE PREFERRED EMBODIMENTS

In order to further clarify the configurations and the operations of the invention, embodiments of a printing material supply system according to the invention are described below with reference to the accompanied drawings.

A. First Embodiment

A-1. General Configuration of Printing Material Supply System

Figure 1:
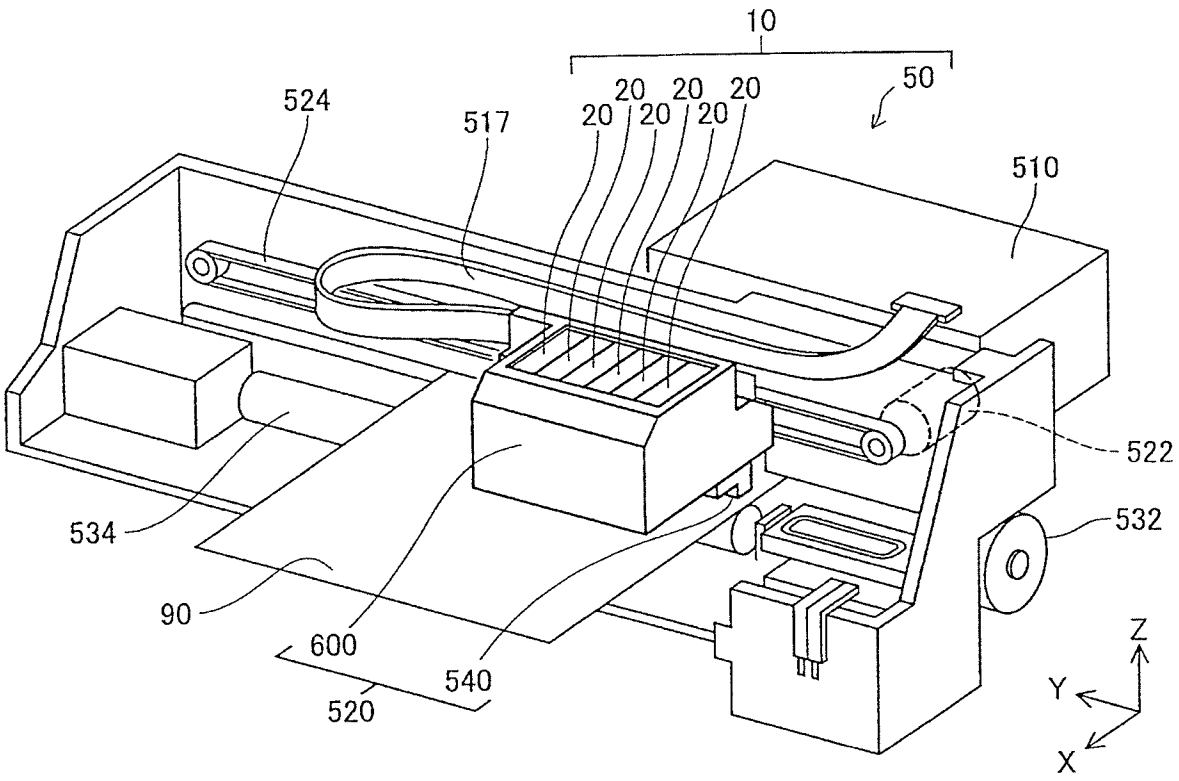
FIG. 1 is a perspective view illustrating the configuration of a printing material supply system.

FIG. 1 is a perspective view illustrating the configuration of a printing material supply system 10. XYZ axes orthogonal to one another are shown in FIG. 1. The XYZ axes in FIG. 1 correspond to the XYZ axes in the other drawings. According to this embodiment, the Z axis represents vertical direction. The printing material supply system 10 includes cartridges 20 and a printer (printing device) 50. In the printing material supply system 10, the cartridges 20 are removably attached to a holder (cartridge mounting structure) 600 of the printer 50 by the user.

Each of the cartridges 20 in the printing material supply system 10 is a cartridge (ink cartridge) serving to contains ink (printing material) and is structured to be removably attached to the printer 50. The ink as the printing material contained in the cartridge 20 is supplied through a printing material supply port and a printing material supply tube (described later) to a head 540 of the printer 50. According to this embodiment, a plurality of the cartridges 20 are removably attached to the holder 600 of the printer 50. More specifically, six cartridges 20 respectively containing six different color inks (black, yellow, magenta, light magenta, cyan and light cyan) are attached to the holder 600.

The number of cartridges attached to the holder 600 is not limited to six but may be changed to any arbitrary number, i.e., less than six or greater than six, according to the structure of the printer 50. The number of different color inks contained in the cartridges 20 is not limited to six colors but may be less than six colors (for example, four colors, black, yellow, magenta and cyan) or greater than six colors (for example, special glossy colors, such as metallic luster and pearl white, in addition to the ink colors of the embodiment). According to other embodiments, two or more cartridges 20 attached to the holder 600 may contain one identical color ink. The detailed structures of the cartridge 20 and the holder 600 will be described later.

The printer 50 of the printing material supply system 10 is constructed as an inkjet printer including the printing device serving to supply ink (printing material). The printer 50 has a controller 510, a carriage 520, and a head 540, in addition to the holder 600. The printer 50 serves to supply ink from each of the cartridges 20 attached to the holder 600 to the head 540 (i.e., function of printing device) and ejects ink from the head 540 onto a printing medium 90, such as printing sheet or label, so as to print various data, such as character strings, figures and images, on the printing medium 90.

The controller 510 of the printer 50 serves to control the various parts of the printer 50. The carriage 520 of the printer 50 is configured to move the head 540 relative to the printing medium 90. The head 540 of the printer 50 has an ink ejection mechanism configured to receive ink supply from each of the cartridges 20 attached to the holder 600 and eject the ink onto the printing medium 90. The controller 510 and the carriage 520 are electrically connected via a flexible cable 517. The ink ejection mechanism of the head 540 is operated by control signals from the controller 510.

According to this embodiment, the carriage 520 has the head 540 and the holder 600. This type of the printer 50 having the cartridges 20 attached to the holder 600 on the carriage 520 serving to move the head 540 is called "on-carriage type" printer.

According to another embodiment, the holder 600 may be provided at a different position from the carriage 520, and ink may be supplied from each of the cartridges 20 attached to the holder 600 to the head 540 of the carriage 520 through a flexible tube. This type of the printer is called "off-carriage type" printer.

According to this embodiment, the printer 50 has a main scan feed mechanism and a sub-scan feed mechanism to move the carriage 520 and the printing medium 90 relative to each other and implement printing on the printing medium 90. The main scan feed mechanism of the printer 50 includes a carriage motor 522 and a drive belt 524 and serves to transfer the power of the carriage motor 522 to the carriage 520 by means of the drive belt 524, so as to move back and forth the carriage 520 in a main scanning direction. The sub-scan feed mechanism of the printer 50 includes a feed motor 532 and a platen 534 and serves to transfer the power of the feed motor 532 to the platen 534, so as to feed the printing medium 90 in a sub-scanning direction orthogonal to the main scanning direction. The carriage motor 522 of the main scan feed mechanism and the feed motor 532 of the sub-scan feed mechanism are operated by control signals from the controller 510.

According to this embodiment, in the use state of the printing material supply system 10, the X axis represents the axis along the sub-scanning direction, in which the printing medium 90 is fed. The Y axis represents the axis along the main scanning direction, in which the carriage 520 is moved back and forth. The Z axis represents the axis along the direction of gravity. The X, Y and Z axes are orthogonal to one another. The use state of the printing material supply system 10 means the state of the printing material supply system 10 placed on a horizontal plane. In this embodiment, the horizontal plane is a plane parallel to the X axis and the Y axis.

According to this embodiment, the positive X-axis direction represents the sub-scanning direction, and the negative X-axis direction represents its reverse direction. In this embodiment, the positive X-axis side forms the front face of the printing material supply system 10. According to this embodiment, the positive Y-axis direction represents the direction going from the right side face to the left side face of the printing material supply system 10, and the negative Y-axis direction represents its reverse direction. In this embodiment, the plurality of cartridges 20 attached to the holder 600 are arrayed in the direction along the Y axis.

A-2. Structure for Attachment of Cartridge to Holder

Figure 2:
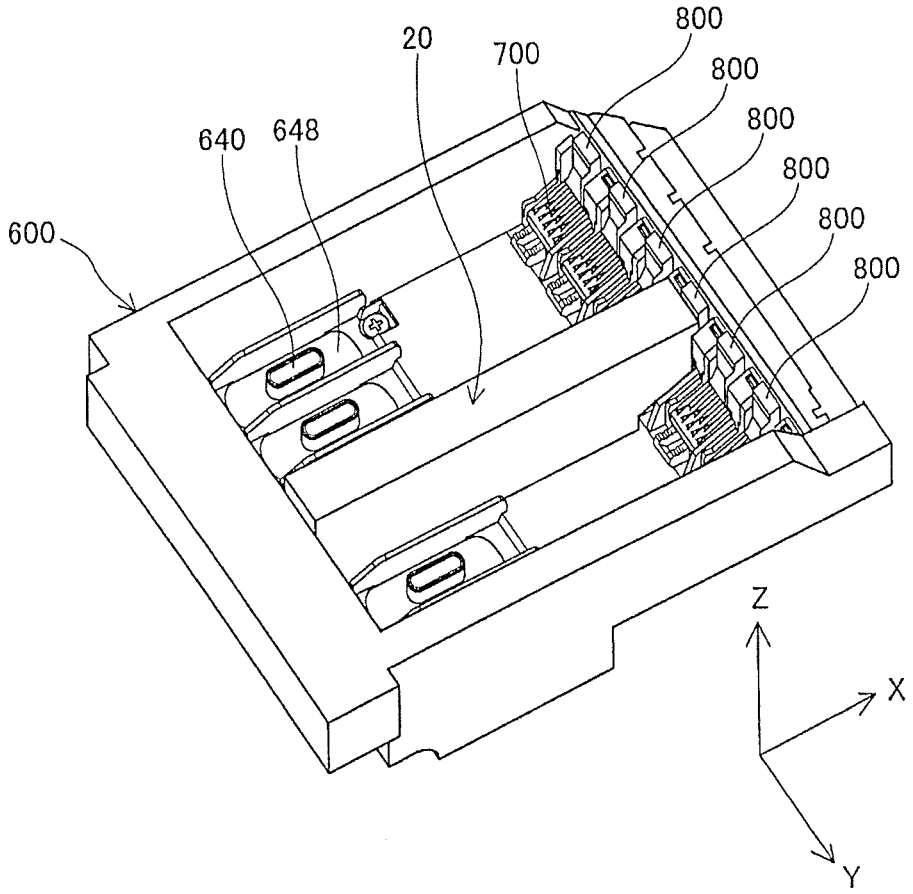
FIG. 2 is a perspective view illustrating a holder with a cartridge attached thereto.
Figure 3:
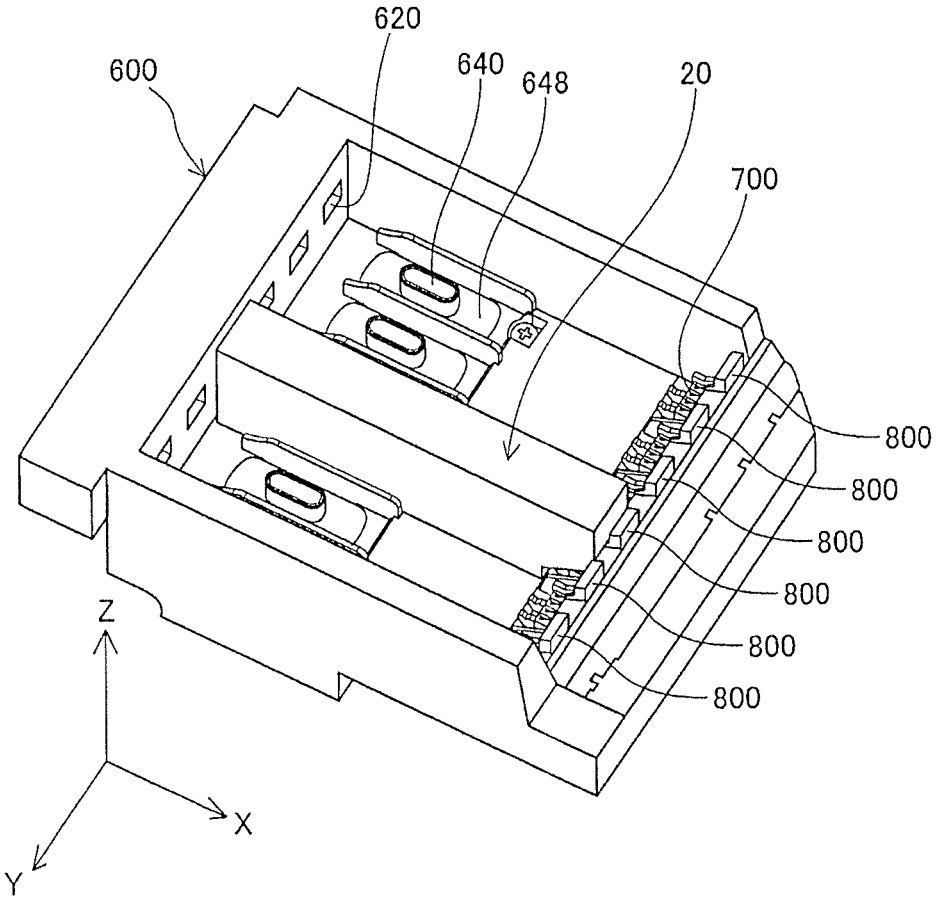
FIG. 3 is a perspective view illustrating a holder with the cartridge attached thereto.
Figure 4:
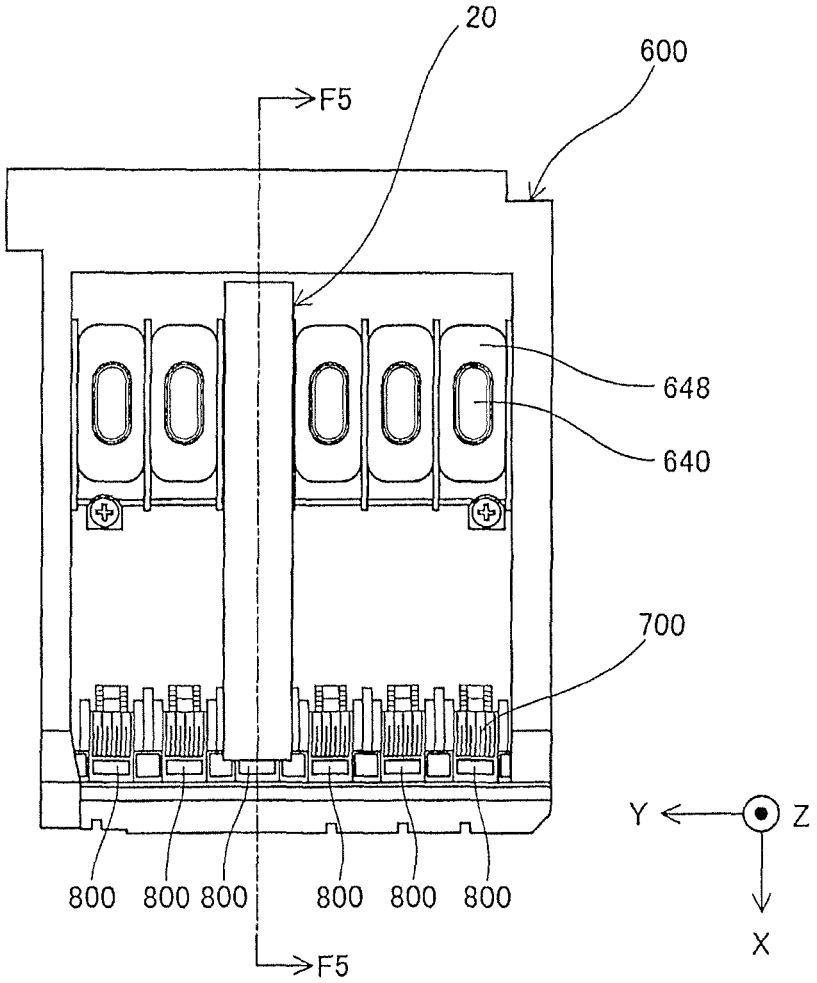
FIG. 4 is a top view illustrating the holder with the cartridge attached thereto.
Figure 5:
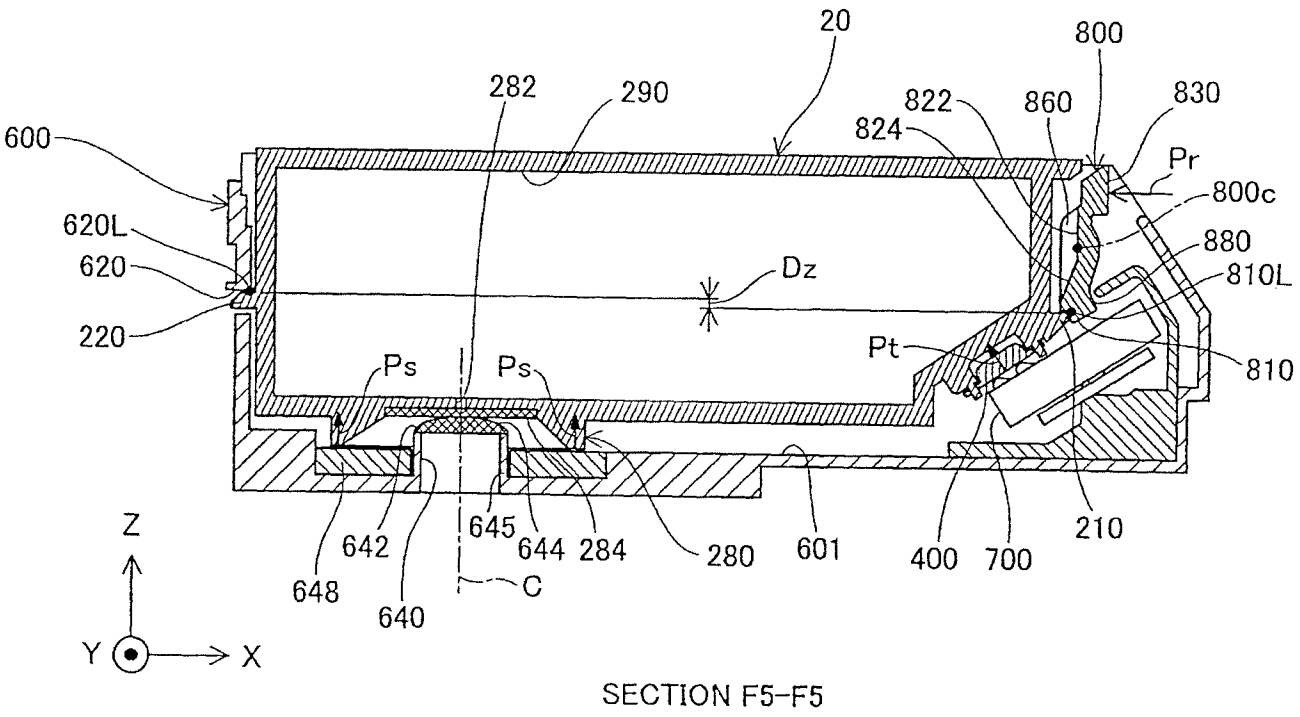
FIG. 5 is a sectional view illustrating the holder with the cartridge attached thereto, taken on an arrowed line F5-F5 in FIG. 4.

FIGS. 2 and 3 are perspective views illustrating the holder 600 with the cartridge 20 attached thereto. FIG. 4 is a top view illustrating the holder 600 with the cartridge 20 attached thereto. FIG. 5 is a sectional view of the holder 600 with the cartridge 20 attached thereto, taken on an arrowed line F5-F5 of FIG. 4. In the state illustrated in FIGS. 2 to 5, one cartridge 20 is properly attached at a designed attachment position of the holder 600.

The holder 600 of the printer 50 has a plurality of slots (mounting spaces) formed corresponding to the plurality of cartridges 20 to receive the respective cartridge 20 attached thereto. In the printer 50, each of the slots provided in the holder 600 has an ink supply tube (printing material supply tube) 640, a terminal base 700, a lever 800, a first device-side locking element 810 and a second device-side locking element 620.

As shown in FIG. 5, the cartridge 20 has a first cartridge-side locking element 210, a second cartridge-side locking element 220, an ink chamber (printing material chamber) 290, an ink supply port (printing material supply port) 280 and a circuit board 400 corresponding to each of the slots provided in the holder 600 of the printer 50. According to this embodiment, an ink flow path 282 communicating with the ink chamber 290 is formed at the ink supply port (ink supply structure) 280 of the cartridge 20, so that ink is supplied from the ink chamber 290 through the ink flow path 282 to outside of the cartridge 20. According to this embodiment, a resin foam 284 is provided at the exit of the ink flow path 282 to prevent unintentional leakage of ink from the ink flow path 282.

Connecting the ink supply tube 640 of the printer 50 with the ink supply port 280 of the cartridge 20 enables ink to be supplied from the ink chamber 290 of the cartridge 20 to the head 540. The ink supply tube 640 has a peripheral end 642 to be connected with the cartridge. A base end 645 of the ink supply tube 640 is provided on the bottom face of the holder 600. According to this embodiment, the ink supply tube 640 has a central axis C parallel to the Z axis as shown in FIG. 5. The direction going from the base end 645 to the peripheral end 642 of the ink supply tube 640 along the central axis C is the positive Z-axis direction.

According to this embodiment, a porous filter 644 serving to filter the ink supplied from the cartridge 20 is provided at the peripheral end 642 of the ink supply tube 640. The porous filter 644 may be made of, for example, stainless steel mesh or stainless steel woven fabric. According to another embodiment, the peripheral end 642 of the ink supply tube 640 may be configured without a porous filter.

According to this embodiment, as shown in FIGS. 2 to 5, an elastic member 648 is provided around the ink supply tube 640 to seal the ink supply port 280 of the cartridge 20 and thereby prevent leakage of ink from the ink supply port 280 to the periphery. In the attached state of the cartridge 20 to the holder 600, a pressing force Ps including a positive Z-axis component is applied from the elastic member 648 to the ink supply port 280.

The terminal base 700 of the printer 50 is provided on the positive X-axis side of the ink supply tube 640. The terminal base 700 has device-side terminals that are electrically connectable with cartridge-side terminals provided on the circuit board 400. In the attached state of the cartridge 20 to the holder 600, a pressing force Pt including a positive Z-axis component is applied from the device-side terminals provided on the terminal base 700 to the circuit board 400.

The first device-side locking element 810 of the printer 50 is formed as part of the lever 800 to engage with the first cartridge-side locking element 210 at a first locking position 810L. The first locking position 810L is located on the positive Z-axis side and on the positive X-axis side of the contact position where the circuit board 400 is in contact with the device-side terminals provided on the terminal base 700. The first device-side locking element 810 engages with the first cartridge-side locking element 210 to restrict the motion of the cartridge 20 in the positive Z-axis direction.

The second device-side locking element 620 of the printer 50 is formed as part of the holder 600 to engage with the second cartridge-side locking element 220 at a second locking position 620L. The second locking position 620L is located on the positive Z-axis side and the negative X-axis side of the ink supply tube 640. The second device-side locking element 620 engages with the second cartridge-side locking element 220 to restrict the motion of the cartridge 20 in the positive Z-axis direction.

For attachment and detachment of the cartridge 20 to and from the holder 600, the cartridge 20 is turned along a plane parallel to the Z axis and the X axis about the engagement of the second cartridge-side locking element 220 and the second device-side locking element 620 as the pivot point of rotation. The second cartridge-side locking element 220 and the second device-side locking element 620 accordingly serve as the pivot point of rotation of the cartridge 20 during attachment and detachment of the cartridge 20. The details of attachment and detachment of the cartridge 20 to and from the holder 600 will be described later.

The lever 800 of the printer 50 has a pivotal center 800*c* on the positive Z-axis side and on the positive X-axis side of the first locking position 810L where the first device-side locking element 810 engages with the first cartridge-side locking element 210. The lever 800 is provided to be rotatable such that the first device-side locking element 810 moves in the positive X-axis direction from the first locking position 810L to engage with and disengage from the first cartridge-side locking element 210.

The lever 800 has an operating member 830 provided to receive the user's operating force Pr toward the negative X-axis direction and located on the positive Z-axis side and the positive X-axis side of the pivotal center 800*c*. The user's operating force Pr applied to the operating member 830 turns the lever 800 to move the first device-side locking element 810 in the positive X-axis direction from the first locking position 810L and thereby disengage the first device-side locking element 810 from the first cartridge-side locking element 210. The cartridge 20 can thus be detached from the holder 600.

As shown in FIG. 5, in the attached state of the cartridge 20 to the holder 600, the first locking position 810L is located on the negative Z-axis side by a distance Dz from the second locking position 620L. The pressing forces Ps and Pt applied from the holder 600 to the cartridge 20 act in the direction to enhance the engagement between the first cartridge-side locking element 210 and the first device-side locking element 810 (i.e., the direction including a positive X-axis component and a positive Z-axis component), based on the moment balance with the second locking position 620L serving as the pivot point of rotation of the cartridge 20. This enables the cartridge 20 to be stably held at the designed attachment position.

Figure 6A:
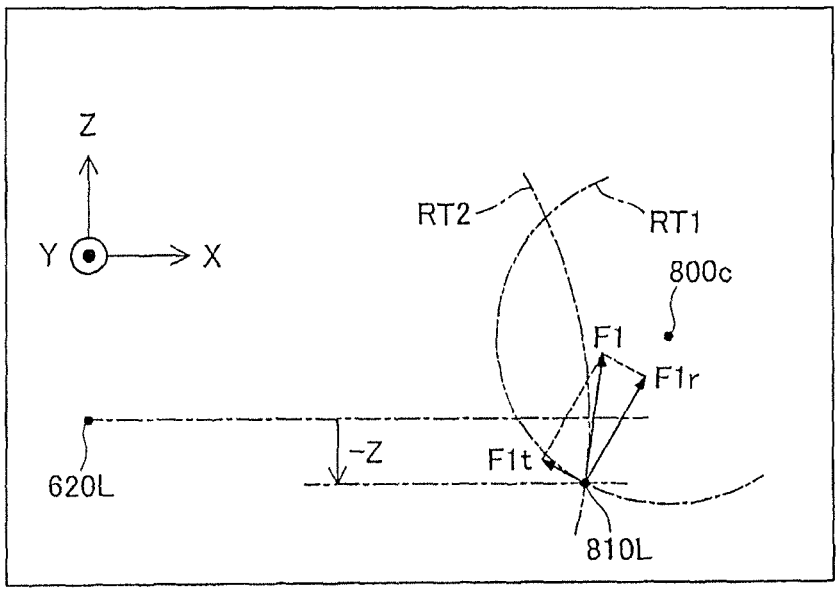
FIGS. 6A and 6B show how the force is applied from the cartridge to a lever at a first locking position.
Figure 6B:
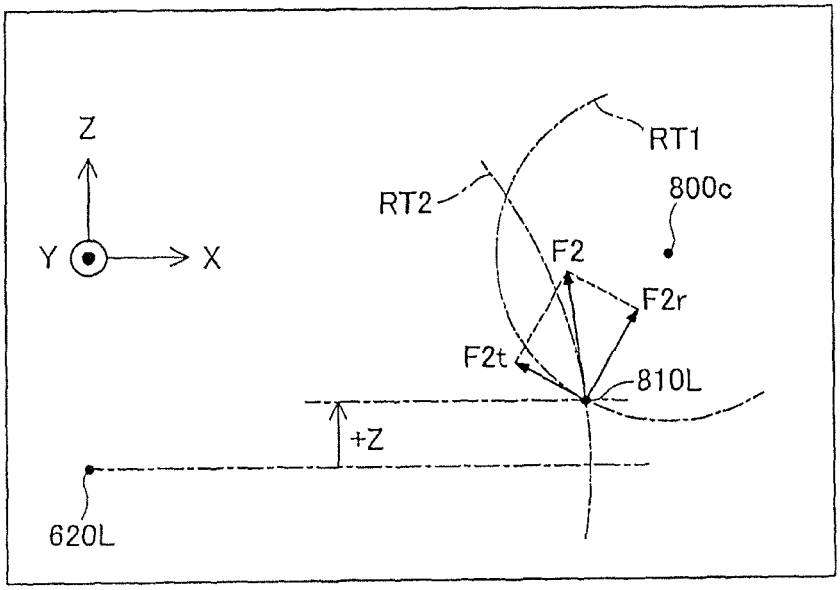

FIGS. 6A and 6B show how the force is applied from the cartridge 20 to the lever 800 at the first locking position 810L. In the state of FIG. 6A where the first locking position 810L is located on the negative Z-axis side of the second locking position 620L, a force F1 is applied from the cartridge 20 to the lever 800 at the first locking position 810L. In the state of FIG. 6B where the first locking position 810L is located on the positive Z-axis side of the second locking position 620L, a force F2 is applied from the cartridge 20 to the lever 800 at the first locking position 810L. The force F1 shown in FIG. 6A has the same magnitude as that of the force F2 shown in FIG. 6B.

FIGS. 6A and 6B schematically show the positional relationships of the first locking position 810L, the second locking position 620L and the pivotal center 800*c* to one another on the X axis and on the Z axis. The difference between the two positional relationships shown in FIGS. 6A and 6B is only the difference of the second locking position 620L on the Z axis. An arc RT1 shown in FIGS. 6A and 6B represents the rotation locus of the first locking position 810L about the pivotal center 800*c*. An arc RT2 shown in FIGS. 6A and 6B represents the rotation locus of the first locking position 810L about the second locking position 620L.

In the state of FIG. 6A where the first locking position 810L is located on the negative Z-axis side of the second locking position 620L, the force F1 applied in the tangential direction of the arc RT2 at the first locking position 810L has a positive X-axis component and a positive Z-axis component. The force F1 is accordingly resolved into a component F1*t* in the tangential direction of the arc RT1 and a component F1*r* in the radial direction of the arc RT1.

In the state of FIG. 6B where the first locking position 810L is located on the positive Z-axis side of the second locking position 620L, the force F2 applied in the tangential direction of the arc RT2 at the first locking position 810L has a negative X-axis component and a positive Z-axis component. The force F2 is accordingly resolved into a component F2*t* in the tangential direction of the arc RT1 and a component F2*r* in the radial direction of the arc RT1.

As clearly understood from the comparison between FIGS. 6A and 6B, when the magnitude of force F1 is equal to the magnitude of force F2 (F1=F2), the positional relationships of the first locking position 810L, the second locking position 620L and the pivotal center 800*c* to one another cause the relation "F1*t*<F2*t*" of the force components in the tangential direction of the arc RT1 and the relation "F1*r*>F2*r*" of the force components in the radial direction of the arc RT1. The state where the first locking position 810L is located on the negative Z-axis side of the second locking position 620L has the larger force component from the cartridge 20 toward the pivotal center 800*c* of the lever 800 and the smaller force component of rotating the lever 800 clockwise, viewed from the positive Y-axis direction, around the pivotal center 800*c* than the state where the first locking position 810L is located on the positive Z-axis side of the second locking position 620L. In other words, the state where the first locking position 810L is located on the negative Z-axis side of the second locking position 620L has the stronger engagement between the first cartridge-side locking element 210 and the first device-side locking element 810 than the state where the first locking position 810L is located on the positive Z-axis side of the second locking position 620L.

A-3. Detailed Structure of Cartridge

Figure 7:
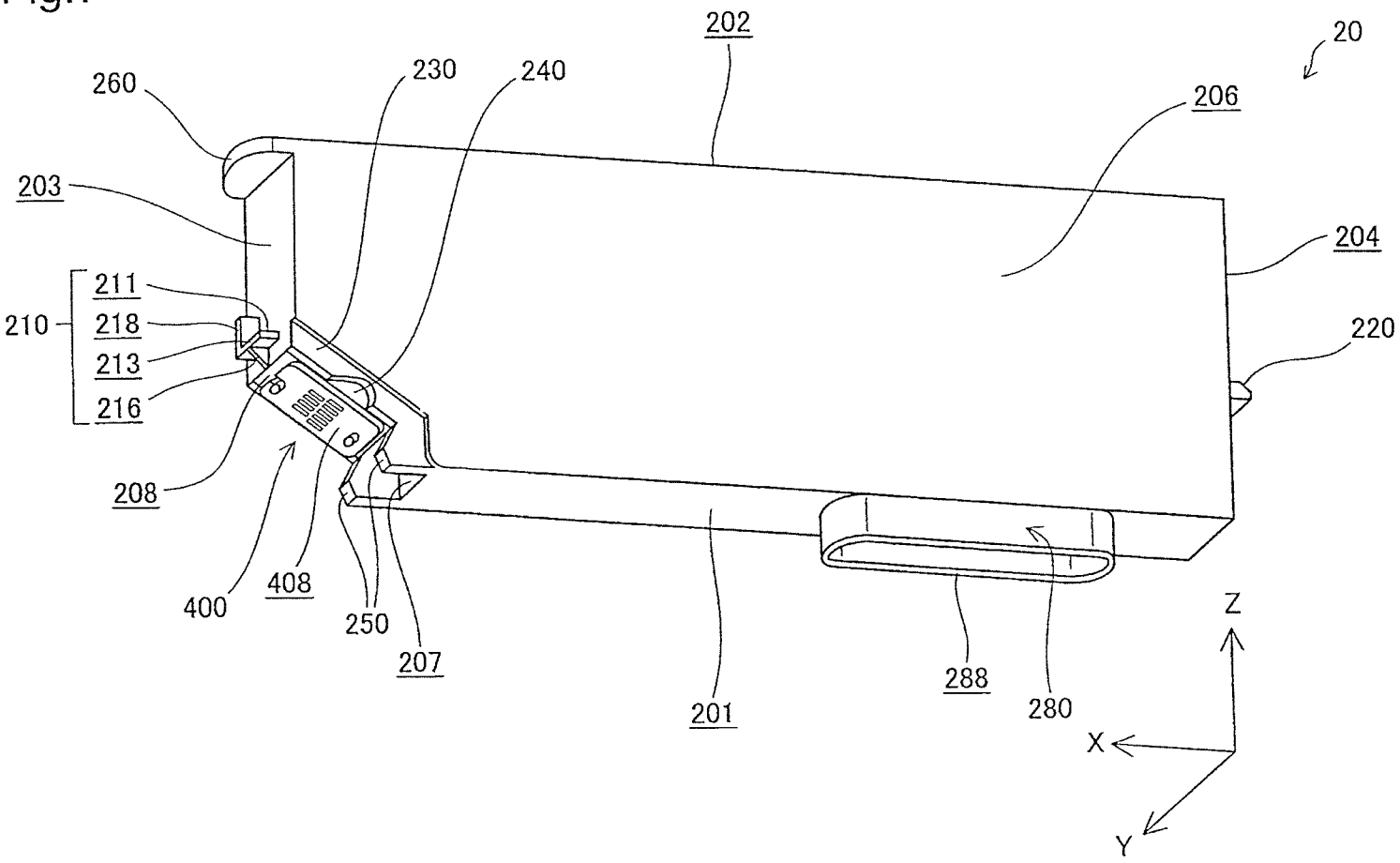
FIG. 7 is a perspective view illustrating the structure of the cartridge.
Figure 8:
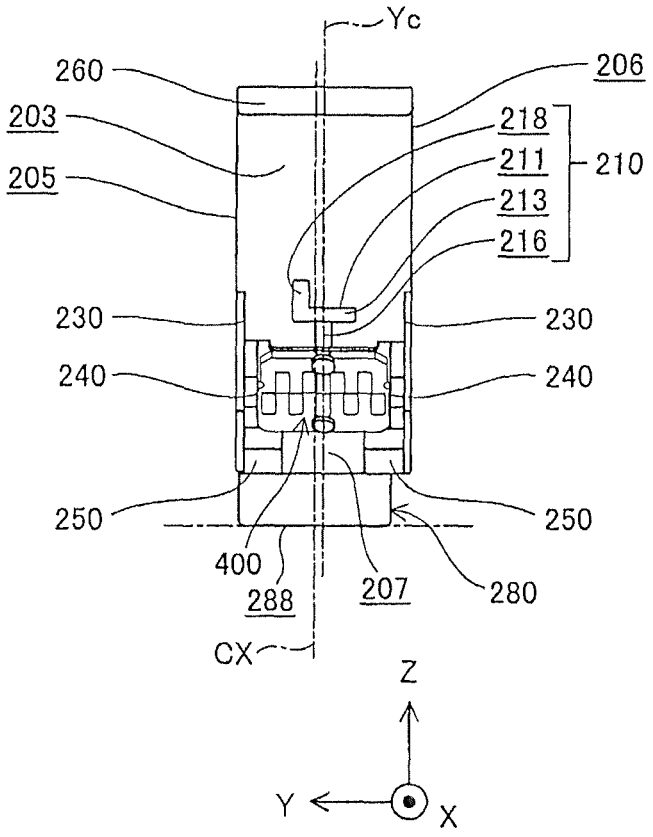
FIG. 8 is a front view illustrating the structure of the cartridge.
Figure 9:
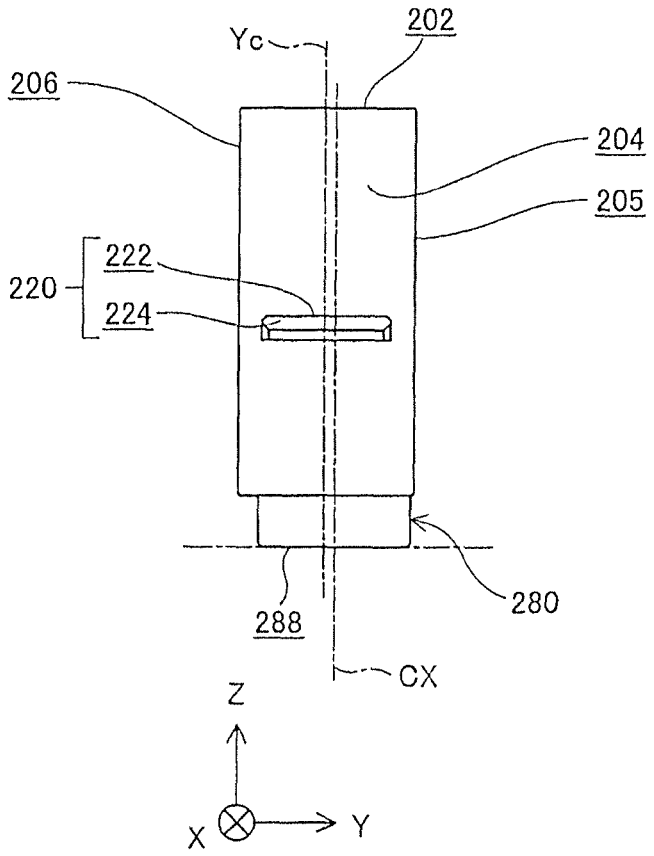
FIG. 9 is a rear view illustrating the structure of the cartridge.
Figure 10:
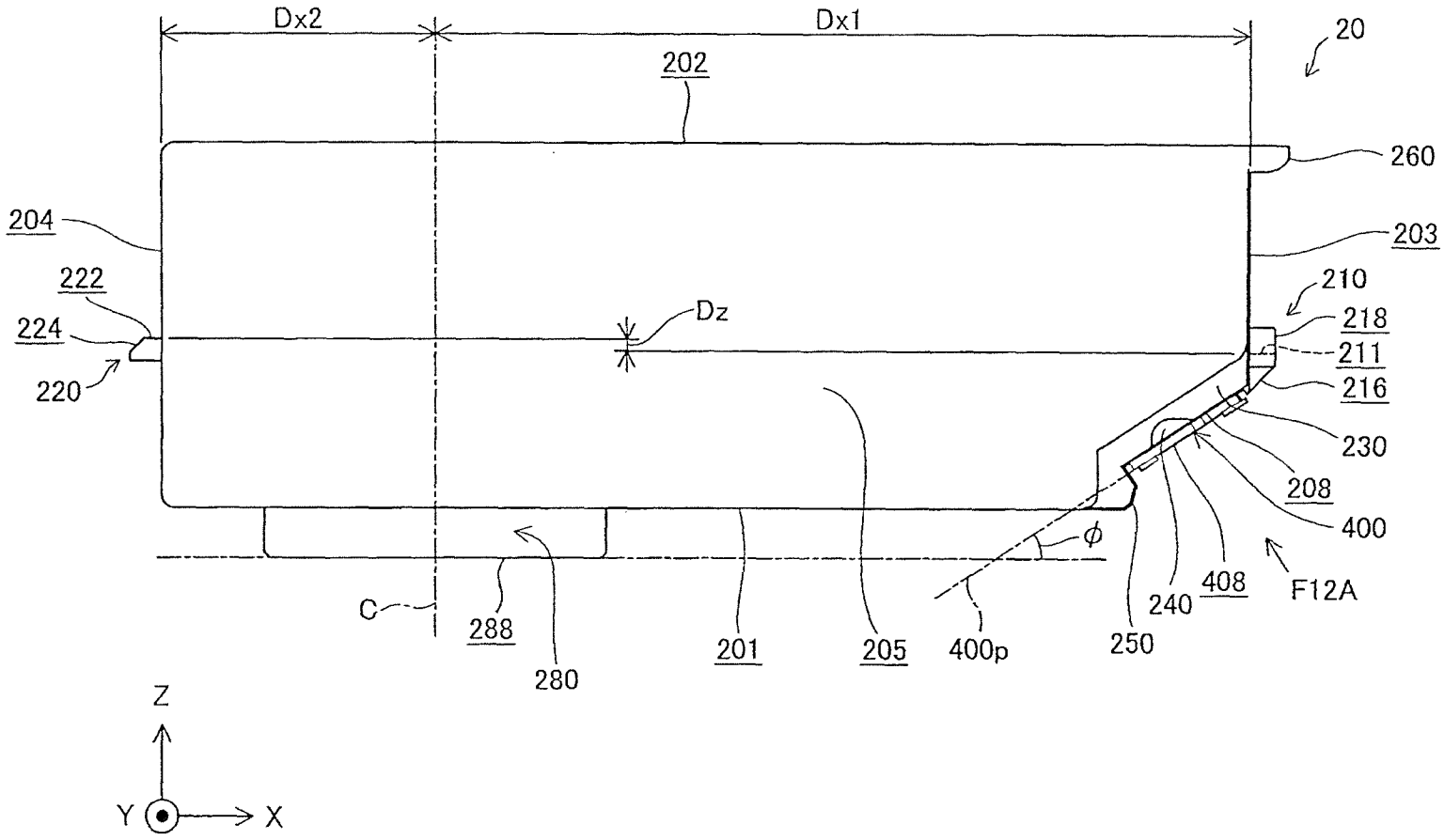
FIG. 10 is a left side view illustrating the structure of the cartridge.
Figure 11:
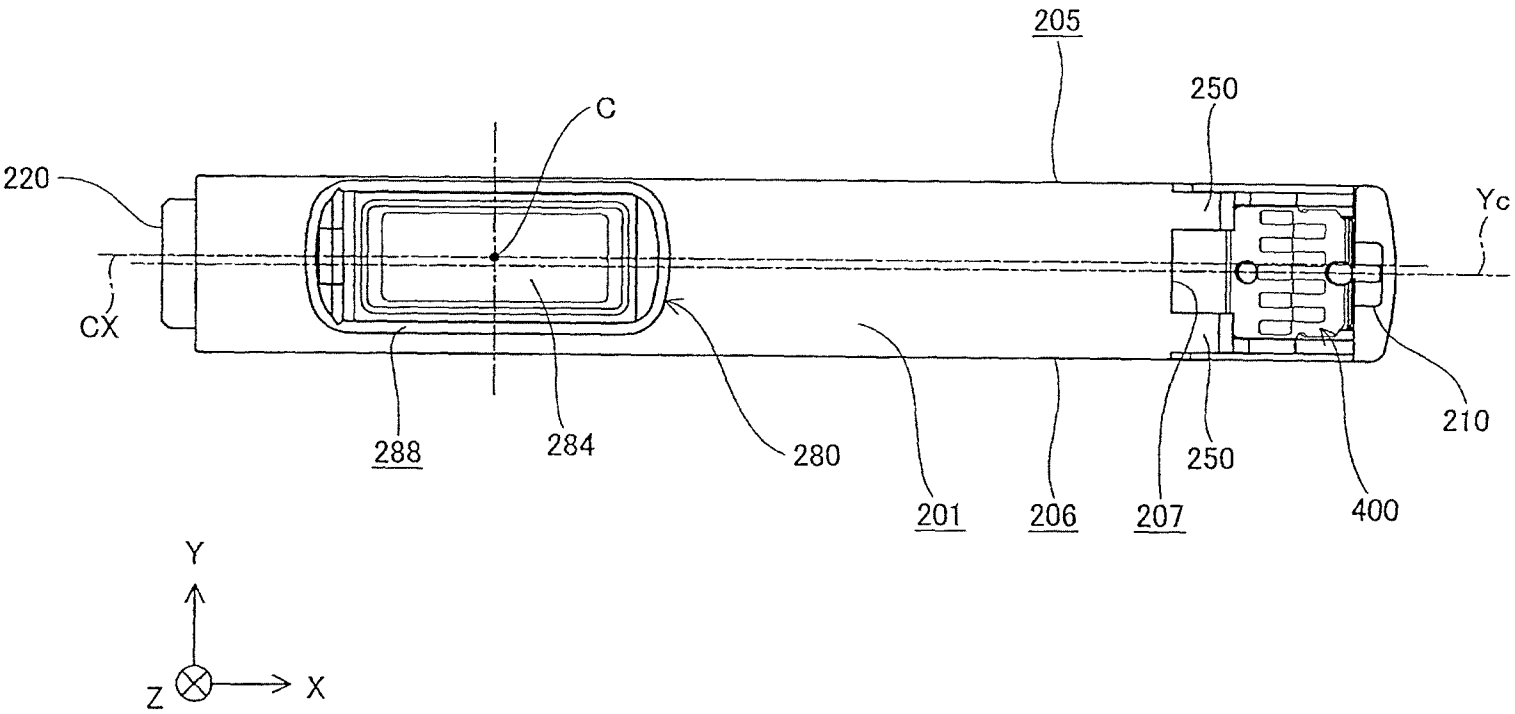
FIG. 11 is a bottom view illustrating the structure of the cartridge.

FIG. 7 is a perspective view illustrating the structure of the cartridge 20. FIG. 8 is a front view illustrating the structure of the cartridge 20. FIG. 9 is a rear view illustrating the structure of the cartridge 20. FIG. 10 is a left side view illustrating the structure of the cartridge 20. FIG. 11 is a bottom view illustrating the structure of the cartridge 20.

In the description of the cartridge 20, the X axis, the Y axis and the Z axis with respect to the cartridge 20 attached to the holder 600 are regarded as the axes on the cartridge 20. According to this embodiment, in the attached state of the cartridge 20 to the holder 600, the positive X-axis side forms the front face of the cartridge 20. A plane CX shown in FIGS. 8, 9 and 11 is a plane that passes through the central axis C and is parallel to the Z axis and the X axis. A plane Yc shown in FIGS. 8, 9 and 11 is a plane that passes through the center of the width or the Y-axis direction length of the cartridge 20 and is parallel to the Z axis and the X axis.

As shown in FIGS. 7 to 11, the cartridge 20 has six planes defining the profile of approximate rectangular prism, first face 201, second face 202, third face 203, fourth face 204, fifth face 205 and sixth face 206. According to this embodiment, the cartridge 20 also has a seventh face 207 and an eighth face 208 provided between the first face 201 and the third face 203, in addition to the first to the sixth faces 201 to 206 corresponding to the six planes of the approximate rectangular prism profile. The space defined by the first to the eighth faces 201 to 208 serves as the ink chamber 290.

The first to the eighth faces 201 to 208 are provided as substantial planes, which may not be perfectly flat over the whole surface but may have partial irregularity. According to this embodiment, the first to the eighth faces 201 to 208 form the outer surfaces of the assembly of the plurality of members. According to this embodiment, the first to the eighth faces 201 to 208 are made of plate-like members. According to other embodiments, part of the first to the eighth faces 201 to 208 may be made of a film (thin film) member. The first to the eighth faces 201 to 208 are made of a resin material and more specifically made of a resin material having the higher rigidity than polypropylene (PP) (e.g., polyacetal (POM)) in this embodiment.

According to this embodiment, the cartridge 20 has the length (X-axis direction length), the width (Y-axis direction length) and the height (Z-axis direction length), wherein the length, the height and the width descend in this order. The magnitude relation of the length, the width and the height of the cartridge 20 is, however, not limited to this order but may be determined arbitrarily; for example, the height, the length and the width may descend in this order or the height, the length and the width may be equal to one another.

The first face 201 and the second face 202 of the cartridge 20 are the faces parallel to the X axis and the Y axis and are located to be opposed to each other in the Z-axis direction. The first face 201 is located on the negative Z-axis side, and the second face 202 is located on the positive Z-axis side. The first face 201 and the second face 202 are located to intersect the third face 203, the fourth face 204, the fifth face 205 and the sixth face 206. In the description herein, the expression that "two faces intersect or cross each other" means one of the state that two faces actually cross each other, the state that an extension of one face intersects the other face, and the state that extensions of two faces cross each other. According to this embodiment, in the attached state of the cartridge 20 to the holder 600, the first face 201 forms the bottom face of the cartridge 20, and the second face 202 forms the top face of the cartridge 20.

Figure 5A:
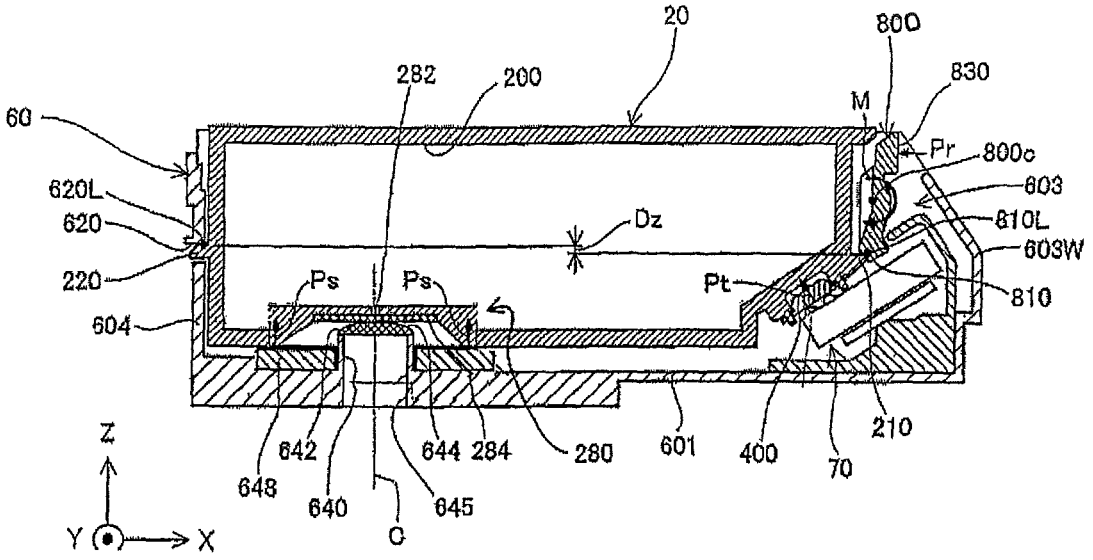
FIG. 5A is a sectional view illustrating a holder with a cartridge attached thereto.

The ink supply port 280 is formed in the first face 201. The ink supply port 280 is protruded in the negative Z-axis direction from the first face 201 and has an open surface 288 at its negative Z-axis end with an opening in a plane parallel to the X axis and the Y axis. According to this embodiment, as shown in FIG. 11, the resin foam 284 is provided inside the ink supply port 280 at the position on the positive Z-axis side of the open surface 288. According to this embodiment, before shipment of the cartridge 20, the open surface 288 of the ink supply port 280 is sealed with a sealing member (not shown), such as a cap or a film. For attachment of the cartridge 20 to the holder 600, the sealing member (not shown) to seal the open surface 288 is removed from the cartridge 20. As can be seen in FIG. 5A, ink supply port 280 need not protrude from the first face 201. Rather, in one embodiment, it can be flush or substantially flush with the first face 201. In such an embodiment, ink supply tube 640 is raised so as to be proximate to the first face when the cartridge 20 is mounted. As used herein, "proximate" can mean "close to," "near" or "on."

According to this embodiment, the ink supply port 280 is protruded in the negative Z-axis direction with the center on the central axis C of the ink supply tube 640. According to another embodiment, the center of the ink supply port 280 may be deviated from the central axis C of the ink supply tube 640. According to this embodiment, the open surface 288 of the ink supply port 280 viewed from the negative Z-axis direction toward the positive Z-axis direction is line-symmetric with respect to axes parallel to the X axis and the Y axis. According to another embodiment, the open surface 288 of the ink supply port 280 may be asymmetric. The open surface 288 viewed from the Z-axis direction is in the rounded rectangular shape according to this embodiment but may be in any other suitable shape, e.g., precise circle, ellipse, oval, square or rectangle according to other embodiments.

The third face 203 and the fourth face 204 of the cartridge 20 are the faces parallel to the Y axis and the Z axis and are located to be opposed to each other in the X-axis direction. The third face 203 is located on the positive X-axis side, and the fourth face 204 is located on the negative X-axis side. The third face 203 and the fourth face 204 are located to intersect the first face 201, the second face 202, the fifth face 205 and the sixth face 206. According to this embodiment, in the attached state of the cartridge 20 to the holder 600, the third face 203 forms the front face of the cartridge 20, and the fourth face 204 forms the rear face of the cartridge 20.

The first cartridge-side locking element 210 is provided on the third face 203 and is located on the positive Z-axis side and on the positive X-axis side of the ink supply port 280 and the circuit board 400. The first cartridge-side locking element 210 has a first locking surface 211 facing in the positive Z-axis direction. Turning the lever 800 causes the first device-side locking element 810 to engage with the first locking surface 211 at the first locking position 810L and thereby restrict the motion of the cartridge 20 in the positive Z-axis direction.

According to this embodiment, the first cartridge-side locking element 210 is provided as a projection protruded in the positive X-axis direction from the third face 203. The first cartridge-side locking element 210 is thus readily formed on the third face 203 and is readily checked by the user in the course of attachment of the cartridge 20.

According to this embodiment, as shown in FIGS. 7, 8 and 10, the first cartridge-side locking element 210 is protruded from the third face 203 to be formed as the L-shaped projection with two sides respectively parallel to the Y axis and the Z axis. A wall in a triangular shape (viewed from the Y-axis direction) is formed on the negative Z-axis side from the approximate center of the Y-axis parallel portion of the L-shaped projection to be extended from the positive X-axis end of the L-shaped projection to the third face 203.

According to this embodiment, the first cartridge-side locking element 210 has a third locking surface 213 facing in the positive X-axis direction, in addition to the first locking surface 211 facing in the positive Z-axis direction. Turning the lever 800 causes the first device-side locking element 810 to engage with the first locking surface 211 and the third locking surface 213 at the first locking position 810L and thereby restrict the motion of the cartridge 20 in the positive Z-axis direction and in the positive X-axis direction. This enables the cartridge 20 to be more stably held at the designed attachment position.

According to this embodiment, the first locking surface 211 of the first cartridge-side locking element 210 is provided as a plane facing in the positive Z-axis direction, which forms the Y-axis parallel portion of the L-shaped projection. In other words, the first locking surface 211 is the plane parallel to the X axis and the Y axis. According to this embodiment, the third locking surface 213 of the first cartridge-side locking element 210 is provided as a plane facing in the positive X-axis direction, which forms the Y-axis parallel portion of the L-shaped projection. In other words, the third locking surface 213 is the plane parallel to the Y axis and the Z axis.

According to this embodiment, the first cartridge-side locking element 210 has a sloped surface 216 inclined in the negative Z-axis direction and in the positive X-axis direction. The positive Z-axis side of the sloped surface 216 is adjacent to the negative Z-axis side of the third locking surface 213 adjoining to the positive X-axis side of the first locking surface 211. The negative Z-axis side of the sloped surface 216 is adjacent to the position where the third face 203 adjoins to the eighth face 208. This structure enables the first device-side locking element 810 to be smoothly guided to the first locking surface 211 for attachment of the cartridge 20 to the holder 600. According to this embodiment, the sloped surface 216 of the first cartridge-side locking element 210 is formed as a plane on the positive X-axis side of the triangular-shaped wall formed on the negative Z-axis side of the L-shaped projection.

According to this embodiment, the first cartridge-side locking element 210 also has an extended surface 218 formed by extending in the positive Z-axis direction part of the third locking surface 213 adjoining to the positive X-axis side of the first locking surface 211. In the course of attachment of the cartridge 20 to the holder 600, this structure prevents the lever 800 from running on the positive Z-axis side of the first locking surface 211. According to this embodiment, the extended surface 218 of the first cartridge-side locking element 210 is formed as a plane facing in the positive X-axis direction, which forms the Z-axis parallel portion of the L-shaped projection. In other words, the extended surface 218 is the plane parallel to the Y axis and the Z axis.

According to this embodiment, the third face 203 has a projection 260. The projection 260 has a shape extended from the second face 202 in the positive X-axis direction and is protruded in the positive X-axis direction from the third face 203. The projection 260 formed on the cartridge 20 enables the user to readily lift up the cartridge 20 in the positive Z-axis direction about the second cartridge-side locking element 220 as the pivot point of rotation for detachment of the cartridge 20 from the holder 500 by simply placing the user's finger on the projection 260 after pressing the operating member 830 of the lever 800 in the negative X-axis direction. According to other embodiments, the third face 203 may be designed without the projection 260.

The second cartridge-side locking element 220 is provided on the fourth face 204 and is located on the positive Z-axis side and on the negative X-axis side of the ink supply port 280 and the circuit board 400. The second cartridge-side locking element 220 has a second locking surface 222 facing in the positive Z-axis direction. Engaging the second locking surface 222 with the second device-side locking element 620 restricts the motion of the cartridge 20 in the positive Z-axis direction.

According to this embodiment, for attachment and detachment of the cartridge 20 to and from the holder 600, the second cartridge-side locking element 220 engages with the second device-side locking element 620 and serves as the pivot point of rotation of the cartridge 20 relative to the holder 600. This structure ensures easy attachment and detachment of the cartridge 20 to and from the holder 600.

According to this embodiment, the second cartridge-side locking element 220 is provided as a projection protruded in the negative X-axis direction from the fourth face 204. The second cartridge-side locking element 220 is thus readily formed on the fourth face 204 and is readily checked by the user in the course of attachment of the cartridge 20.

According to this embodiment, the second locking surface 222 of the second cartridge-side locking element 220 is provided as a plane facing in the positive Z-axis direction, which forms the projection protruded in the negative X-axis direction from the fourth face 204. In other words, the second locking surface 222 is the plane parallel to the X axis and the Y axis.

According to this embodiment, the second cartridge-side locking element 220 has a sloped surface 224 provided adjacent to the negative X-axis side of the second locking surface 222 and inclined in the positive Z-axis direction and in the negative X-axis direction. This structure enables the second locking surface 222 to be smoothly guided to the second device-side locking element 620 for attachment of the cartridge 20 to the holder 600. According to other embodiments, the second cartridge-side locking element 220 may be designed without the sloped surface 224.

As shown in FIG. 10, the first locking surface 211 of the first cartridge-side locking element 210 is provided on the negative Z-axis side, i.e., on the side closer to the first face 201, by the distance Dz from the second locking surface 222 of the second cartridge-side locking element 220. In other words, the second locking surface 222 is located on the positive Z-axis side, i.e., on the side closer to the second face 202, by the distance Dz from the first locking surface 211. This structure enhances the engagement between the first cartridge-side locking element 210 and the first device-side locking element 810 in the attached state of the cartridge 20 to the holder 600 as described above with reference to FIG. 6.

According to this embodiment, as shown in FIGS. 8, 9 and 11, the first locking surface 211 of the first cartridge-side locking element 210 and the second locking surface 222 of the second cartridge-side locking element 220 are provided at the positions intersecting the plane Yc passing through the center of the width or the Y-axis direction length of the cartridge 20. This structure advantageously prevents the pressing forces Ps and Pt applied from the holder 600 to the cartridge 20 from acting to tilt the cartridge 20 in the Y-axis direction.

According to this embodiment, as shown in FIGS. 8, 9 and 11, the first locking surface 211 of the first cartridge-side locking element 210 and the second locking surface 222 of the second cartridge-side locking element 220 are provided at the positions intersecting the plane CX passing through the central axis C. This structure effectively prevents the pressing force Ps applied from the holder 600 to the cartridge 20 from acting to tilt the cartridge 20 in the Y-axis direction.

According to this embodiment, as shown in FIG. 10, a distance Dx1 on the X axis between the central axis C and the third face 203 is greater than a distance Dx2 on the X axis between the central axis C and the fourth face 204. In other words, the distance on the X axis from the second locking surface 222 of the second cartridge-side locking element 220 to the ink supply port 280 is less than the distance on the X-axis from the first locking surface 211 of the first cartridge-side locking element 210 to the ink supply port 280. The ink supply port 280 is provided at the position closer to the second locking surface 222, which is positioned relative to the holder 600 prior to the first locking surface 211, so that the cartridge 20 can readily be positioned relative to the holder 600.

According to this embodiment, as shown in FIG. 11, the Y-axis direction length of the first cartridge-side locking element 210 is less than the Y-axis direction length of the second cartridge-side locking element 220. According to this embodiment, the Y-axis direction length of the first cartridge-side locking element 210 is less than the Y-axis direction length of the circuit board 400. According to this embodiment, the Y-axis direction length of the second cartridge-side locking element 220 is substantially equal to the Y-axis direction length of the circuit board 400.

The fifth face 205 and the sixth face 206 of the cartridge 20 are the faces parallel to the Z axis and the X axis and are located to be opposed to each other in the Y-axis direction. The fifth face 205 is located on the positive Y-axis side, and the sixth face 206 is located on the negative Y-axis side. The fifth face 205 and the sixth face 206 are located to intersect the first face 201, the second face 202, the third face 203 and the fourth face 204. According to this embodiment, in the attached state of the cartridge 20 to the holder 600, the fifth face 205 forms the left side face of the cartridge 20, and the sixth face 206 forms the right side face of the cartridge 20.

The seventh face 207 of the cartridge 20 is provided at the corner connecting the first face 201 with the third face 203 and is extended in the positive Z-axis direction from the first face 201. The seventh face 207 is linked with the eighth face 208 on its positive Z-axis side and with the first face 201 on its negative Z-axis side. According to this embodiment, the seventh face 207 is the face parallel to the Y axis and the Z axis and is located to be opposed to the fourth face 204.

The eighth face 208 of the cartridge 20 is provided at the corner connecting the first face 201 with the third face 203 and is provided on the positive Z-axis side of the seventh face 207. The eighth face 208 is linked with the third face 203 on its positive Z-axis side and with the seventh face 207 on its negative Z-axis side. According to this embodiment, the eighth face 208 is inclined in the negative Z-axis direction and in the positive X-axis direction as shown in FIGS. 7 and 10.

The circuit board 400 is provided on the eighth face 208 according to this embodiment. As shown in FIG. 10, the circuit board 400 mounted on the eighth face 208 has a sloped surface (also called "cartridge-side sloped surface") 408 inclined in the negative Z-axis direction and in the positive X-axis direction. In the attached state of the cartridge 20 to the holder 600, the cartridge-side terminals provided on the cartridge-side sloped surface 408 of the circuit board 400 of the cartridge 20 are in contact with the device-side terminals provided on the terminal base 700 in the holder 600.

Figure 9A:
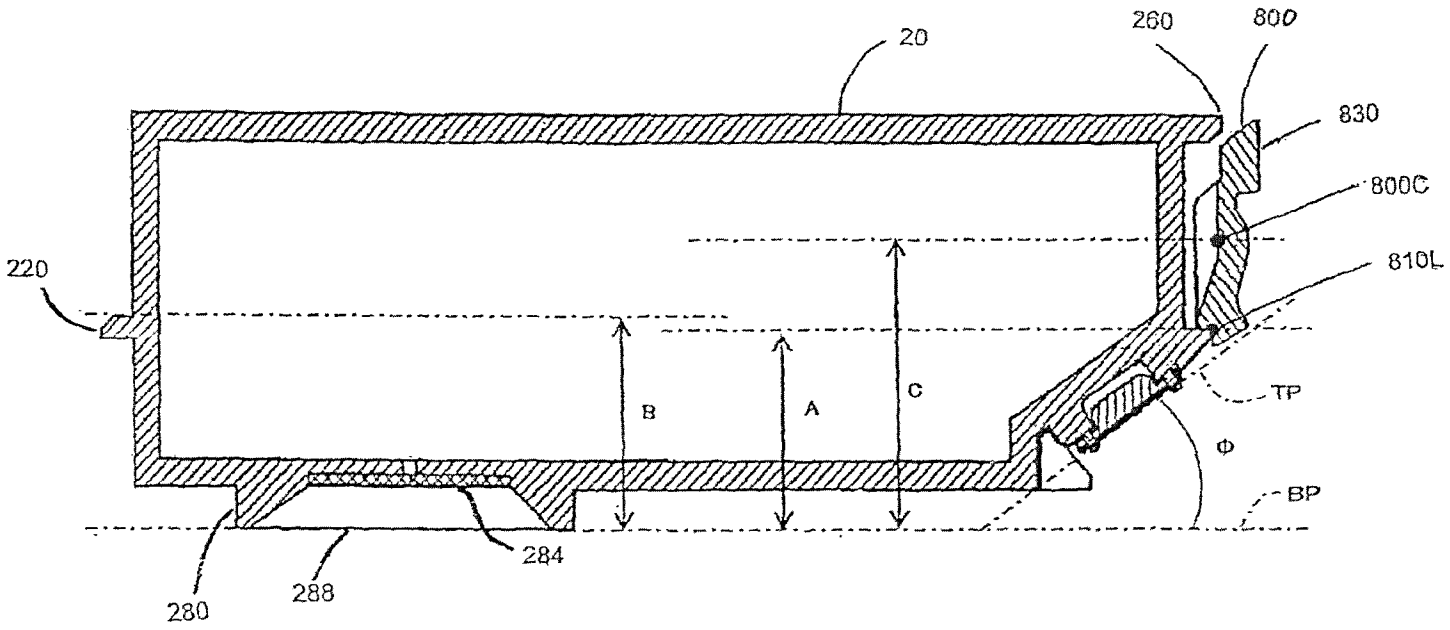
FIG. 9A is a view of a cartridge and the lever when the cartridge is in its mounted position.

As shown in FIG. 9A, plane BP is a plane formed by the mounting direction leading edge of the open surface 288 of ink supply port 280. Distance A is the distance between plane BP and the first locking surface 211 of the first cartridge-side locking element 210. Distance B is the distance between plane BP and an engagement portion of the second cartridge-side locking element 220. Distance C is the distance between plane BP and the lever 800's pivot point around axis 800C. As can be seen in FIG. 9A, the distance between plane BP and an engagement portion of the second cartridge-side locking element 220 is greater than the distance between plane BP and the first locking surface 211 of the first restriction portion 210 when measured in an orthogonal direction to the plane BP. The distance between plane BP and the first locking surface 211 of the first restriction portion 210 is less than the distance between plane BP and the lever 800's pivot point around axis 800C when measured in an orthogonal direction to the plane BP. Additionally as can be seen in FIG. 9A, plane TP is the plane formed by the cartridge-side sloped surface 408, which in this embodiment is parallel to the cartridge-side sloped surface 408 itself, and so for simplicity sake, cartridge-side sloped surface 408 may be used to refer to the plane TP. Plane TP is neither parallel nor perpendicular to plane BP. The sloped cartridge-side sloped surface 408 has cartridge-side terminals 400, which are in contact with the device-side terminals of the contact mechanism (FIG. 2).

The angle ϕ of inclination of the cartridge-side sloped surface 408 to the plane parallel to the X axis and the Y axis (i.e., the open surface 288 of the ink supply port 280) is preferably in a range of 25 to 40 degrees. Setting the angle of inclination of the cartridge-side sloped surface 408 to be not less than 25 degrees ensures a sufficient amount of wiping. The term "wiping" herein means that the cartridge-side terminals provided on the cartridge-side sloped surface 408 are rubbed by the device-side terminals provided on the terminal base 700 in the course of attachment of the cartridge 20 to the holder 600. The "amount of wiping" means the length of the cartridge-side terminals that can be rubbed by the device-side terminals. Such wiping removes dust and foreign particles adhering to the top of the cartridge-side terminals and reduces the potential connection failure between the cartridge-side terminals and the device-side terminals. Setting the angle of inclination of the cartridge-side sloped surface 408 to be not greater than 40 degrees enables the pressing force Pt applied from the device-side terminals provided on the terminal base 700 to the circuit board 400 to include a sufficient magnitude of the positive Z-axis component.

Figure 43A:
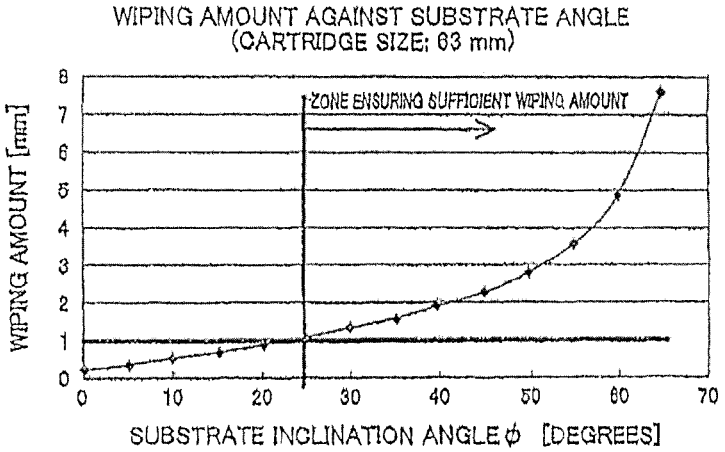
FIG. 43A is a graph showing a relation of wiping amount of a board terminal to a board inclination angle ϕ.
Figure 43B:
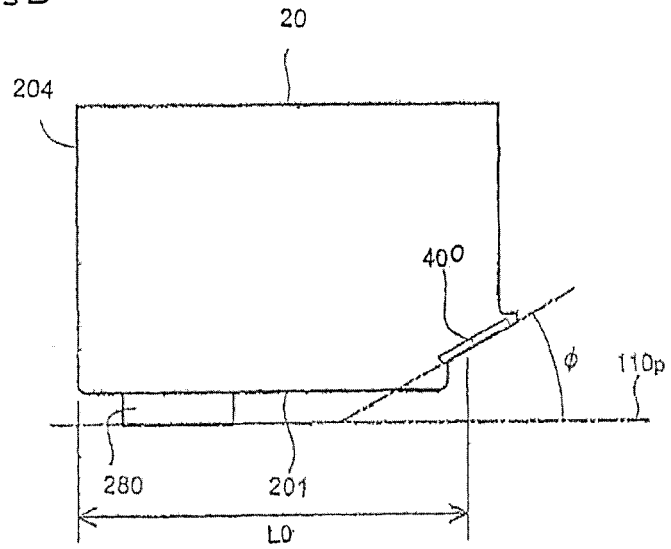
FIG. 43B shows the wiping amount of a board terminal.

FIGS. 43A and 43B shows the relation of a wiping amount of the terminal on the circuit board 400 by an apparatus-side terminal with respect to an inclination angle ϕ of the circuit board 400. The inclination angle ϕ of the circuit board 400 represents an angle between the plane 110*p* extended from the mounting direction leading edge of the ink supply port 280 and a plane in which the terminals of the circuit board 400 are arranged. The plane defined by the terminals is neither perpendicular nor parallel to the plane 110*p*. The inclination angle ϕ is generally an acute angle (less than 90 degrees). In this embodiment, the plane 110*p* extended from the mounting direction leading edge is parallel to the bottom face 201 of the cartridge 20. Also, the plane in which the terminals are arranged is parallel to the board surface of the circuit board 400. Accordingly, in this embodiment, the inclination angle ϕ is equal to the angle between the bottom face 201 of the cartridge 20 and the board surface of the circuit board 400. Also, for simplicity sake, the cartridge-side sloped surface 408 may be used interchangeably with "plane defined by the terminals" or "terminal plane". When contact portions 431-439 are referenced in connection with the cartridge-side sloped surface 408 the term "plane defined by the contact portions" or "contact portion plane" can be used interchangeably well. In the course of attachment or mounting of the cartridge 20, as shown in FIGS. 24-27, the front face 203 (the first surface) of the cartridge 20 goes down with slight pivotal rotation on the rear face 204 (the second surface) of the cartridge 20. In this process, the circuit board 400 slightly rotates and comes into contact with the apparatus-side contact forming members 731-739 on the terminal base 700, so that the respective contact portions 431-439 are wiped by the apparatus-side contact forming members 731-739. The wiping of the terminal on the circuit board 400 by the corresponding apparatus-side terminal properly removes the dust or oxide coating on the surface of the terminal on the circuit board 400 to enhance the electric conductivity (electrical connection).

The plot of FIG. 43A shows the wiping length (wiping amount) of the terminal on the circuit board 400 by the corresponding apparatus-side contact forming members as ordinate, and the board inclination angle ϕ as abscissa. The calculation is on the assumption that distance L0 in the X direction from the second surface (rear face) 204 of the cartridge 20 to the contact portion of the ground terminal 437 that comes into contact with the corresponding apparatus-side ground terminal 737 is 63 mm. In general, the greater board inclination angle ϕ causes the board surface to be closer to the vertical plane and increases the wiping amount. In order to sufficiently remove the dust or oxide coating on the surface of the terminal on the circuit board 400, the wiping amount is preferably not less than 1 mm. According to the graph of FIG. 43A, the board inclination angle ϕ is preferably not less than 25 degrees to ensure the wiping amount of not less than 1 mm.

Figure 25:
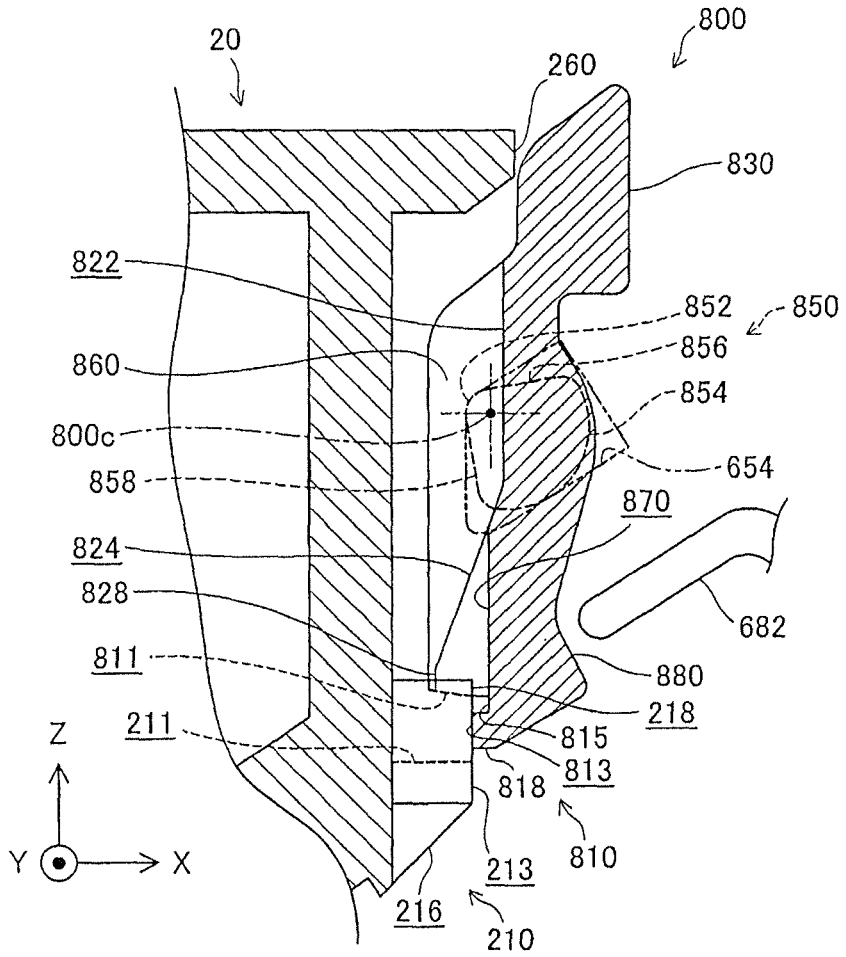
FIG. 25 illustrates moving the cartridge in the negative Z-axis direction from the state of FIG. 24.
Figure 44A:
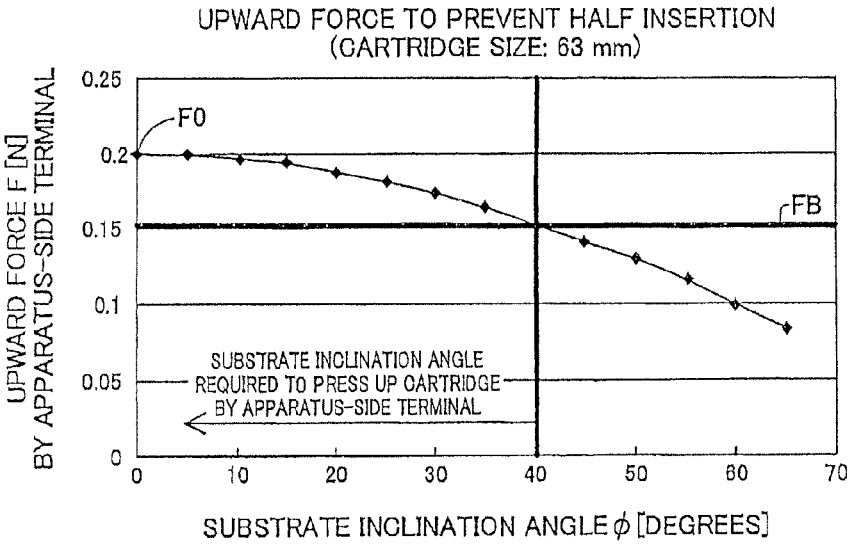
FIG. 44A is a graph showing a relation of upward force by an apparatus-side ground terminal to a board inclination angle ϕ.
Figure 44B:
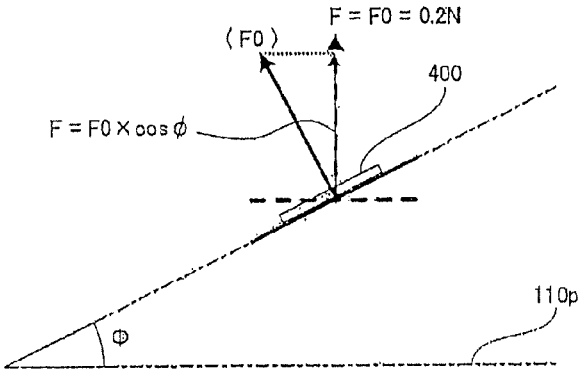
FIG. 44B shows the upward force by the apparatus-side ground terminal.

FIG. 44A shows the relation of upward force F by the apparatus-side ground terminal 737 to the board inclination angle ϕ in consideration of preventing half insertion of the cartridge. The calculation of FIG. 44A is also on the assumption that the distance L0 is equal to 63 mm, like the calculation of FIG. 43A. The weight of the cartridge (including the weight of ink) is assumed to be 30 grams. This value is the standard weight of the cartridge for inkjet printing apparatuses for household use. The "half insertion of the cartridge" denotes the state where the first device-side locking element 810 of the lever 800 is located just beside the elastic member 682 as shown in FIG. 25, i.e., the state immediately before the complete engagement. This state of half insertion is also called "half engagement". In this state of half engagement, only the apparatus-side ground terminal 737 among the plurality of apparatus-side contact forming members 731-739 applies the upward force to the circuit board 400. It should be noted that in the printing apparatus shown in FIG. 1, the holder 60 does not have a cover. When the user releases the hand in this state of half engagement, the cartridge 20 may be kept in this state of half engagement. The plot of FIG. 44A shows the calculation result of the upward force by the apparatus-side ground terminal 737 to prevent such half insertion of the cartridge 20. FIG. 44B shows the relation of the upward force F to the board inclination angle ϕ.

Figure 21:
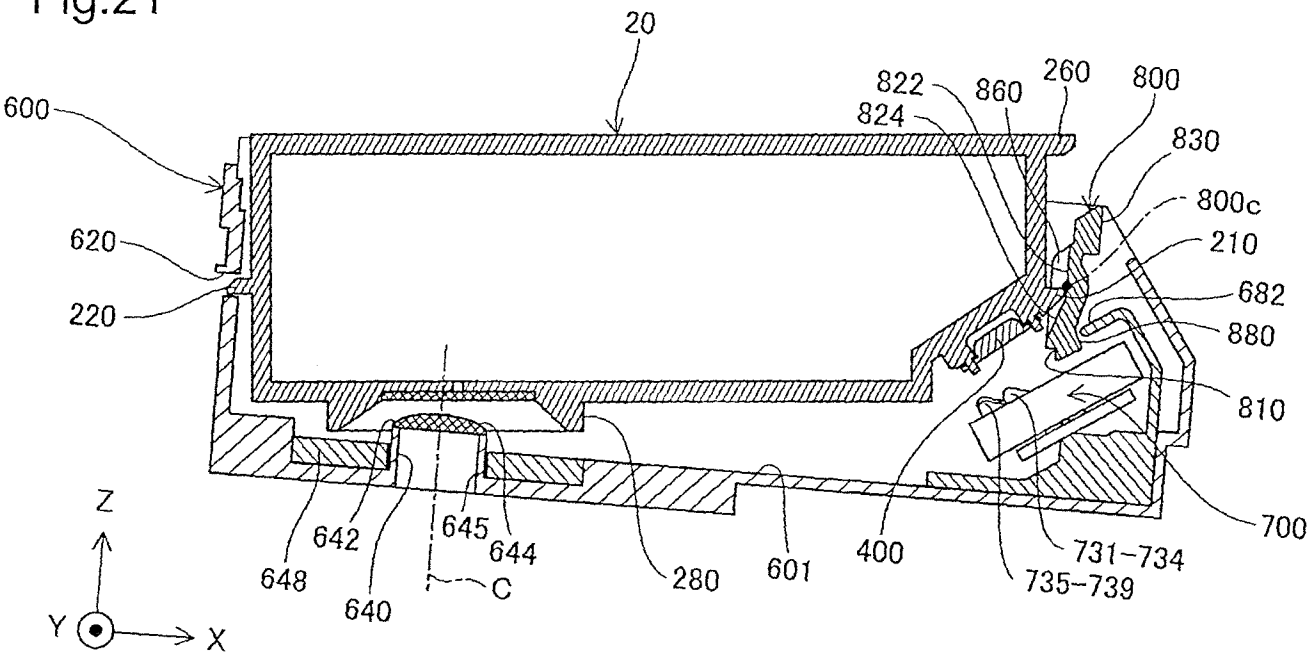
FIG. 21 illustrates attachment and detachment of the cartridge to and from the holder.

The upward force by the apparatus-side ground terminal 737 is a +Z-direction vector component (vertically upward vector component in this embodiment) of the force applied from the apparatus-side ground terminal 737 to the circuit board 400 (and the cartridge 20) in the state of half engagement of FIG. 21. When the ground terminal 437 of the circuit board 400 is pressed against the apparatus-side ground terminal 737, a pressing force in a direction perpendicular to the board surface of the circuit board 400 is applied to the ground terminal 437 by the elastic force of the apparatus-side ground terminal 737. The calculation of the upward force of FIG. 44A is on the assumption that pressing force F0 of the apparatus-side ground terminal 737 is 0.2 N in the direction perpendicular to the board surface. Since the upward force F (=F0×cos ϕ) is the +Z-direction vector component of the pressing force F0, F=F0=0.2 N holds at the board inclination angle ϕ=0 degree as shown by the broken line in FIG. FIG. 44B. The upward force F varies according to the curve F=F0×cos ϕ with a variation in board inclination angle ϕ. The curve of FIG. 44A is the curve F=F0×cos ϕ. With an increase in board inclination angle ϕ (ϕ approaching 90 degrees), the board surface approaches the XZ plane and reduces the upward force F. An upward force FB balancing with the cartridge 20 having the distance L0 of 63 mm and the weight of 30 grams is approximately 0.15 N (the position of thick horizontal line in FIG. 44A). This means that the upward force of not less than 0.15 N enables the cartridge 20 to be pressed vertically upward by the apparatus-side ground terminal 737. In order to ensure the upward force of not less than 0.15 N, the board inclination angle ϕ is preferably not greater than 40 degrees, as clearly understood from FIG. 44A.

When the user releases the hand in the state of half engagement of FIG. 25, the cartridge 20 may be kept in the state of half engagement. If the board inclination angle ϕ is set to be not greater than 40 degrees as shown in FIG. 44A, however, when the user releases the hand in the state of half engagement, the apparatus-side ground terminal 737 presses the front face 203 of the cartridge 20 in the +Z direction (upward direction). This clearly disengages the cartridge from the apparatus- and facilitates the user to find the failed attachment. From this point of view, it is preferable to set the board inclination angle ϕ to be not greater than 40 degrees.

Figure 45:
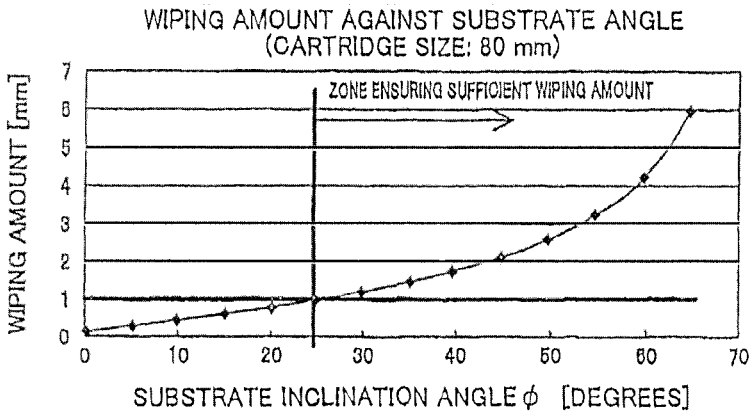
FIG. 45 is a graph showing another relation of wiping amount of the board terminal to a board inclination angle ϕ.
Figure 46:
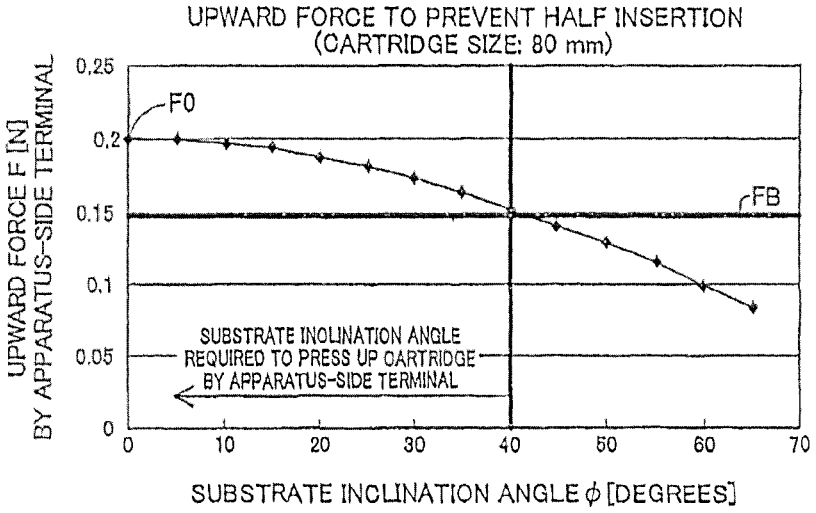
FIG. 46 is a graph showing another relation of upward force by the apparatus-side ground terminal to a board inclination angle ϕ.

FIGS. 45 and 46 show the characteristics of a cartridge having a greater dimension in the X direction than the dimension of the cartridge in FIGS. 46 and 44A. Whereas the cartridge is assumed to have the distance L0=63 mm in FIGS. 46 and 44A, it is assumed to have the distance L0=80 mm in FIGS. 45 and 46. The calculation of the upward force of FIG. 42 is on the assumption that F0=0.2 N and the weight of the cartridge (including the weight of ink) is 30 g, like the calculation of FIG. 44A. As clearly understood from the result of FIG. 45, like the result of FIG. 43A, in order to ensure the wiping amount of not less than 1 mm, the board inclination angle ϕ is preferably not less than 25 degrees. Although the distance L0 is 80 mm in the calculation of FIG. 46 relative to 63 mm in the calculation of FIG. 44A, the upward force FB balancing with the cartridge 20 having the weight of 30 grams is almost equal to that of FIG. 44A and is approximately 0.15 N (the position of thick horizontal line in FIG. 46). As clearly understood from the result of FIG. 46, like the result of FIG. 44A, in order to prevent half engagement of the cartridge, the board inclination angle ϕ is preferably not greater than 40 degrees.

By taking into account the characteristics of FIGS. 43 through 46, discussed above, it is preferable to set the board inclination angle ϕ to be not less than 25 degrees and not greater than 40 degrees.

The increased pressing force of the apparatus-side ground terminal 737 ensures the sufficient upward force even at the greater board inclination angle ϕ. In this case, it is preferable to set the pressing force of the apparatus-side ground terminal 737 and the board inclination angle ϕ to such values that enable the cartridge 20 to be pressed upward and changed from the state of half engagement to the disengagement state by the pressing force of the apparatus-side ground terminal 737, when the user release the hand from the cartridge 20 in the state of half engagement.

According to this embodiment, a pair of first engagement surfaces 230, a pair of second engagement surfaces 240 and a pair of projections 250 are provided around the circuit board 400 on the cartridge 20, in order to prevent positional misalignment of the cartridge-side terminals provided on the circuit board 400 relative to the device-side terminals provided on the terminal base 700 in the course of attachment of the cartridge 20 to the holder 600.

Figure 13:
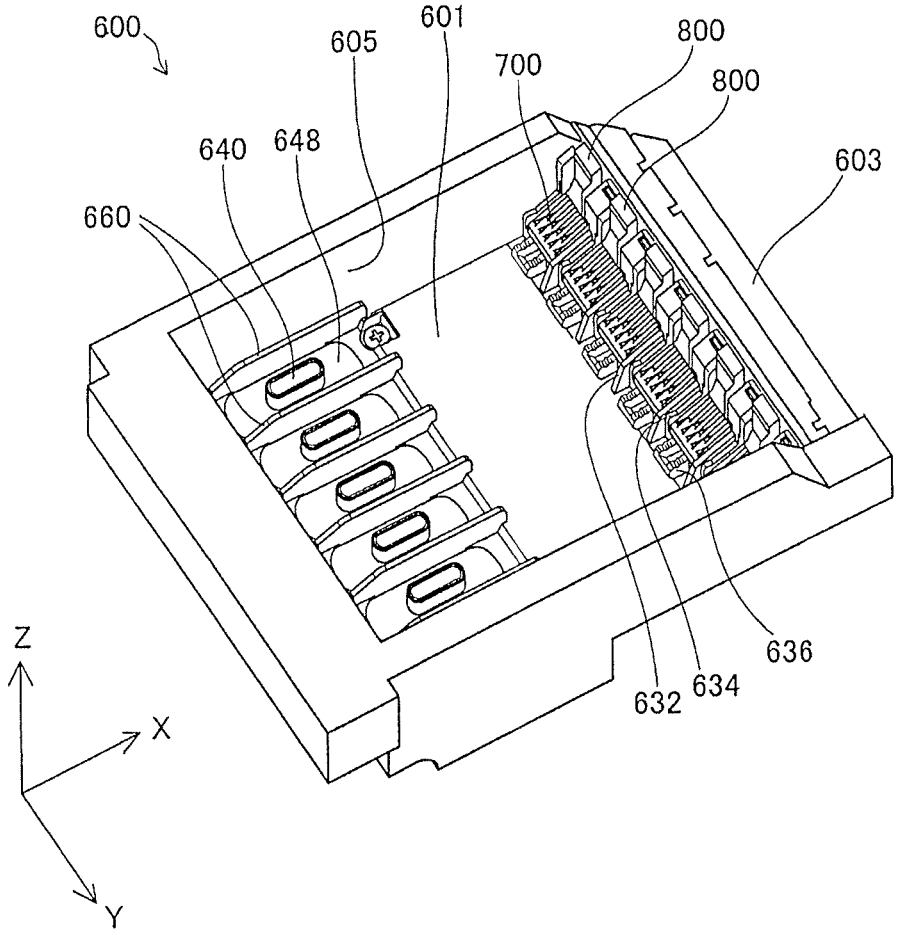
FIG. 13 is a perspective view illustrating the structure of the holder.
Figure 14:
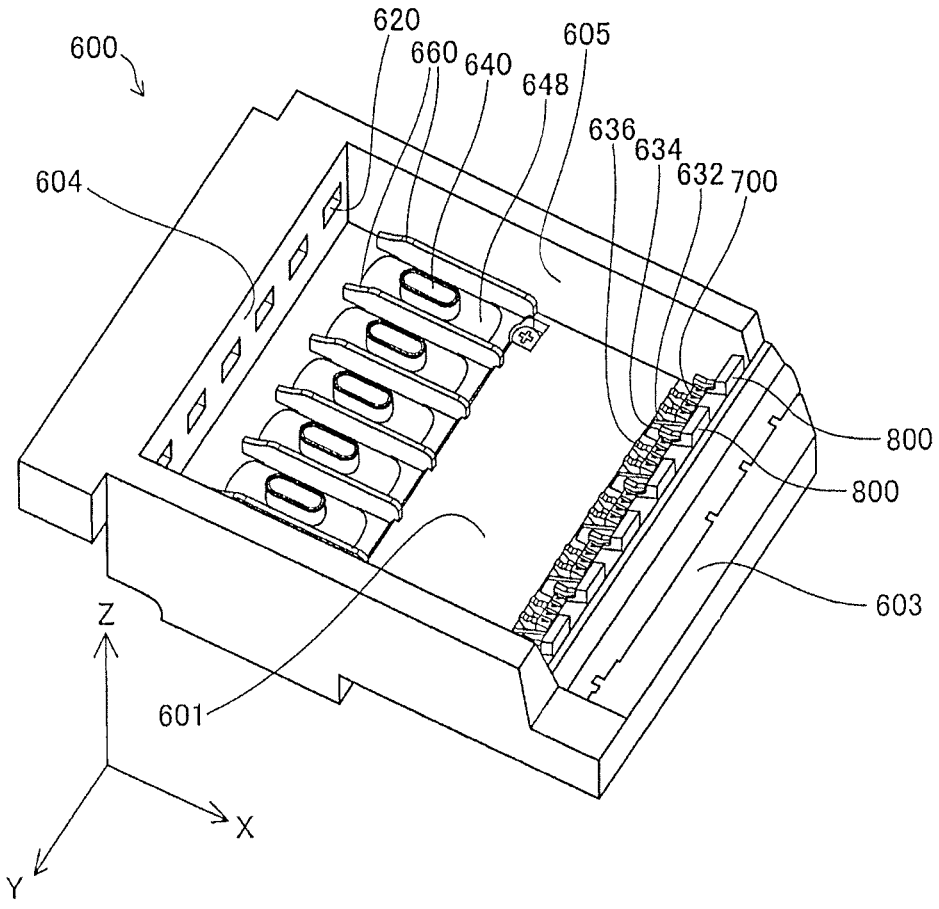
FIG. 14 is a perspective view illustrating the structure of the holder.
Figure 15:
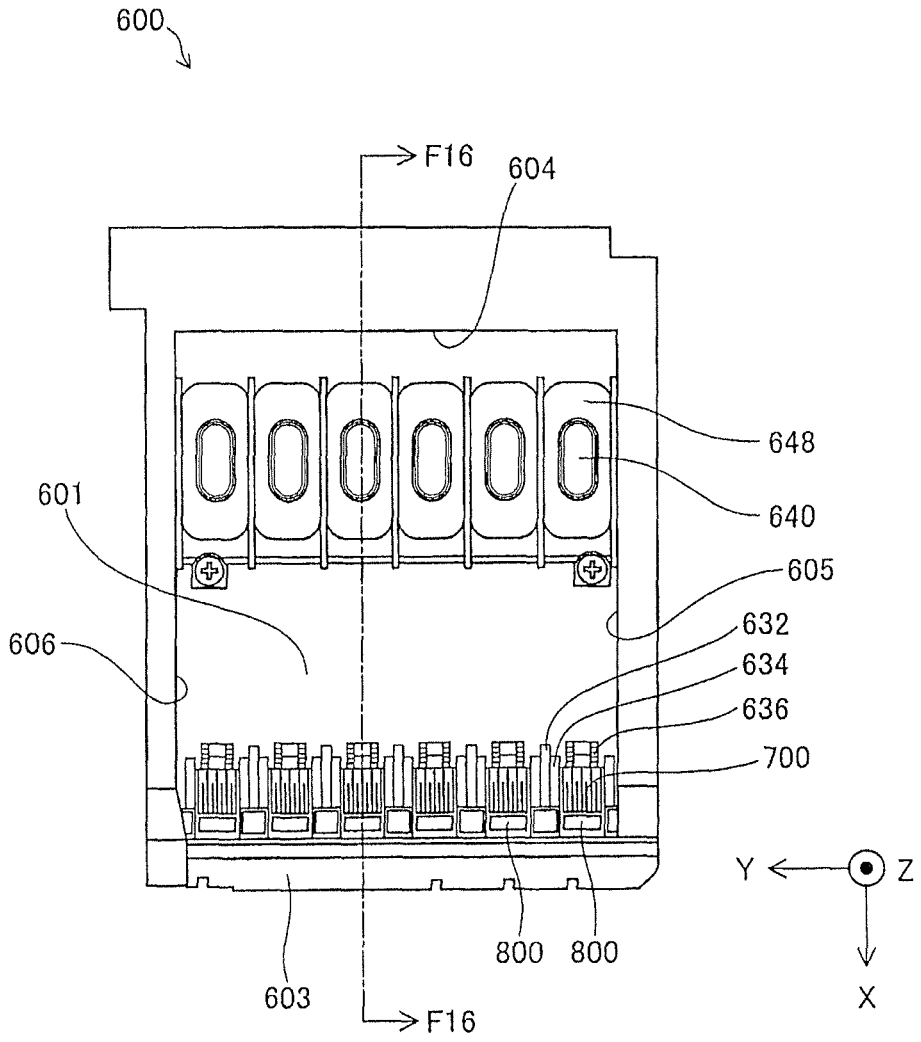
FIG. 15 is a top view illustrating the structure of the holder.

The pair of first engagement surfaces 230 provided at the positions close to the circuit board 400 on the fifth face 205 and the sixth face 206 of the cartridge 20 are the pair of faces parallel to the Z axis and the X axis and are formed on both sides of the circuit board 400 along the Y-axis direction. The pair of first engagement surfaces 230 are configured to engage with first engagement members 632 provided in the holder 600 (FIGS. 13 to 15). This structure effectively prevents the positional misalignment of the circuit board 400 relative to the holder 600 in the Y-axis direction and enables the cartridge-side terminals to be in contact with the device-side terminals at the appropriate position.

According to this embodiment, the pair of first engagement surfaces 230 includes an engagement surface formed on the fifth face 205 and an engagement surface formed on the sixth face 206. The engagement surface on the fifth face 205 is formed by lowering part of the fifth face 205 in the negative Y-axis direction over an area within a preset distance from the boundary of the eighth face 208 to the corresponding projection 250. The engagement surface on the sixth face 206 is formed by lowering part of the sixth face 206 in the positive Y-axis direction over an area within the preset distance from the boundary of the eighth face 208 to the corresponding projection 250. The distance between the pair of first engagement surfaces 230 along the Y-axis direction is less than the width or the Y-axis direction length of the cartridge 20, i.e., the distance between the fifth face 205 and the sixth face 206 and is greater than the width or the Y-axis direction length of the circuit board 400.

The pair of second engagement surfaces 240 provided at the positions close to the circuit board 400 on the fifth face 205 and the sixth face 206 of the cartridge 20 are the pair of faces parallel to the Z axis and the X axis and are formed on both sides of the circuit board 400 along the Y-axis direction. The pair of second engagement surfaces 240 are configured to engage with second engagement members 634 provided in the holder 600 (FIGS. 13 to 15). This structure effectively prevents the positional misalignment of the circuit board 400 relative to the holder 600 in the Y-axis direction and enables the cartridge-side terminals to be in contact with the device-side terminals at the appropriate position.

According to this embodiment, the pair of second engagement surfaces 240 includes an engagement surface formed on the fifth face 205 and an engagement surface formed on the sixth face 206. The engagement surface on the fifth face 205 is formed by further lowering part of the first engagement surface 230 adjacent to the eighth face 208 in the negative Y-axis direction. The engagement surface on the sixth face 206 is formed by further lowering part of the first engagement surface 230 adjacent to the eighth face 208 in the positive Y-axis direction. The distance between the pair of second engagement surfaces 204 along the Y-axis direction is less than the width or the Y-axis direction length of the cartridge 20, i.e., the distance between the fifth face 205 and the sixth face 206 and is substantially equal to the width or the Y-axis direction of the circuit board 400.

The pair of projections 250 of the cartridge 20 are provided on the positive Y-axis side and on the negative Y-axis side of the seventh face 207 to be protruded in the positive X-axis direction. The pair of projections 250 face each other along the Y axis on the negative Z-axis side of the circuit board 400. The pair of projections 250 are configured to engage with a fitting member 636 provided in the holder 600 (FIGS. 13 to 15). This structure effectively prevents the positional misalignment of the circuit board 400 relative to the holder 600 in the Y-axis direction and enables the cartridge-side terminals to be in contact with the device-side terminals at the appropriate position.

Figure 12A:
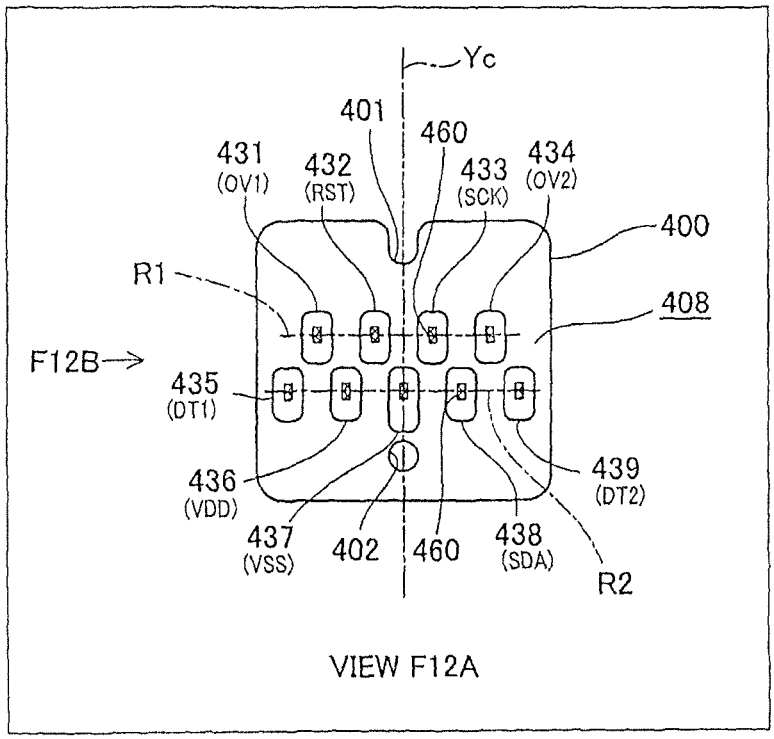
FIGS. 12A and 12B illustrate the detailed structure of a circuit board on the cartridge.
Figure 12B:
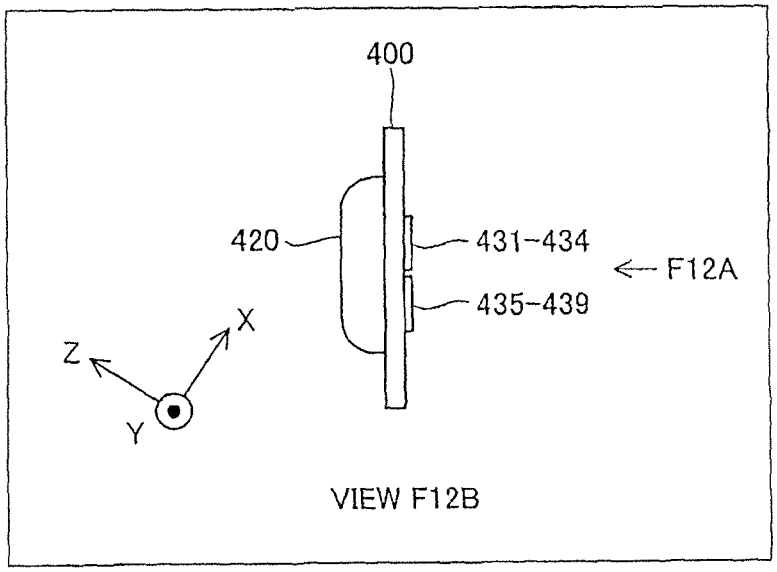

FIGS. 12A and 12B illustrate the detailed structure of the circuit board 400 of the cartridge 20. FIG. 12A shows the structure on the surface (cartridge-side sloped surface) 408 of the circuit board 400 viewed from the direction of arrow F12A in FIG. 10. FIG. 12B shows the structure of the side face of the circuit board 400 viewed from the direction of arrow F12B (positive Y-axis direction) in FIG. 12A.

As shown in FIG. 12A, the circuit board 400 has a boss groove 401 at its positive Z-axis end and a boss hole 402 at its negative Z-axis end. The circuit board 400 is fixed to the eighth face 208 of the cartridge 20 by means of the boss groove 401 and the boss hole 402. According to this embodiment, the boss groove 401 and the boss hole 402 are provided at the positions intersecting the plane Yc passing through the center of the width or Y-axis direction length of the cartridge 20. According to another embodiment, at least one of the boss groove 401 and the boss hole 402 may be omitted from the circuit board 400, and the circuit board 400 may be fixed to the eighth face 208 by an adhesive or by an engagement click (not shown) provided on the eighth face 208.

According to this embodiment, nine cartridge-side terminals 431 to 439 are provided on the cartridge-side sloped surface 408 of the circuit board 400 as shown in FIG. 12A, while a memory unit 420 is provided on the rear face as shown in FIG. 12B. The cartridge side terminals are electrically conductive and can be coupled to an electrical device As used herein, electrical device can refer to a resistor, sensor, memory device or other device that produces or is powered by electricity as can be appreciated by one of ordinary skill in the art. According to this embodiment, information regarding ink contained in the cartridge 20 (e.g., ink level or ink color) is stored in the memory unit 420 of the circuit board 400.

The number of cartridge-side terminals on the circuit board 400 is not limited to nine but may be changed to any arbitrary number, i.e., less than nine or greater than nine. The cartridge-side terminals 431 to 439 preferably have substantially the same height from the cartridge-side sloped surface 408 of the circuit board 400.

Each of the cartridge-side terminals 431 to 439 of the circuit board 400 has a contact portion "cp" that is in contact with the corresponding device-side terminal provided on the terminal base 700 of the holder 600. Among the cartridge-side terminals 431 to 439, four cartridge-side terminals 431 to 434 are arrayed along a terminal line R1 that is parallel to the Y axis and is located on the positive Z-axis side, while five cartridge-side terminals 435 to 439 are arrayed along a terminal line R2 that is parallel to the Y axis and is located on the negative Z-axis side of the terminal line R1. The contact portions "cp" of the cartridge-side terminals 431 to 434 arrayed along the terminal line R1 are aligned on the terminal line R1, whilst the contact portions "cp" of the cartridge-side terminals 435 to 439 arrayed along the terminal line R2 are aligned on the terminal line R2.

In order to prevent the cartridge-side terminals 431 to 434 on the terminal line R1 from overlapping the cartridge-side terminals 435 to 439 on the terminal line R2 viewed from the direction along the Y axis, the cartridge-side terminals 431 to 434 on the terminal line R1 are located on the positive Z-axis side of the cartridge-side terminals 435 to 439 on the terminal line R2. In order to prevent the cartridge-side terminals 431 to 434 on the terminal line R1 from overlapping the cartridge-side terminals 435 to 439 on the terminal line R2 viewed from the direction along the Z axis, the cartridge-side terminals 431 to 434 on the terminal line R1 and the cartridge-side terminals 435 to 439 on the terminal line R2 are arranged alternately or in zigzag.

The five cartridge-side terminals 432, 433, 436, 437 and 438 are electrically connected with the memory unit 420. The cartridge-side terminal 432 serves as "reset terminal" to receive supply of a reset signal RST to the memory unit 420. The cartridge-side terminals 433 serves as "clock terminal" to receive supply of a clock signal SCK to the memory unit 420. The cartridge-side terminal 436 serves as "power terminal" to receive supply of power voltage VDD (e.g., rated voltage of 3.3 V) to the memory unit 420. The cartridge-side terminal 437 serves as "ground terminal" or "cartridge-side ground terminal" to receive supply of ground voltage VSS (0 V) to the memory unit 420. The cartridge-side terminal 438 serves as "data terminal" to receive supply of a data signal SDA to the memory unit 420.

The four cartridge-side terminals 431, 434, 437 and 439 serve as "attachment detection terminals" used by the holder 600 to check whether the cartridge 20 is properly attached to the holder 600. The contact portions "cp" of the five cartridge-side terminals 432, 433, 436, 437 and 438 are placed in a quadrilateral area defined by the contact portions "cp" of the other four cartridge-side terminals 431, 434, 437 and 439 as four apexes. According to this embodiment, the four cartridge-side terminals 431, 434, 437 and 439 are interconnected electrically inside the circuit board 400 and are electrically connected to a ground line (not shown) of the printer 50 through the cartridge-side terminal 437 serving as the ground terminal, in the attached state of the cartridge 20 to the holder 600.

According to this embodiment, in the attached state of the cartridge 20 to the holder 600, the nine cartridge-side terminals 431 to 439 of the circuit board 400 are electrically connected to the controller 510 of the printer 50 via the device-side terminals provided on the terminal base 700 of the holder 600. Such connection enables the controller 510 to detect attachment of the cartridge 20 and to read and write information from and into the memory unit 420 of the circuit board 400.

According to this embodiment, the cartridge-side terminal 437 serving as the ground terminal is provided at the position intersecting the plane Yc passing through the center of the width or the Y-axis direction length of the cartridge 20. The cartridge-side terminal 437 is configured to be in contact with the corresponding device-side terminal 737

(FIG. 17), before the other cartridge-side terminals 431 to 436, 438 and 439 are in contact with the corresponding device-side terminals 731 to 736, 738 and 739 (FIG. 17), in the course of attachment of the cartridge 20 to the holder 600. The pressing force Pt first applied from the holder 600 to the circuit board 400 is thus generated on the substantial center of the width or the Y-axis direction length of the cartridge 20. This prevents the pressing force Pt applied to the cartridge-side sloped surface 408 from acting to tilt the cartridge 20 in the Y-axis direction and thereby ensures attachment of the cartridge 20 in the stable attitude to the holder 600. Such contact of the cartridge-side terminal 437 serving as the ground terminal with the corresponding device-side terminal prior to the other cartridge-side terminals 431 to 436, 438 and 439 advantageously prevents or reduces the high voltage-induced trouble or failure by the grounding function of the cartridge-side terminal 437, even when an unexpected high voltage is applied to the cartridge 20.

According to this embodiment, the cartridge-side terminal 437 serving as the ground terminal is formed longer along the Z-axis direction than the other cartridge-side terminals 431 to 436, 438 and 439. This ensures the earlier contact of the cartridge-side terminal 437 serving as the ground terminal with the corresponding device-side terminal 737 provided on the terminal base 700 of the holder 600 (FIG. 17) than the contact of the other cartridge-side terminals 431 to 436, 438 and 439 with the corresponding device-side terminals 731 to 736, 738 and 739. According to another embodiment, all the cartridge-side terminals 431 to 439 may be formed in the same size.

A-4. Detailed Structure of Holder

Figure 16:
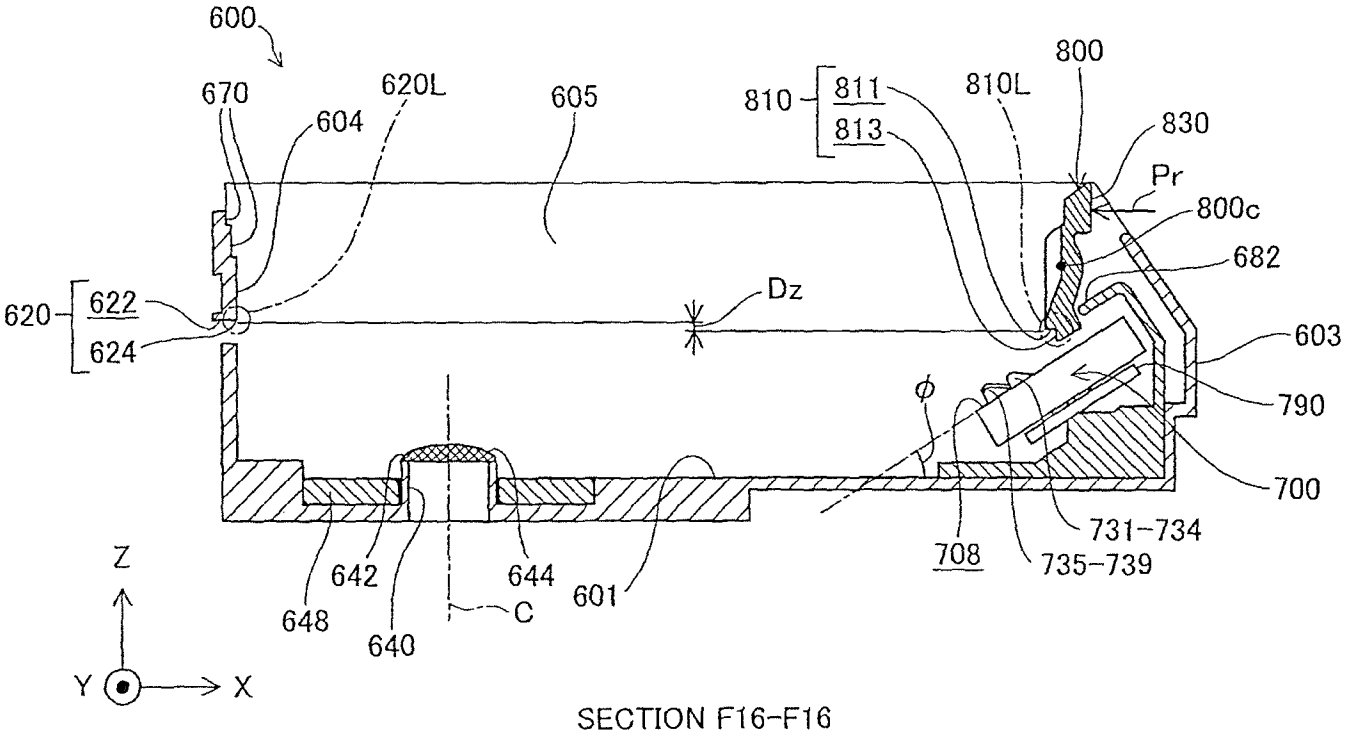
FIG. 16 is a sectional view illustrating the holder, taken on an arrowed line F16-F16 in FIG. 15.

FIGS. 13 and 14 are perspective views illustrating the structure of the holder 600. FIG. 15 is a top view illustrating the structure of the holder 600. FIG. 16 is a sectional view, taken on an arrowed line F16-F16 in FIG. 15.

The holder 600 of the printer 50 has five wall members 601, 603, 604, 605 and 606 assembled to form a container with the space to receive the cartridges 20 attached to the holder 600. According to this embodiment, the five wall members 601, 603, 604, 605 and 606 are plate members and are made of a resin material having the higher rigidity than polypropylene (PP), e.g., modified polyphenylene ether (m-PPE).

The wall member 601 of the holder 600 forms the bottom face of the container in the use attitude of the printer 50. The wall member 603 of the holder 600 is erected on the positive X-axis side of the wall member 601 and forms the front face of the container in the use attitude of the printer 50. The wall member 604 of the holder 600 is erected on the negative X-axis side of the wall member 601 and forms the rear face of the container in the use attitude of the printer 50. The wall member 605 of the holder 600 is erected on the negative Y-axis side of the wall member 601 and forms the right side face of the container in the use attitude of the printer 50. The wall member 606 of the holder 600 is erected on the positive Y-axis side of the wall member 601 and forms the left side face of the container in the use attitude of the printer 50. The wall member 603 and the wall member 604 are located to be opposed to each other, whilst the wall member 605 and the wall member 606 are located to be opposed to each other.

The ink supply tube 640 is provided on the wall member 601 of the holder 600, and a porous filter 644 is provided at a peripheral end 642 of the ink supply tube 640. According to this embodiment, the ink supply tube 640 is located on the side closer to the wall member 604 (i.e., closer to the negative X-axis side). According to other embodiments, the ink supply tube 640 may be located on the side closer to the wall member 603 (i.e., closer to the positive X-axis side) or may be located in the middle between the wall member 604 and the wall member 603.

An elastic member 648 is provided around the ink supply tube 640 on the wall member 601. The elastic member 648 serves to seal the ink supply port 280 of the cartridge 20 and prevent leakage of ink from the ink supply port 280 to the periphery in the attached state of the cartridge 20 to the holder 600. The elastic member 648 generates the pressing force Ps in the direction of pressing back the ink supply port 280 of the cartridge 20 (in the positive Z-axis direction) in the attached state of the cartridge 20 to the holder 600.

According to this embodiment, a pair of elevation surfaces 660 are erected on the positive Y-axis side and on the negative Y-axis side of each ink supply tube 640 on the wall member 601. The pair of elevation surfaces 660 are formed as wall surfaces parallel to the Z axis and the X axis and are configured such that the cartridge 20 is received and fit between the pair of elevation surfaces 660 in the course of attachment of the cartridge 20 to the holder 600. This effectively prevents the positional misalignment of the ink supply port 280 relative to the ink supply tube 640.

The terminal base 700 is provided at the position where the wall member 601 adjoins to the wall member 603 and is located on the side closer to the wall member 603 than the ink supply tube 640 (i.e., on the positive X-axis side of the ink supply tube 640). As shown in FIG. 16, the terminal base 700 mounted on the wall member 601 has a device-side sloped surface 708 inclined in the positive Z-axis direction and in the negative X-axis direction. In the attached state of the cartridge 20 to the holder 600, the device-side terminals provided on the device-side sloped surface 708 of the terminal base 700 in the holder 600 are in contact with the circuit board 400 of the cartridge 20. The device-side terminals provided on the terminal base 700 are in contact with a substrate 790 placed on an opposite sloped surface to the device-side sloped surface 708 and fastened to the holder 600, and are electrically connected with the controller 510 via terminals and wiring on the substrate 790.

The angle of inclination of the device-side sloped surface 708 of the terminal base 700 to the plane parallel to the X axis and the Y axis (wall member 601) is equal to the angle $\phi$ of inclination of the cartridge-side sloped surface 408 of the cartridge 20 to the open surface 288 of the ink supply port 280. In the attached state of the cartridge 20 to the holder 600, the device-side sloped surface 708 of the terminal base 700 is accordingly parallel to the cartridge-side sloped surface 408 of the circuit board 400.

According to this embodiment, nine device-side terminals 731 to 739 are provided on the device-side sloped surface 708 of the terminal base 700 corresponding to the nine cartridge-side terminals 431 to 439 provided on the circuit board 400 of the cartridge 20. The number of device-side terminals is not limited to nine but may be changed to any arbitrary number, i.e., less than nine or greater than nine.

Figure 17:
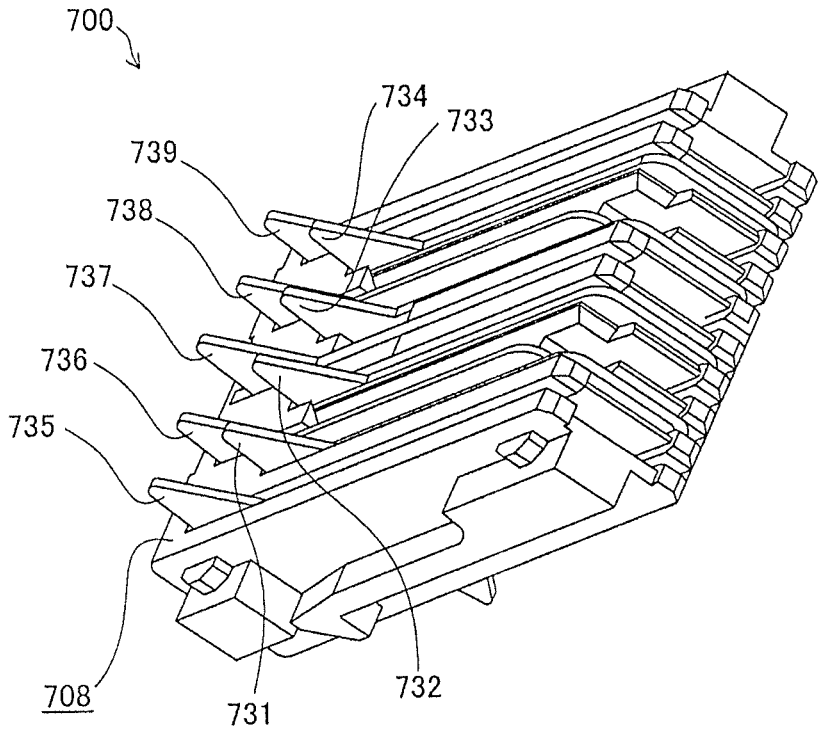
FIG. 17 is a perspective view illustrating the detailed structure of a terminal base.

FIG. 17 is a perspective view illustrating the detailed structure of the terminal base 700 detached from the holder 600. The nine device-side terminals 731 to 739 on the terminal base 700 are provided at the positions corresponding to the nine cartridge-side terminals 431 to 439 on the circuit board 400 of the cartridge 20. The five device-side terminals 735 to 739 are arrayed along the Y axis on the negative Z-axis side of the device-side sloped surface 708 of the terminal base 700. The four device-side terminals 731 to 734 are arrayed along the Y axis on the positive Z-axis side of these five device-side terminals 735 to 739.

The device-side terminals 731 to 739 are made of an elastic material with electrical conductivity. The device-side terminals 731 to 739 are protruded from the device-side sloped surface 708 and generate the pressing force Pt in the direction of pressing back the cartridge-side sloped surface 408 of the cartridge 20 (i.e., in the positive Z-axis direction) in the attached state of the cartridge 20 to the holder 600.

According to this embodiment, the device-side terminal 737 located on the center in the Y-axis direction among the nine device-side terminals 731 to 739 is electrically connected to a ground line (not shown) and serves as "ground terminal" or "device-side ground terminal". The device-side terminal 737 serving as the device-side ground terminal is in contact with the cartridge-side terminal 437 serving as the cartridge-side ground terminal (FIG. 12) in the attached state of the cartridge 20 to the holder 600.

According to this embodiment, the height of the device-side terminal 737 protruded from the device-side sloped surface 708 is greater than the height of the other device-side terminals 731 to 736, 738 and 739. The device-side terminal 737 is accordingly in contact with the cartridge-side terminal 437 serving as the cartridge-side ground terminal (FIG. 12), prior to the other device-side terminals 731 to 736, 738 and 739 with the corresponding cartridge-side terminals.

Figure 39:
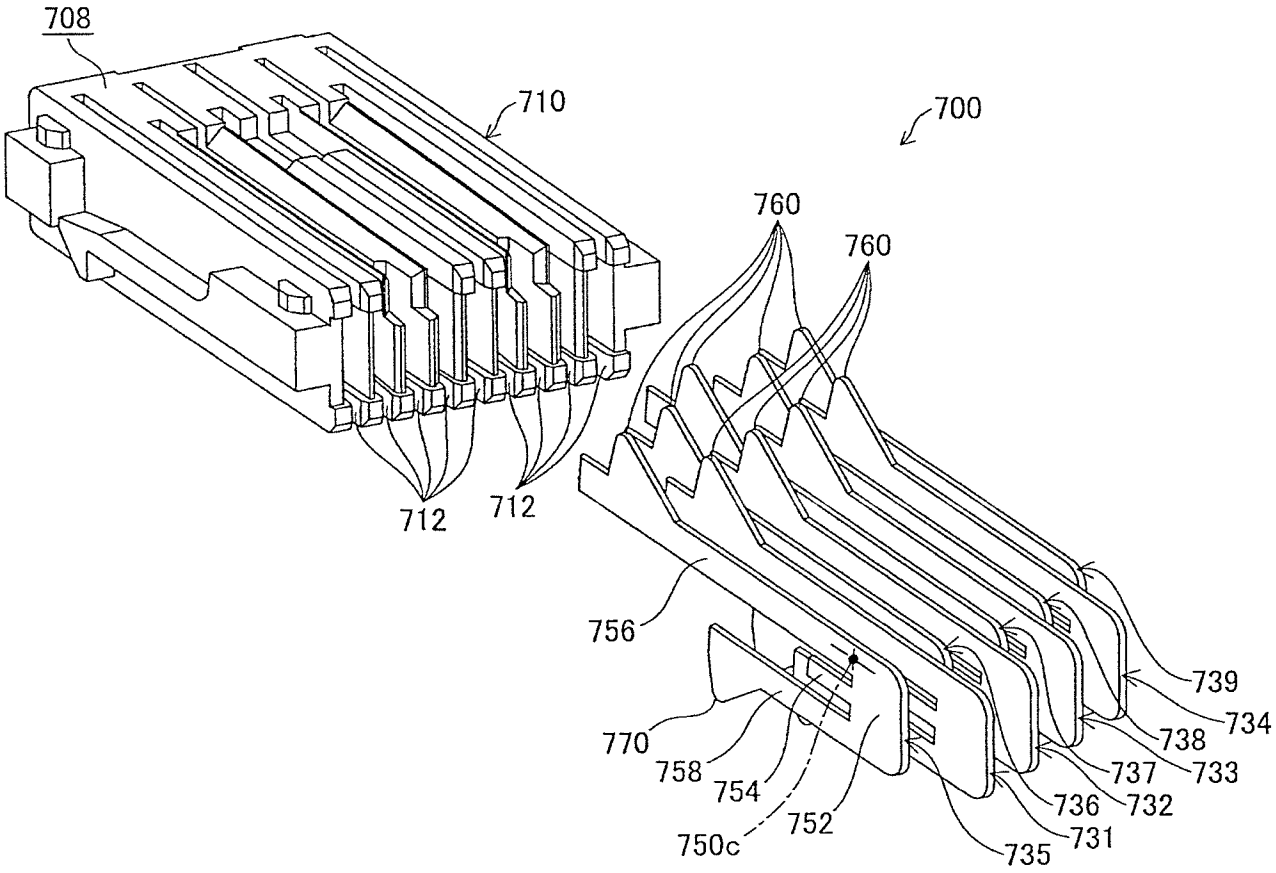
FIG. 39 is an exploded perspective view illustrating the detailed structure of the terminal base.

FIG. 39 is an exploded perspective view illustrating the detailed structure of the terminal base 700. The terminal base 700 includes a base member 710 and the device-side terminals 731 to 739.

The base member 710 has a plurality of slits 712 provided to individually hold the device-side terminals 731 to 739 in an elastically deformable manner. According to this embodiment, the base member 710 is in the shape of an approximate rectangular parallelepiped having the device-side sloped surface 708 as one of its faces. The base member 710 is made of, for example, an elastically insulating resin.

The device-side terminals 731 to 739 are members having electrical conductivity and elasticity and are, for example, metal plate members. According to this embodiment, each of the device-side terminals 731 to 739 includes a joint element 752, a fixation element 754, a first beam element 756, a second beam element 758, a device-side contact portion 760, and a contact portion 770. The first beam element 756, the fixation element 754 and the second beam element 758 are arranged in parallel to one another in this order and are interconnected by the joint element 752. The fixation element 754 is shorter than the first beam element 756 and the second beam element 758. Each of the device-side terminals 731 to 739 is fixed to the base member 710 via the fixation element 754.

The first beam element 756 has one end supported on the joint element 752 and the other end with the device-side contact portion 760 configured to be in contact with corresponding one of the cartridge-side terminals 431 to 439. According to this embodiment, the device-side contact portion 760 is formed as a triangular apex. In response to a force applied to the device-side contact portion 760, the first beam element 756 elastically deforms about a joint position 750*c* between the first beam element 756 and the joint element 752 as the pivotal center. According to this embodiment, the first beam element 756 is longer than the second beam element 758. This allows for a moving distance of the device-side contact portion 760 during elastic deformation of the first beam 756.

The second beam element 758 has one end supported on the joint element 752 and the other end with the contact portion 770 configured to be in contact with a terminal on the substrate 790 fastened to the holder 600. According to this embodiment, the contact portion 770 is formed as a triangular apex. In response to a force applied to the contact portion 770, the second beam element 758 elastically deforms about a joint position between the second beam element 758 and the joint element 752.

Figure 40:
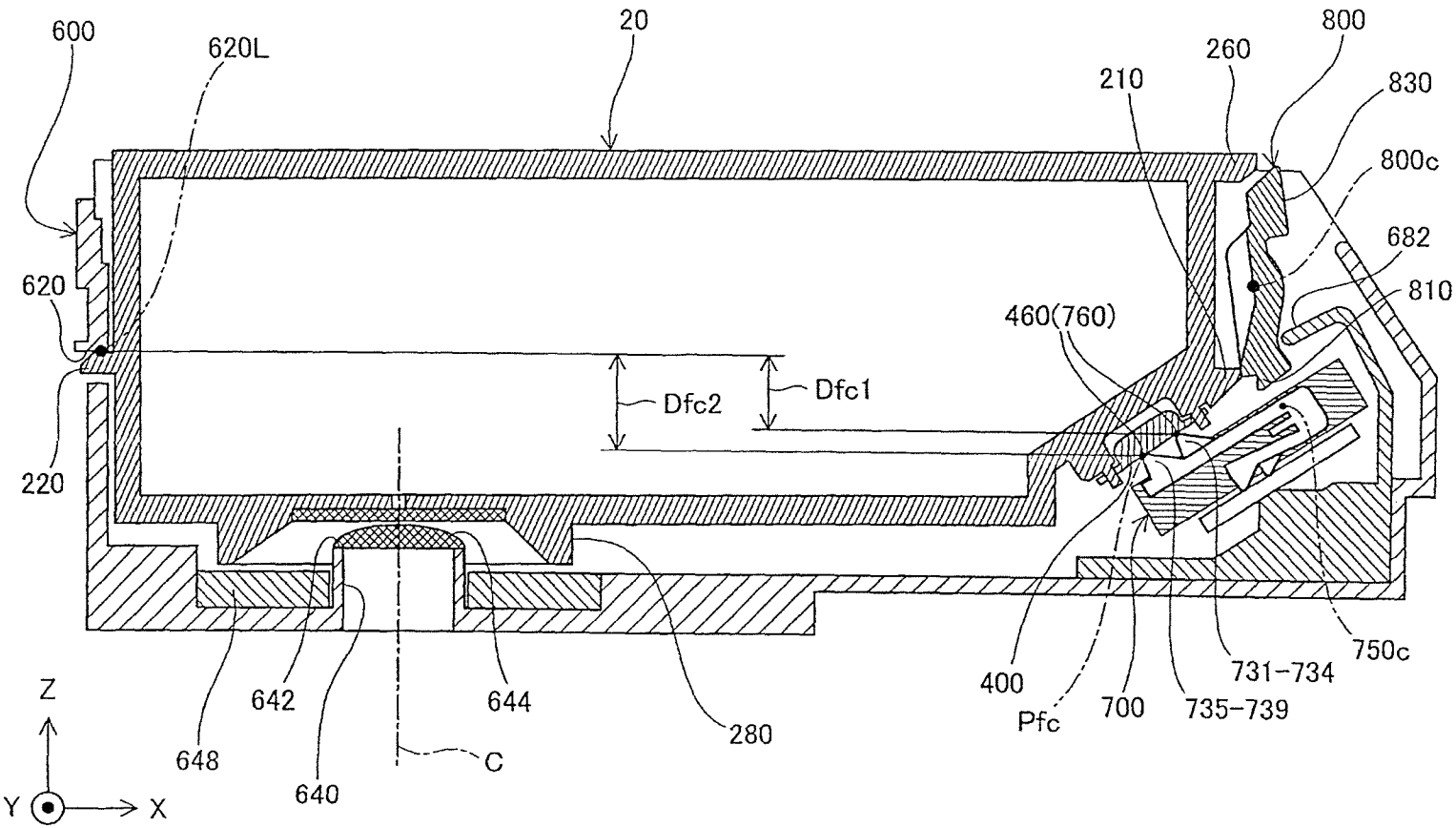
FIG. 40 illustrates the device-side terminals coming into contact with the circuit board in the course of attachment of the cartridge to the holder.
Figure 41:
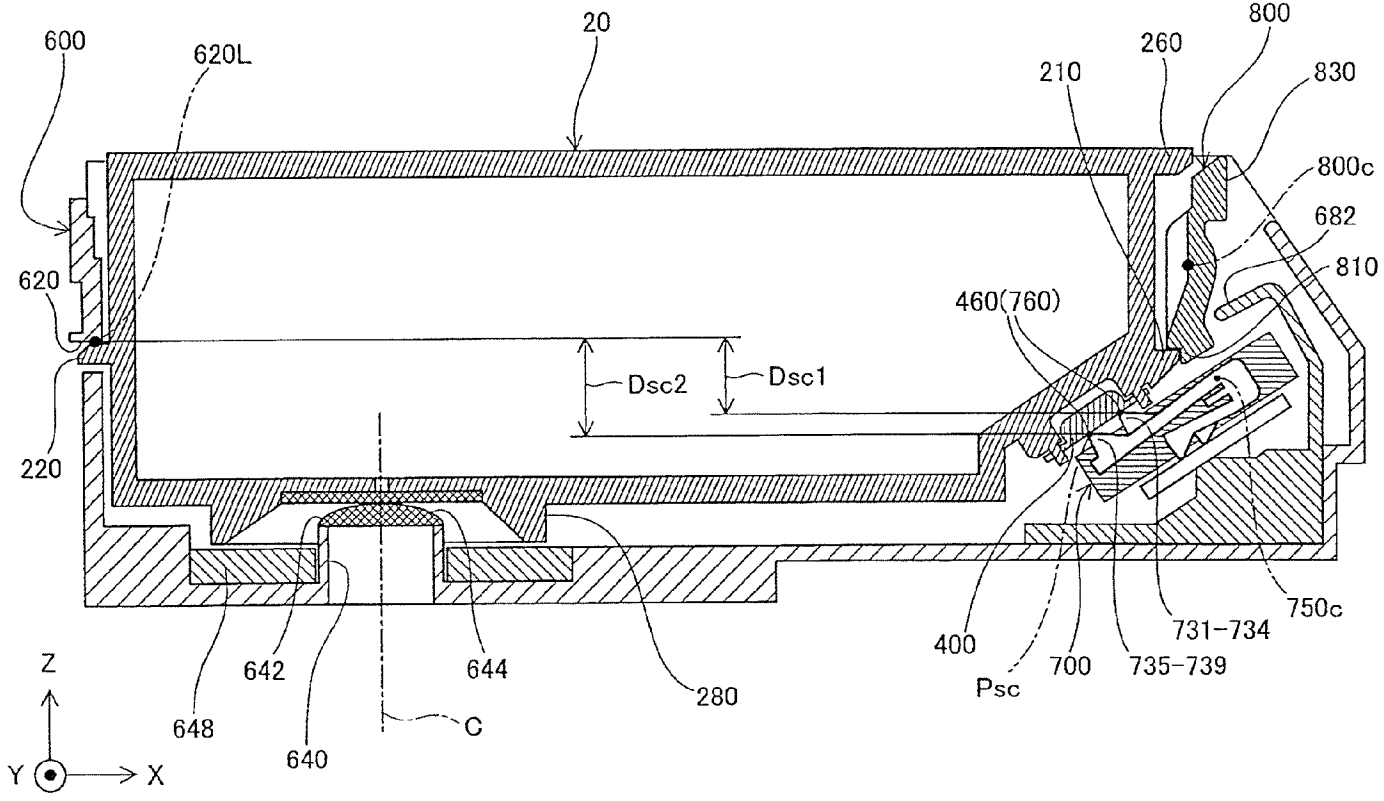
FIG. 41 illustrates the complete attachment of the cartridge to the holder.

FIG. 40 illustrates the device-side terminals 731 to 739 coming into contact with the circuit board 400 in the course of attachment of the cartridge 20 to the holder 600. FIG. 41 illustrates the complete attachment of the cartridge 20 to the holder 600.

As described in detail later, for attachment of the cartridge 20 to the holder 600, the cartridge 20 is turned clockwise, viewed from the positive Y-axis direction, about the second locking position 620L as the pivot point of rotation. As the cartridge 20 is turned about the second locking position 620L as the pivot point of rotation, the device-side contact portion 760 of each of the device-side terminals 731 to 739 comes into contact with a cartridge-side contact portion 460 of corresponding one of the cartridge-side terminals 431 to 439 at a contact point Pfc shown in FIG. 40. The device-side contact portions 760 of the device-side terminals 731 to 734 are located on the positive Z-axis side and on the positive X-axis side of the device-side contact portions 760 of the device-side terminals 735 to 739. The cartridge-side contact portions 460 of the cartridge-side terminals 431 to 434 are located on the positive Z-axis side and on the positive X-axis side of the cartridge-side contact portions 460 of the cartridge-side terminals 435 to 439.

As shown in FIG. 40, the device-side contact portions 760 of the device-side terminals 731 to 734 are located on the negative Z-axis side by a distance Dfc1 from the second locking position 620L. The cartridge-side contact portions 460 of the corresponding cartridge-side terminals 431 to 434 are thus located on the negative Z-axis side by the distance Dfc1 from the second locking position 620L.

As shown in FIG. 40, the device-side contact portions 760 of the device-side terminals 735 to 739 are located on the negative Z-axis side by a distance Dfc2 from the second locking position 620L. The cartridge-side contact portions 460 of the corresponding cartridge-side terminals 435 to 439 are thus located on the negative Z-axis side by the distance Dfc2 from the second locking position 620L.

As the cartridge 20 is further turned about the second locking position 620L as the pivot point of rotation from the state of FIG. 40, each of the device-side terminals 731 to 739 elastically deforms about the joint position 750*c* as the pivotal center, which is located on the positive Z-axis side and on the positive X-axis side of its device-side contact portion 760. When the first cartridge-side locking element 210 engages with the first device-side locking element 810, the device-side contact portion 760 of each of the device-side terminals 731 to 739 is kept in contact with the cartridge-side contact portion 460 of corresponding one of the cartridge-side terminals 431 to 439 at a contact point Psc shown in FIG. 41.

As shown in FIG. 41, the device-side contact portions 760 of the device-side terminals 731 to 734 are located on the negative Z-axis side by a distance Dsc1 from the second locking position 620L. The cartridge-side contact portions 460 of the corresponding cartridge-side terminals 431 to 434 are thus located on the negative Z-axis side by the distance Dsc1 from the second locking position 620L.

As shown in FIG. 41, the device-side contact portions 760 of the device-side terminals 735 to 739 are located on the negative Z-axis side by a distance Dsc2 from the second locking position 620L. The cartridge-side contact portions 460 of the corresponding cartridge-side terminals 435 to 439 are thus located on the negative Z-axis side by the distance Dsc2 from the second locking position 620L.

Figure 42A:
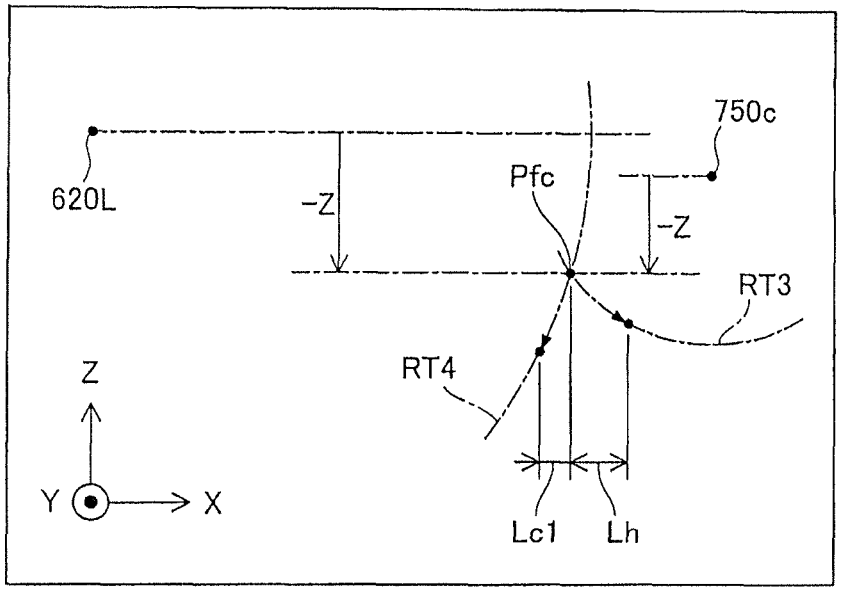
FIGS. 42A and 42B illustrate wiping between the cartridge-side contact portion and the device-side contact portion.
Figure 42B:
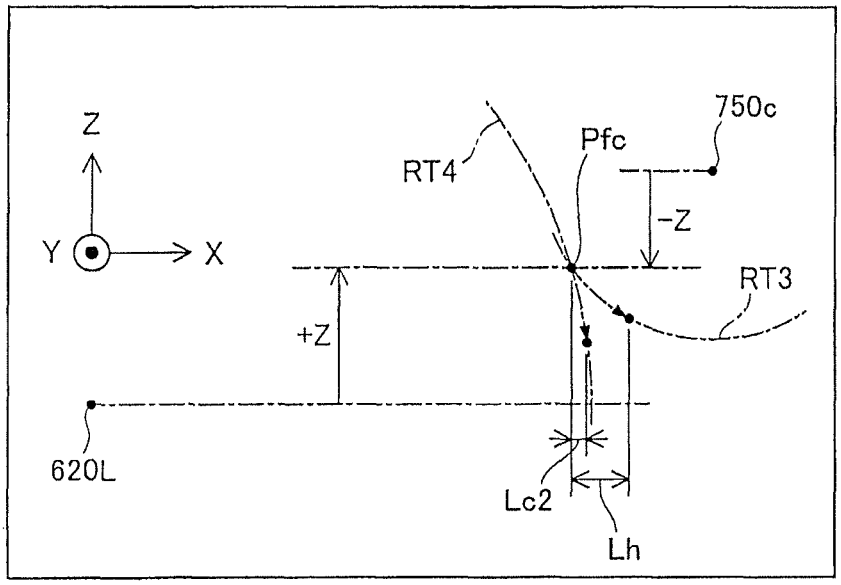

FIGS. 42A and 42B illustrate wiping between the cartridge-side contact portion 460 and the device-side contact portion 760. FIG. 42A shows wiping in the state that the contact point Pfc where the cartridge-side contact portion 460 comes into contact with the device-side contact portion 760 is located on the negative Z-axis side of the second locking position 620L. FIG. 42B shows wiping in the state that the contact point Pfc where the cartridge-side contact portion 460 comes into contact with the device-side contact portion 760 is located on the positive Z-axis side of the second locking position 620L.

FIGS. 42A and 42B schematically illustrate the positional relationships of the second locking position 620L, the contact point Pfc and the joint position 750*c* on the X axis and on the Z axis. The only difference between the positional relationships of FIGS. 42A and 42B is the second locking position 620L on the Z axis. An arc RT3 shown in FIGS. 42A and 42B represents the rotation locus of the contact point Pfc about the joint position 750*c*. An RT4 shown in FIGS. 42A and 42B represents the rotation locus of the contact point Pfc about the second locking position 620L.

As shown in FIGS. 42A and 42B, when the contact point Pfc is located on the negative Z-axis side and on the negative X-axis side of the joint position 750*c*, as the cartridge 20 is turned for attachment from the state of FIG. 40 to the state of FIG. 41, the device-side contact portion 760 moves in the positive X-axis direction. A distance Lh represents the moving distance of the device-side contact portion 760 on the X axis.

As shown in FIG. 42A, when the contact point Pfc is located on the negative Z-axis side and on the positive X-axis side of the second locking position 620L, as the cartridge 20 is turned for attachment from the state of FIG. 40 to the state of FIG. 41, the cartridge-side contact portion 460 moves in the negative X-axis direction. A distance Lc1 represents the moving distance of the cartridge-side contact portion 460 on the X axis.

As shown in FIG. 42B, when the contact point Pfc is located on the positive Z-axis side and on the positive X-axis side of the second locking position 620L, as the cartridge 20 is turned for attachment from the state of FIG. 40 to the state of FIG. 41, the cartridge-side contact portion 460 moves in the positive X-axis direction. A distance Lc2 represents the moving distance of the cartridge-side contact portion 460 on the X axis.

The amount of wiping between the cartridge-side contact portion 460 and the device-side contact portion 760 is determined as the projected distance on the cartridge-side sloped surface 408 by projecting the difference between the moving distance of the cartridge-side contact portion 460 on the X axis and the moving distance of the device-side contact portion 760 on the X axis. The amount of wiping accordingly increases with an increase in difference between the moving distance of the cartridge-side contact portion 460 on the X axis and the moving distance of the device-side contact portion 760 on the X axis.

In the state of FIG. 42A, the cartridge-side contact portion 460 and the device-side contact portion 760 move in the different directions on the X axis, so that the difference between the moving distance of the cartridge-side contact portion 460 on the X axis and the moving distance of the device-side contact portion 760 on the X axis is equal to "Lh+Lc1". In the state of FIG. 42B, on the other hand, the cartridge-side contact portion 460 and the device-side contact portion 760 move in the same direction on the X axis, so that the difference between the moving distance of the cartridge-side contact portion 460 on the X axis and the moving distance of the device-side contact portion 760 on the X axis is equal to "Lh−Lc2". The state of FIG. 42A where the contact point Pfc is located on the negative Z-axis side of the second locking position 620L thus significantly increases the amount of wiping, compared with the state of FIG. 42B where the contact point Pfc is located on the positive Z-axis side of the second locking position 620L. In other words, the state of FIG. 42A where the cartridge-side contact portion 460 is located on the negative Z-axis side of the second locking position 620L thus significantly increases the amount of wiping, compared with the state of FIG. 42B where the cartridge-side contact portion 460 is located on the positive Z-axis side of the second locking position 620L.

Referring back to FIGS. 13 to 16, according to this embodiment, the pair of first engagement members 632 are provided on the positive Y-axis side and on the negative Y-axis side of the terminal base 700. The pair of first engagement members 632 respectively have surfaces parallel to the Z axis and the X axis and are configured to engage with the pair of first engagement surfaces 230 of the cartridge 20 in the course of attachment of the cartridge 20 to the holder 600. Such engagement effectively prevents the positional misalignment of the circuit board 400 relative to the terminal base 700 and thereby the positional misalignment of the cartridge-side terminals 431 to 439 relative to the device-side terminals 731 to 739.

According to this embodiment, the pair of second engagement members 634 are provided on the positive Y-axis side and on the negative Y-axis side of the terminal base 700 and inside the pair of first engagement members 632. The pair of second engagement members 634 respectively have surfaces parallel to the Z axis and the X axis and are configured to engage with the pair of second engagement surfaces 240 of the cartridge 20 in the course of attachment of the cartridge 20 to the holder 600. Such engagement effectively prevents the positional misalignment of the circuit board 400 relative to the terminal base 700 and thereby the positional misalignment of the cartridge-side terminals 431 to 439 relative to the device-side terminals 731 to 739.

According to this embodiment, the fitting member 636 is provided adjacent to the negative Z-axis side of the terminal base 700 and is configured to be fit between the pair of projections 250 of the cartridge 20 in the course of attachment of the cartridge 20 to the holder 600. Such engagement effectively prevents the positional misalignment of the circuit board 400 relative to the terminal base 700 and thereby the positional misalignment of the cartridge-side terminals 431 to 439 relative to the device-side terminals 731 to 739.

The lever 800 is provided in a pivotally rotatable manner on the wall member 603 of the holder 600. According to this embodiment, the lever 800 is provided as a separate member from the five wall members 601, 603, 604, 605 and 606 of the holder 600 and is made of a resin material with the higher rigidity than polypropylene (PP), e.g., polyacetal (POM).

As shown in FIG. 16, the lever 800 has the pivotal center 800*c* on the positive Z-axis side and on the positive X-axis side of the device-side terminals 731 to 739. The lever 800 has the operating member 830 and the first device-side locking element 810. The operating member 830 is located on the positive Z-axis side of the pivotal center 800*c*, whilst the first device-side locking element 810 is located on the negative Z-axis side of the pivotal center 800*c*.

The operating member 830 is provided on the positive Z-axis end of the lever 800. The operating member 830 is configured to receive the user's operating force Pr applied in the negative X-axis direction from the side of the wall member 603 (positive X-axis side). The user's operating force Pr applied to the operating member 830 turns the lever 800 counterclockwise, viewed from the positive Y-axis direction, around the pivotal center 800*c*.

The first device-side locking element 810 is provided on the negative Z-axis end of the lever 800. The first device-side locking element 810 is configured to lock the first cartridge-side locking element 210 at the first locking position 810L located on the negative Z-axis side and on the negative X-axis side of the pivotal center 800*c*. According to this embodiment, the first device-side locking element 810 has a first device-side locking surface 811 and a second device-side locking surface 813. The first device-side locking surface 811 is a plane facing in the negative Z-axis direction at the first locking position 810L and is configured to engage with the first locking surface 211 of the first cartridge-side locking element 210. The second device-side locking surface 813 is a plane facing in the negative X-axis direction at the first locking position 810L and is configured to engage with the third locking surface 213 of the first cartridge-side locking element 210.

According to this embodiment, the lever 800 is configured such that the first device-side locking element 810 is located at the first locking position 810L in the state of no attachment of the cartridge 20. According to other embodiments, the standby position of the lever 800 may be the position where the first device-side locking element 810 is located on the negative X-axis side of the first locking position 810L or may be the position where the first device-side locking element 810 is located on the positive X-axis side of the first locking position 810L.

According to this embodiment, an elastic member 682 is provided on the negative Z-axis side and on the positive X-axis side of the pivotal center 800*c* of the lever 800. The elastic member 682 abuts the lever 800 and is elastically deformed to press the lever 800 in the direction of pressing back the lever 800, when the lever 800 turns in the direction of rotation of moving the first device-side locking element 810 in the positive X-axis direction from the first locking position 810L.

Figure 18:
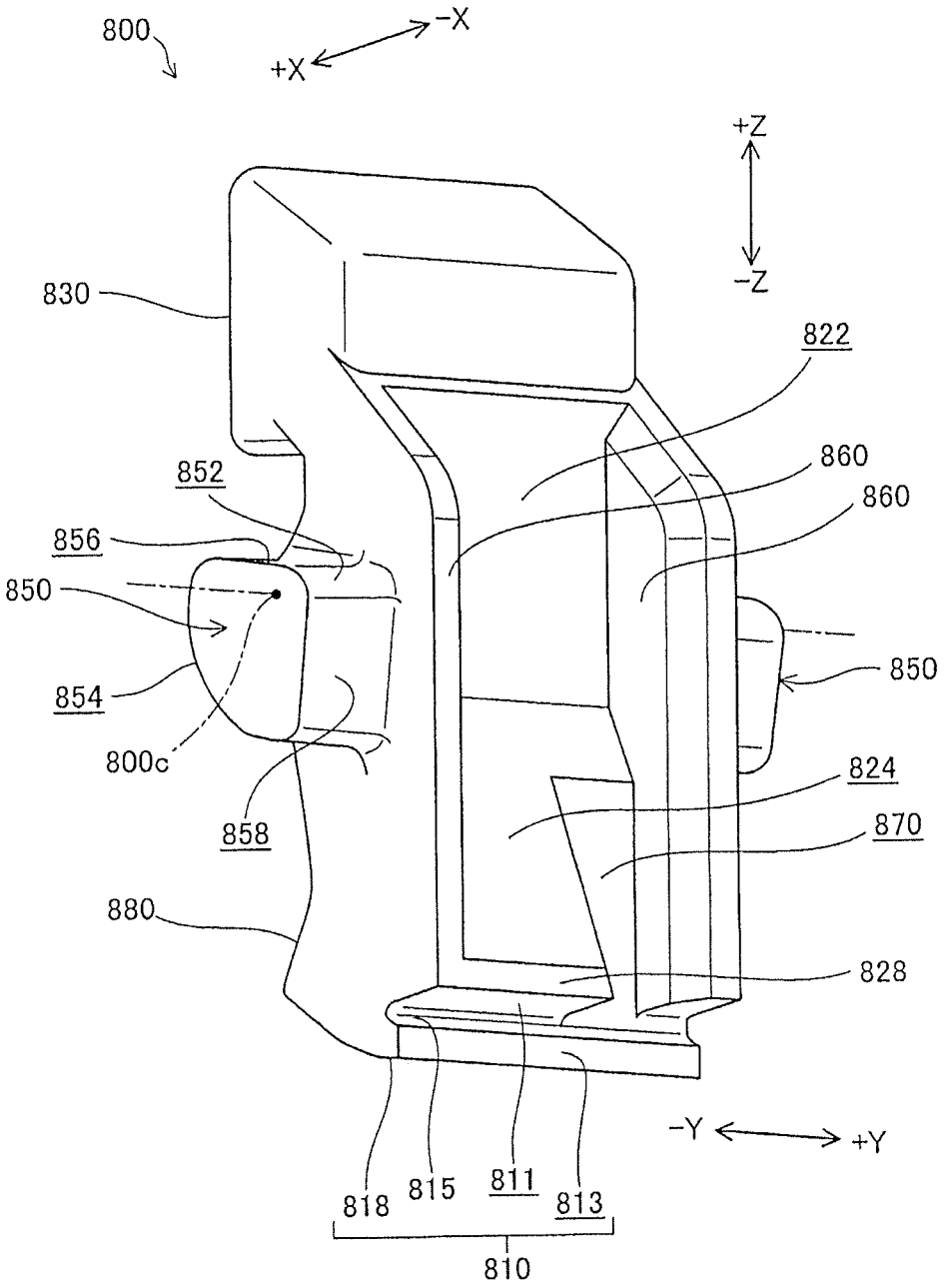
FIG. 18 is a perspective view illustrating the detailed structure of the lever.

FIG. 18 is a perspective view illustrating the detailed structure of the lever 800. As shown in FIG. 18, the operating member 830 is provided on the positive Z-axis end of the lever 800, whilst the first device-side locking element 810 is provided on the opposite end to the end with the operating member 830 across the pivotal center 800*c*, i.e., on the negative Z-axis end of the lever 800.

The first device-side locking element 810 has the first device-side locking surface 811 and the second device-side locking surface 813 as the two intersecting surfaces. The second device-side locking surface 813 is located further away from the pivotal center 800*c* than the first device-side locking surface 811 and is adjacent to a negative Z-axis end 818 of the lever 800.

According to this embodiment, a groove 815 is formed at the position where the first device-side locking surface 811 intersects the second device-side locking surface 813, in order to facilitate engagement of the first device-side locking surface 811 and the second device-side locking surface 813 with the first cartridge-side locking element 210. The groove 815 is provided by extending the first device-side locking surface 811 and cutting part of the first device-side locking surface 811 adjoining to the second device-side locking surface 813.

The lever 800 has a pair of wall members 860 facing each other along the Y axis direction. The pair of wall members 860 are erected on the negative X-axis side of the lever 800 and are extended from the positive Z-axis end to the negative Z-axis end of the lever 800 between the operating member 830 and the first device-side locking element 810. The distance between the pair of wall members 860 along the Y axis is greater than the Y-axis direction length of the first cartridge-side locking element 210 of the cartridge 20. According to this embodiment, the outer surfaces of the pair of wall members 860, i.e., the positive Y-axis side surface of the positive Y-axis side wall member and the negative Y-axis side surface of the negative Y-axis side wall member, form part of the side faces of the lever 800.

A flat surface 822 and a sloped surface 824 are provided between the pair of wall members 860 and are formed sequentially from the operating member 830 toward the first device-side locking element 810. According to this embodiment, the flat surface 822 is provided as a plane parallel to the second device-side locking surface 813, and the sloped surface 824 is provided as a plane linked with the flat surface 822 and inclined in the negative X-axis direction gradually from the flat surface 822 toward the first device-side locking element 810. According to this embodiment, a shallower sloped end portion 828 having the gentler slope than that of the sloped surface 824 is formed between the sloped surface 824 and the first device-side locking surface 811. The pair of wall members 860, the flat surface 822, the sloped surface 824 and the shallower sloped end portion 828 serve as the guide for attachment of the cartridge 20 to the holder 600 and for detachment of the cartridge 20 from the holder 600. In the course of attachment or detachment of the cartridge 20, the pair of wall members 860 restrict the motion of the first cartridge-side locking element 210 in the Y-axis direction, while the flat surface 822, the sloped surface 824 and the shallower sloped end portion 828 restrict the motion of the first cartridge-side locking element 210 in the X-axis direction. This enables the cartridge 20 to be smoothly guided to the proper attachment position in the holder 600 and to be smoothly removed from the holder 600. According to another embodiment, a smooth curved surface may be provided between the pair of wall members 860 to be extended from the operating member 830 to the first device-side locking element 810, instead of the flat surface 822, the sloped surface 824 and the shallower sloped end portion 828.

According to this embodiment, an undercut surface 870 is formed by cutting out part of the sloped surface 824 at the position corresponding to the extended surface 218, in order to receive the extended surface 218 formed on the cartridge 20 and prevent the stuck lever 800. According to this embodiment, the undercut surface 870 is provided as a plane parallel to the second device-side locking surface 813 and is formed from the groove 815 toward the pivotal center 800*c*.

According to this embodiment, an abutting portion 880 is formed on the rear face of the first device-side locking element 810. The abutting portion 880 is configured to temporarily abut the elastic member 682 provided on the holder 600 in the course of attachment of the cartridge 20 to the holder 600 or in the course of detachment of the cartridge 20 from the holder 600.

A pair of pivot shaft bodies 850 are formed on the outer surfaces of the pair of wall members 860 to determine the position of the pivotal center 800*c*. The pair of pivot shaft bodies 850 are provided substantially in the middle of the Z-axis direction length of the lever 800. One of the pivot shaft bodies 850 is protruded in the negative Y-axis direction from the negative Y-axis side surface of the negative Y-axis side wall member, whilst the other pivot shaft body 850 is protruded in the positive Y-axis direction from the positive Y-axis side surface of the positive Y-axis side wall member. According to this embodiment, each of the pair of pivot shaft bodies 840 has a fan-shaped cross section and includes an inner arc surface 852, an outer arc surface 854 and radial side faces 856 and 858. The inner arc surface 852 is a side face at the position corresponding to the central angle of the fan shape, and the outer arc surface 854 is a side face at the position corresponding to the arc of the fan shape. The arcs of the inner arc surface 852 and the outer arc surface 854 both have the centers on the pivotal center 800*c*. The radial side faces 856 and 858 are side faces at the positions corresponding to the radii of the fan shape. The radial side face 856 is a plane substantially along the first device-side locking surface 811, and the radial side face 858 is a plane substantially along the second device-side locking surface 813.

Figure 19:
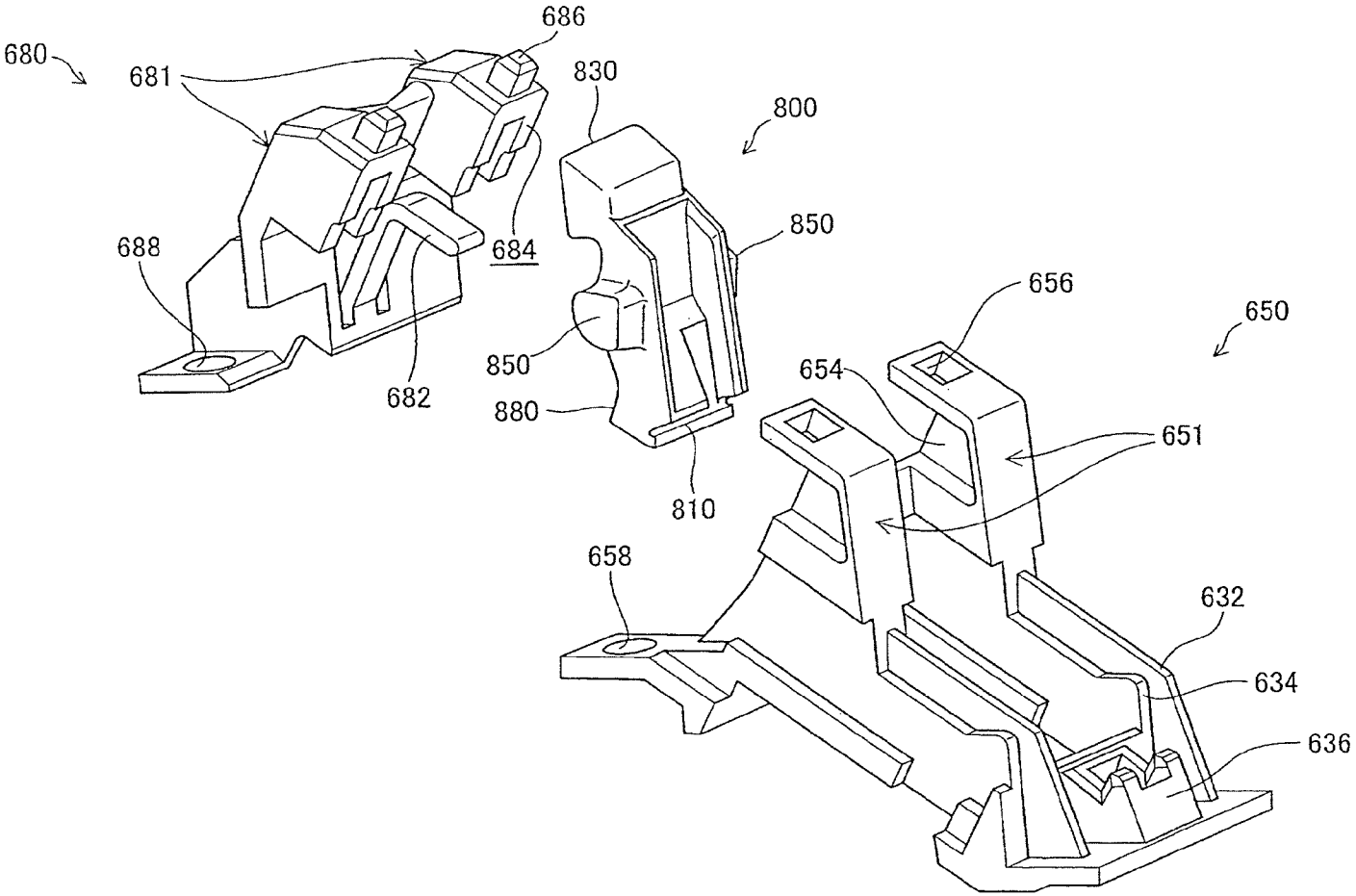
FIG. 19 is an exploded perspective view showing the structure of the lever assembled to the holder.

FIG. 19 is an exploded perspective view showing the structure of the lever 800 assembled to the holder 600. The lever 800 is held on a first retainer member 650 and a second retainer member 680 and is thereby assembled to the holder 600 in a pivotally rotatable manner. The first retainer member 650 and the second retainer member 680 are not fully illustrated in FIG. 19, but only their structural parts relevant to retain the single lever 800 are shown in FIG. 19. According to this embodiment, the first retainer member 650 and the second retainer member 680 are made of a resin material having the higher rigidity than polypropylene (PP), e.g., ABS resin.

The first retainer member 650 has a pair of standing portions 651 and a through hole 658. According to this embodiment, the first retainer member 650 also has the first engagement members 632, the second engagement members 634 and the fitting member 636. The pair of standing portions 651 of the first retainer member 650 are arranged across a space for receiving the lever 800. Each of the standing portions 651 has a bearing element 654 to receive the pivot shaft body 850 of the lever 800. According to this embodiment, each of the standing portions 651 also has an engagement hole 656 serving to engage with the second retainer member 680.

The second retainer member 680 has a pair of standing portions 681 and a through hole 688. According to this embodiment, the second retainer member 680 also has the elastic member 682. The pair of standing portions 681 of the second retainer member 680 are arranged across the same space as that between the pair of standing portions 651 of the first retainer member 650. Each of the standing portions 681 has a block surface 684 to block the bearing element 654, in order to prevent the pivot shaft body 850 of the lever 800 from being unintentionally uncoupled from the bearing element 654. According to this embodiment, each of the standing portions 681 also has an engagement projection 686 to be fit in the engagement hole 656 of the first retainer member 650.

For attachment of the lever 800 to the holder 600, the lever 800 is placed between the pair of standing portions 651 by fitting the respective pivot shaft bodies 850 of the lever 800 into the corresponding bearing elements 654 of the pair of standing portions 651 of the first retainer member 650. Subsequently the first retainer member 650 and the second retainer member 680 are engaged with each other, so that the bearing elements 654 with the pivot shaft bodies 850 of the lever 800 fit therein are blocked by the corresponding block surfaces 684 of the second retainer member 680. The first retainer member 650 and the second retainer member 680 are then fastened together to the holder 600 via screws set in the through holes 658 and 688. This attaches the lever 800 to the holder 600 in a pivotally rotatable manner.

Referring back to FIGS. 13 to 16, the second device-side locking element 620 is formed in the wall member 604 of the holder 600. The second device-side locking element 620 is configured to engage with the second cartridge-side locking element 220 at the second locking position 620L that is located on the positive Z-axis side and on the negative X-axis side of the ink supply tube 640.

According to this embodiment, the second device-side locking element 620 is formed as a through hole having the dimensions to receive the second cartridge-side locking element 220 and has a device-side locking surface 622. The device-side locking surface 622 is a plane facing in the negative Z-axis direction and is configured to engage with the second locking surface 222 of the second cartridge-side locking element 220. In the course of attachment and detachment of the cartridge 20, a positive X-axis end 624 of the device-side locking surface 622 engages with the second cartridge-side locking element 220 and thereby serves as the pivot point of rotation of the cartridge 20 relative to the holder 600.

The wall member 604 of the holder 600 has a space 670 provided on the positive Z-axis side of the second device-side locking element 620. The space 670 provides a room on the wall member 604 to allow rotation of the cartridge 20 about the second device-side locking element 620 as the pivot point of rotation in the course of attachment and detachment of the cartridge 20. According to this embodiment, the space 670 is formed as steps recessed in the negative X-axis direction stepwise in the positive Z-axis direction from the wall member 604. According to another embodiment, the space 670 may be formed as a sloped surface of the wall member 604 lowered in the negative X-axis direction gradually in the positive Z-axis direction.

As shown in FIG. 16, the first device-side locking surface 811 of the first device-side locking element 810 at the first locking position 810L is provided on the negative Z-axis side, i.e., on the side closer to the wall member 601, by the distance Dz from the device-side locking surface 622 of the second device-side locking element 620. In other words, the device-side locking surface 622 is located on the positive Z-axis side, i.e., on the upper side of the holder 600 in the use attitude of the printer 50, by the distance Dz from the first device-side locking surface 811 at the first locking position 810L. This structure enhances the engagement between the first cartridge-side locking element 210 and the first device-side locking element 810 in the attached state of the cartridge 20 to the holder 600 as described above with reference to FIG. 6.

A-5. Attachment and Detachment of Cartridge to and from Holder

Figure 20:
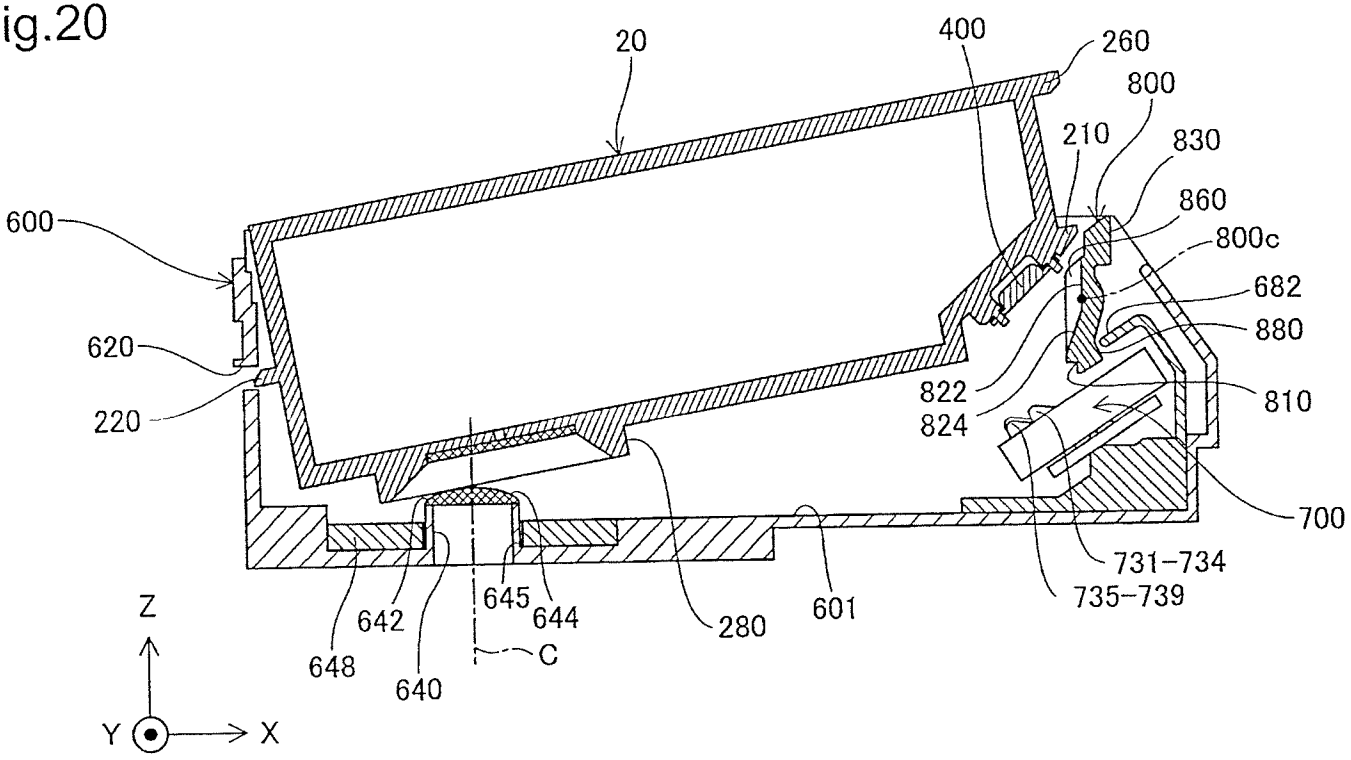
FIG. 20 illustrates attachment and detachment of the cartridge to and from the holder.
Figure 22:
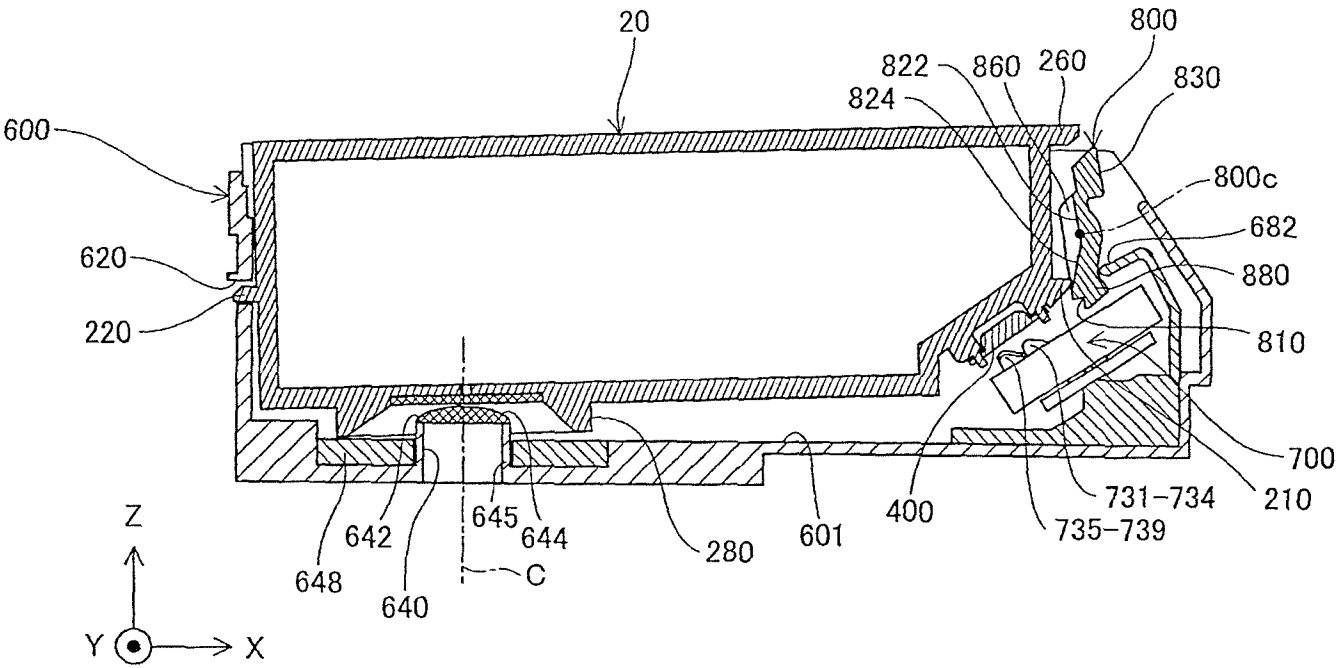
FIG. 22 illustrates attachment and detachment of the cartridge to and from the holder.

FIGS. 20, 21 and 22 illustrate attachment and detachment of the cartridge 20 to and from the holder 600. FIGS. 20 to 22 show the cross sections of the cartridge 20 and the holder 600 taken at the position corresponding to FIG. 5.

For attachment of the cartridge 20 to the holder 600, as shown in FIG. 20, the second cartridge-side locking element 220 is inserted into the second device-side locking element 620, while the cartridge 20 is moved from its end with the second cartridge-side locking element 220 in the negative Z-axis direction into the holder 600. In the state of FIG. 20, the first cartridge-side locking element 210 of the cartridge 20 is located on the positive Z-axis side of the first device-side locking element 810 of the lever 800 in the holder 600.

From the state of FIG. 20, the cartridge 20 is turned clockwise, viewed from the positive Y-axis direction, about the second cartridge-side locking element 220 inserted in the second device-side locking element 620 as the pivot point of rotation, so as to press the third face 203 of the cartridge 20 toward the wall member 601 of the holder 600. As shown in FIG. 21, the first cartridge-side locking element 210 is then guided to between the pair of wall members 860 of the lever 800 to restrict the motion in the Y-axis direction and is in contact with the flat surface 822 between the pair of wall members 860 to restrict the motion in the X-axis direction, while moving on the flat surface 822 in the negative Z-axis direction.

From the state of FIG. 21, the cartridge 20 is further turned to press the third face 203 of the cartridge 20. The first cartridge-side locking element 210 is then further pressed in the negative Z-axis direction and moves on the flat surface 822 to the sloped surface 824 of the lever 800. As shown in FIG. 22, rotating the lever 800 counterclockwise, viewed from the positive Y-axis direction, makes the sloped surface 824 of the lever 800 close to the orientation parallel to the Z axis. In the state of FIG. 22, the first cartridge-side locking element 210 moves in the negative Z-axis direction on the sloped surface 824 close to the orientation parallel to the Z axis. According to this embodiment, the abutting portion 880 on the rear face of the lever 800 abuts the elastic member 682 and receives the pressing force of pressing back the lever 800 clockwise, viewed from the positive Y-axis direction, from the elastic member 682. This pressing force is an external force including a negative Z-axis component. The rotatable range of the lever 800 is accordingly restricted by the elastic member 682. This state of FIG. 22 that the lever 800 abuts the elastic member 682 and is pressed by the elastic member 682 continues until the cartridge 20 is further pressed such that the first cartridge-side locking element 210 goes over the sloped surface 824 of the lever 800.

When the cartridge 20 is further turned from the state of FIG. 22 to cause the first cartridge-side locking element 210 to move on through the sloped surface 824 of the lever 800 and go over the shallower sloped end portion 828, the lever 800 is returned to its original position as shown in FIG. 5, so that the first device-side locking element 810 moves to the first locking position 810L to lock the first cartridge-side locking element 210. The ink supply port 280 of the cartridge 20 is connected with the ink supply tube 640, so that the second cartridge-side locking element 220 engages with the second device-side locking element 620. This completes attachment of the cartridge 20 to the holder 600. Proper attachment of the cartridge 20 at the designed attachment position enables electrical connection between the cartridge-side terminals 431 to 439 and the device-side terminals 731 to 739 and ensures signal transmission between the cartridge 20 and the printer 50.

According to this embodiment, simultaneously with the first cartridge-side locking element 210 moves on through the sloped surface 824 of the lever 800 and goes over the shallower sloped end portion 828, the elastic member 682 separates from the abutting portion 880 on the rear face of the lever 800. The user can accordingly feel the click in the course of attachment of the cartridge 20 to the holder 600.

According to this embodiment, in the attached state of the cartridge 20 to the holder 600, the elastic member 682 does not abut the lever 800 and does not apply an external force. This prevents the lever 800 from being continuously pressed by the elastic member 682 and deformed.

According to another embodiment, the elastic member 682 may abut the lever 800 and press the lever 800 in the direction including a negative X-axis component even in the attached state of the cartridge 20 to the holder 600. This enables the user to more strongly feel the click in the course of attachment of the cartridge 20 to the holder 600. According to another embodiment, the elastic member 682 may be omitted. This reduces the total number of parts. The structure without the elastic member 682 will be described later in a second embodiment.

Figure 23:
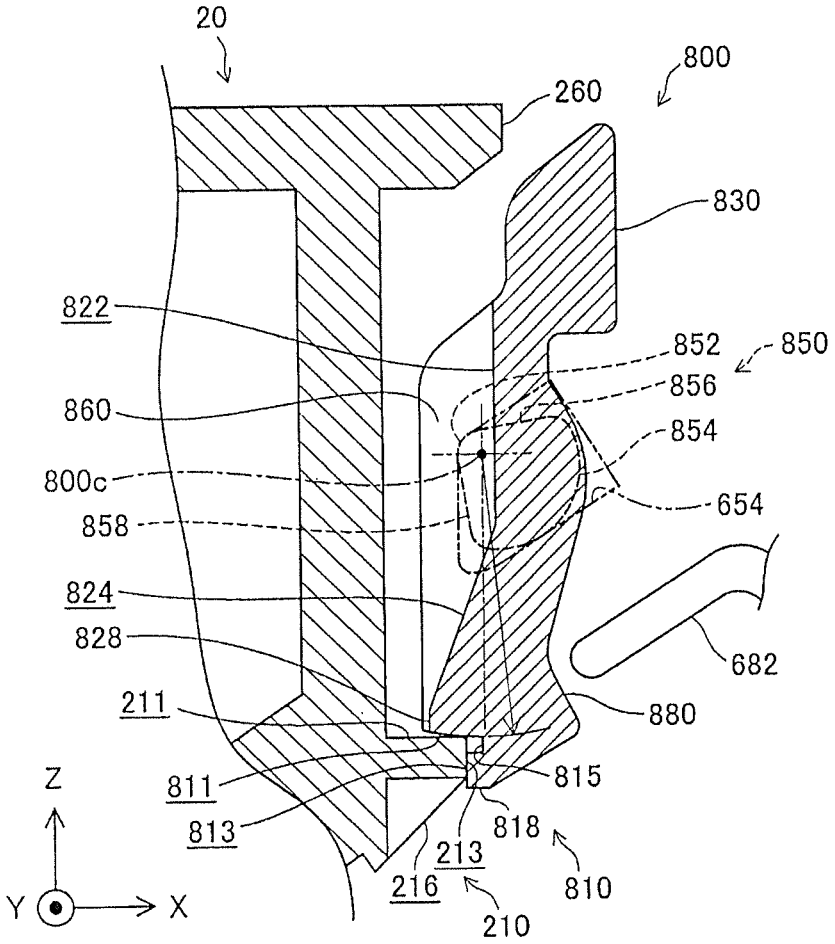
FIG. 23 is a sectional view illustrating the structure around the lever in the attached state of the cartridge to the holder.
Figure 24:
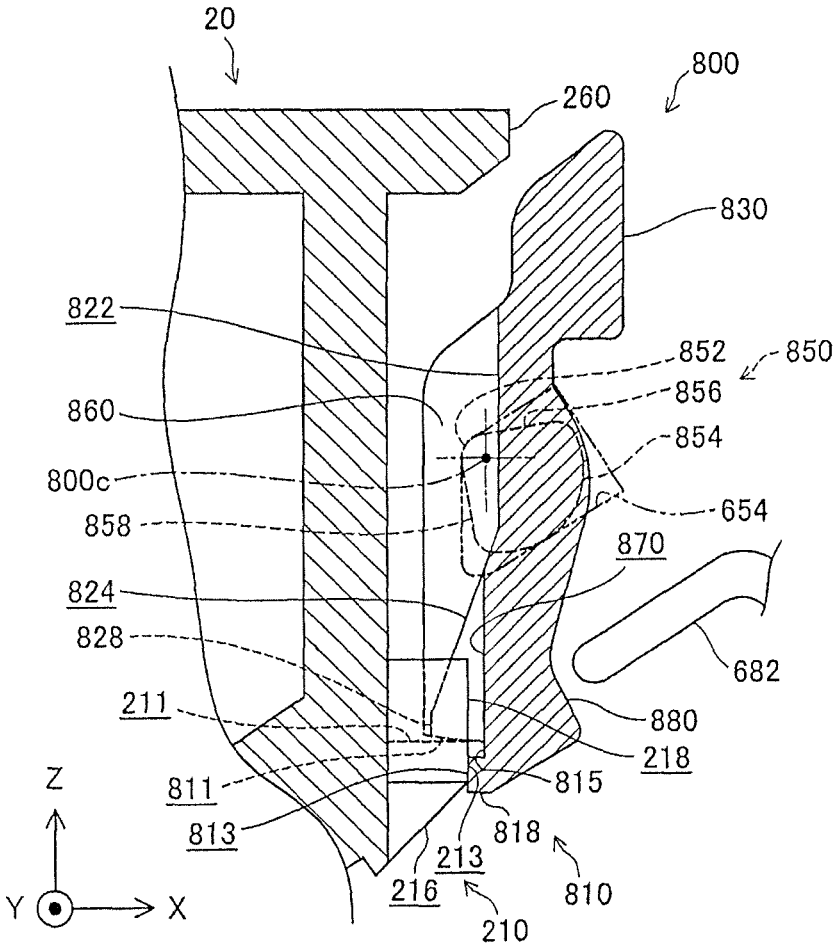
FIG. 24 is a sectional view illustrating the structure around the lever in the attached state of the cartridge to the holder.

FIGS. 23 and 24 are sectional views illustrating the structure around the lever 800 in the attached state of the cartridge 20 to the holder 600. In the state of the lever 800 shown in FIGS. 23 and 24, the first device-side locking element 810 locks the first cartridge-side locking element 210 at the first locking position 810L.

FIG. 23 shows the cross section of the lever 800 locking the cartridge 20 in the holder 600, taken on the plane that goes through the first device-side locking surface 811 and is parallel to the X axis and the Y axis. FIG. 24 shows the cross section of the lever 800 locking the cartridge 20 in the holder 600, taken on the plane that goes through the undercut surface 870 and is parallel to the X axis and the Y axis. In FIGS. 23 and 24, the broken line represents the projected shape of the pivot shaft body 850 of the lever 800, and the two-dot chain line represents the projected shape of the bearing element 654.

As shown in FIGS. 23 and 24, the position of the pivotal center 800*c* of the lever 800 is determined by the contact of the inner arc surface 852 and the outer arc surface 854 with the bearing element 654. Continuously turning the lever 800 counterclockwise, viewed from the positive Y-axis direction, causes the radial side surface 856 of the pivot shaft body 850 to abut the bearing element 654 and thereby restricts the counterclockwise rotation of the lever 800 viewed from the positive Y-axis direction. Continuously turning the lever 800 clockwise, viewed from the positive Y-axis direction, causes the radial side surface 858 of the pivot shaft body 850 to abut the bearing element 654 and thereby restricts the clockwise rotation of the lever 800 viewed from the positive Y-axis direction. This structure ensures stable rotation of the lever 800 and enables the cartridge 20 to be stably held at the designed attachment position.

As shown in FIGS. 23 and 24, the first device-side locking surface 811 of the first device-side locking element 810 engages with the first locking surface 211 of the first cartridge-side locking element 210. Such engagement restricts the motion of the cartridge 20 in the positive Z-axis direction in the attached state of the cartridge 20 to the holder 600. According to this embodiment, the first device-side locking surface 811 is formed to have the cross section parallel to the X axis and the Z axis as the curved surface in arc shape about the pivotal center 800*c*.

As shown in FIGS. 23 and 24, the second device-side locking surface 813 of the first device-side locking element 810 engages with the third locking surface 213 of the first cartridge-side locking element 210. Such engagement restricts the motion of the cartridge 20 in the positive X-axis direction in the attached state of the cartridge 20 to the holder 600. According to this embodiment, the second device-side locking surface 813 is formed as the plane parallel to the Y axis and the Z axis during engagement with the third locking surface 213.

As shown in FIG. 24, in the state that the first device-side locking element 810 locks the first cartridge-side locking element 210, part of the first cartridge-side locking element 210 including the extended surface 218 is accommodated in the space above the undercut surface 870 provided by cutting out the sloped surface 824. This effectively prevents the extended surface 218 from interfering with the engagement of the first device-side locking element 810 with the first cartridge-side locking element 210.

FIG. 25 illustrates moving the cartridge 20 in the negative Z-axis direction from the state of FIG. 24. FIG. 25 shows the assumed state that the user excessively presses the cartridge 20 in the negative Z-axis direction compared with the state of FIG. 5 in the course of attachment of the cartridge 20 to the holder 600. According to this embodiment, as shown in FIG. 25, when the cartridge 20 moves further in the negative Z-axis direction from the state where the first device-side locking element 810 locks the first cartridge-side locking element 210, the second device-side locking surface 813 of the lever 800 engages with the extended surface 218 formed by extending the third locking surface 213 in the positive Z-axis direction. This effectively prevents the negative Z-axis end 818 of the lever 800 from running on the first locking surface 211 of the cartridge 20. According to this embodiment, elimination of the force of moving the cartridge 20 in the negative Z-axis direction from the state of FIG. 25 returns the cartridge 20 and the lever 800 to the state of FIG. 24.

Figure 26:
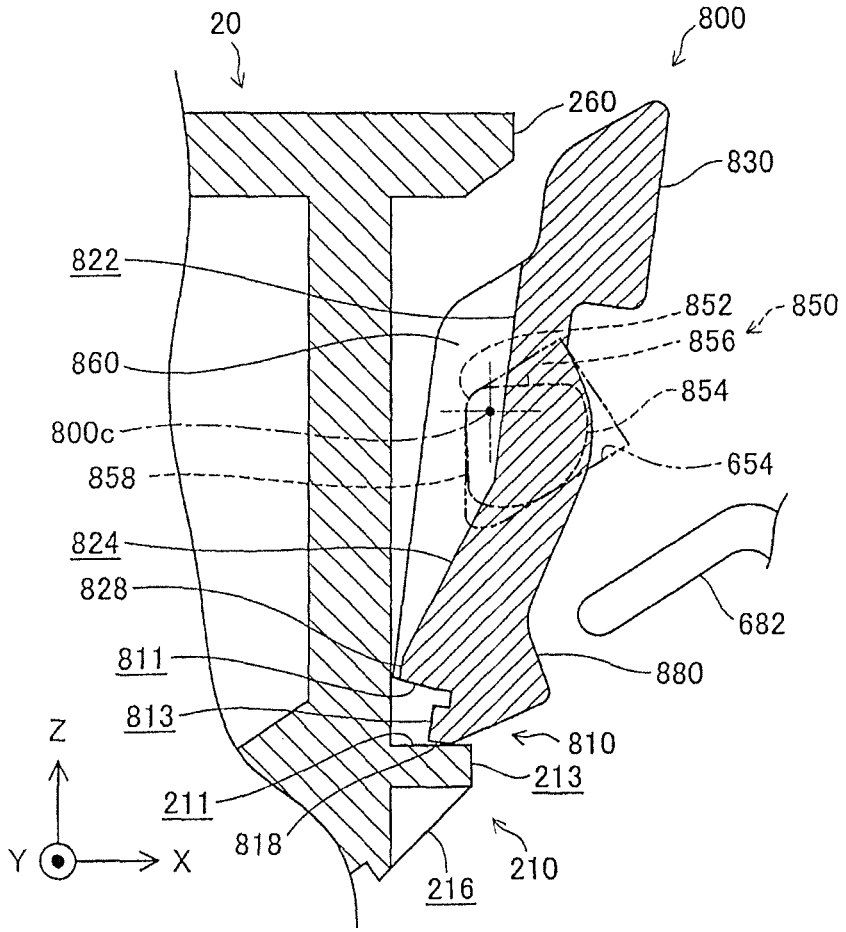
FIG. 26 illustrates moving the cartridge in the negative Z-axis direction from the state corresponding to the state of FIG. 23 according to another embodiment without an extended surface.

FIG. 26 illustrates moving the cartridge 20 in the negative Z-axis direction from the state corresponding to the state of FIG. 23 according to another embodiment without the extended surface 218. Like FIG. 25, FIG. 26 also shows the assumed state that the user excessively presses the cartridge 20 in the negative Z-axis direction in the course of attachment of the cartridge 20 to the holder 600. As shown in FIG. 26, according to this embodiment without the extended surface 218, when the second device-side locking surface 813 of the lever 800 goes over the third locking surface 213 of the cartridge 20, the lever 800 turns clockwise, viewed from the positive Y-axis direction, so that the negative Z-axis end 818 of the lever 800 runs on the first locking surface 211 of the cartridge 20. According to this embodiment without the extended surface 218, the state of FIG. 26 is maintained even when the force of moving the cartridge 20 in the negative Z-axis direction is eliminated. According to this embodiment, the stuck state of the lever 800 is eliminated by pressing the operating member 830 of the lever 800 in the negative X-axis direction and turning the lever 800 counterclockwise, viewed from the positive Y-axis direction, while pressing the cartridge 20 in the negative Z-axis direction.

Figure 26A:
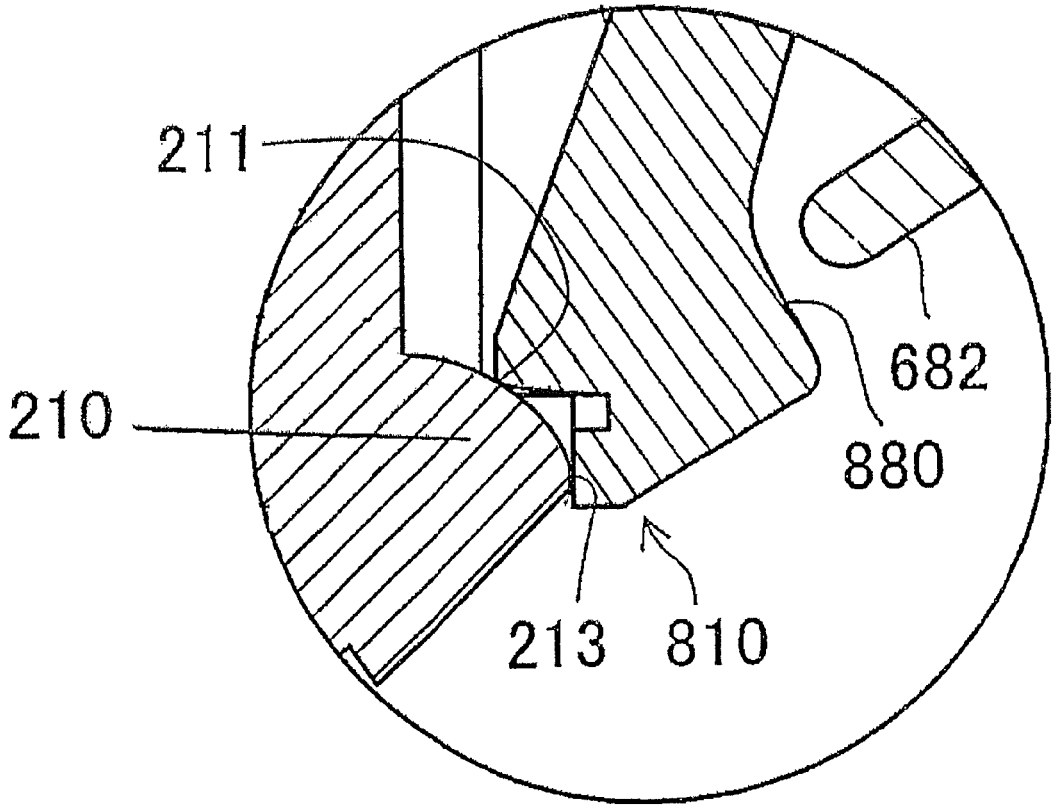
FIG. 26A is a close up view of the cartridge attached to the holder.
Figure 26B:
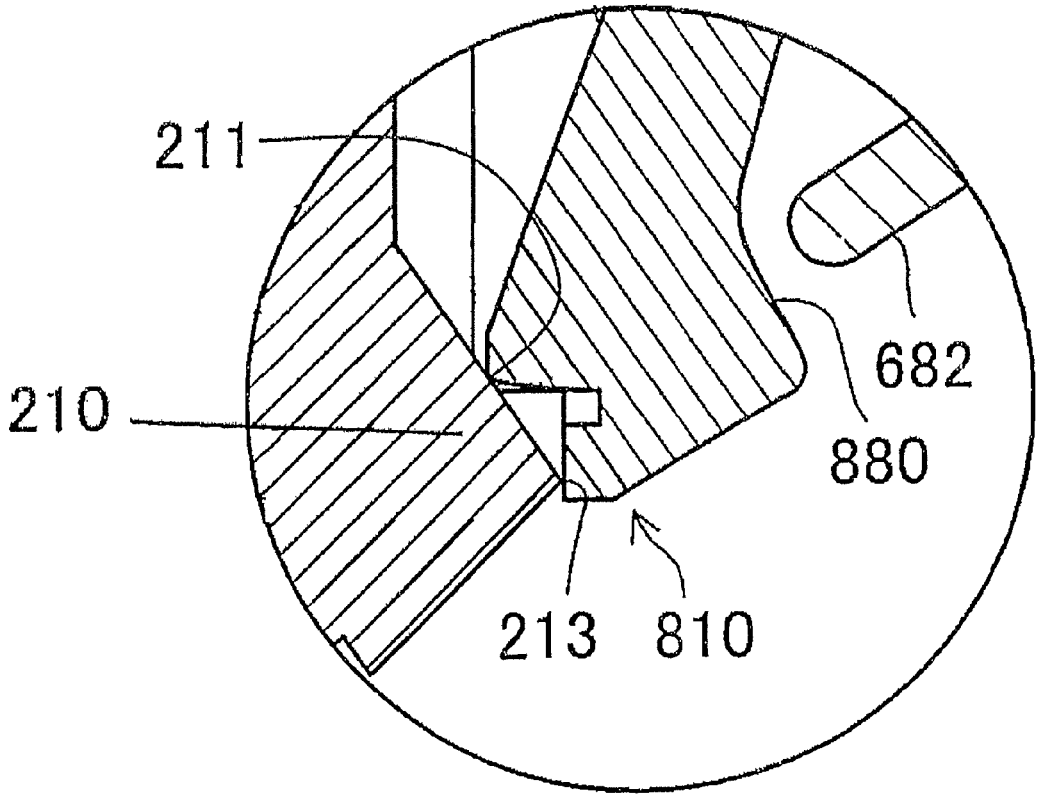
FIG. 26B is a close up view of the cartridge attached to the holder.

As can be seen in FIG. 26A, the first locking surface 211 of the first restriction portion 210 can be formed with a curved surface so that the first cartridge-side locking surface 211 and third locking surface 213 are configured as separate sections of the same surface. Alternatively, as can be seen in FIG. 26B, the first locking surface 211 of the first restriction portion 210 can be formed with a flat slanted surface or other shape so that the first locking surface 211 and third locking surface 213 are configured as separate sections of the same surface.

The cartridge 20 is removed from the holder 600 according to the following procedure. For detachment of the cartridge 20 from the holder 600, the user presses the operating member 830 of the lever 800 in the negative X-axis direction from the state of FIG. 5. In other words, the user applies the operating force Pr in the negative X-axis direction to the operating member 830 of the lever 800. The lever 800 is then turned about the pivotal center 800*c* to move the first device-side locking element 810 in the direction including the positive X-axis component. This disengages the first device-side locking element 810 from the first cartridge-side locking element 210 to the state of FIG. 22. The user subsequently grasps the projection 260 and moves the third face 203 of the cartridge 20 in the positive Z-axis direction, while turning the cartridge 20 counterclockwise, viewed from the positive Y-axis direction, about the second cartridge-side locking element 220 inserted in the second device-side locking element 620 as the pivot point of rotation to the state of FIG. 21 and further to the state of FIG. 20. The user then holds the third face 203 of the cartridge 20 and pulls the second cartridge-side locking element 220 out of the second device-side locking element 620, so as to remove the cartridge 20 from the holder 600.

A-6. Advantageous Effects

According to the first embodiment described above, the lever 800 is provided not on the cartridge 20 but on the holder 600. This structure allows size reduction of the cartridge 20. This structure also shortens the distance between the side wall (the third face 203) of the cartridge 20 and the lever 800 and allows size reduction of the lever 800, thus achieving the size reduction of the printing device and the overall printing material supply system. Since the lever 800 is not provided on the cartridge 20, there is the high degree of freedom in selection of the materials for the housing of the cartridge 20 and for the lever 800. The material with the relatively high rigidity can be selected as the materials for the housing and the lever 800. This lowers the possibility of plastic deformation explained above and enables the cartridge to be stably held at the designed attachment position.

As shown in FIG. 42A, in the course of attachment of the cartridge 20 to the holder 600, the rotation locus of the cartridge-side contact portion 460 about the second locking position 620L on the second locking surface 222 as the pivotal center goes in the negative X-axis direction, while the rotation locus of the device-side contact portion 760 goes in the positive X-axis direction. This enables attachment of the cartridge 20 at the designed attachment position and significantly increases the amount of wiping between the cartridge-side terminals 431 to 439 and the device-side terminals 731 to 739.

In the attached state of the cartridge 20 to the holder 600, the pressing forces Ps and Pt applied from the holder 600 to the cartridge 20 act in the direction of enhancing the engagement of the first cartridge-side locking element 210 with the first device-side locking element 810 (direction including the positive X-axis component and the positive Z-axis component). This effectively prevents detachment of the cartridge 20 from the designed attachment position and enables the cartridge 20 to be stably held at the designed attachment position. The lever 800 is provided not on the cartridge 20 but on the holder 600. This structure allows size reduction of the cartridge 20. Since the lever 800 is not provided on the cartridge 20, there is the high degree of freedom in selection of the material for the first face 201 to the eighth face 208 of the cartridge 20.

B. Second Embodiment

FIGS. 27, 28, 29 and 30 illustrate attachment and detachment of the cartridge 20 to and from a holder 600A according to a second embodiment. A printing material supply system 10A of the second embodiment adopts the holder 600A without the elastic member 682 for pressing the lever 800, but otherwise has the similar configuration and structure to those of the printing material supply system 10 of the first embodiment. The like elements to those of the first embodiment are expressed by the like symbols and are not specifically explained here. The structure of the cartridge 20 is identical with the structure described in the first embodiment.

Figure 27:
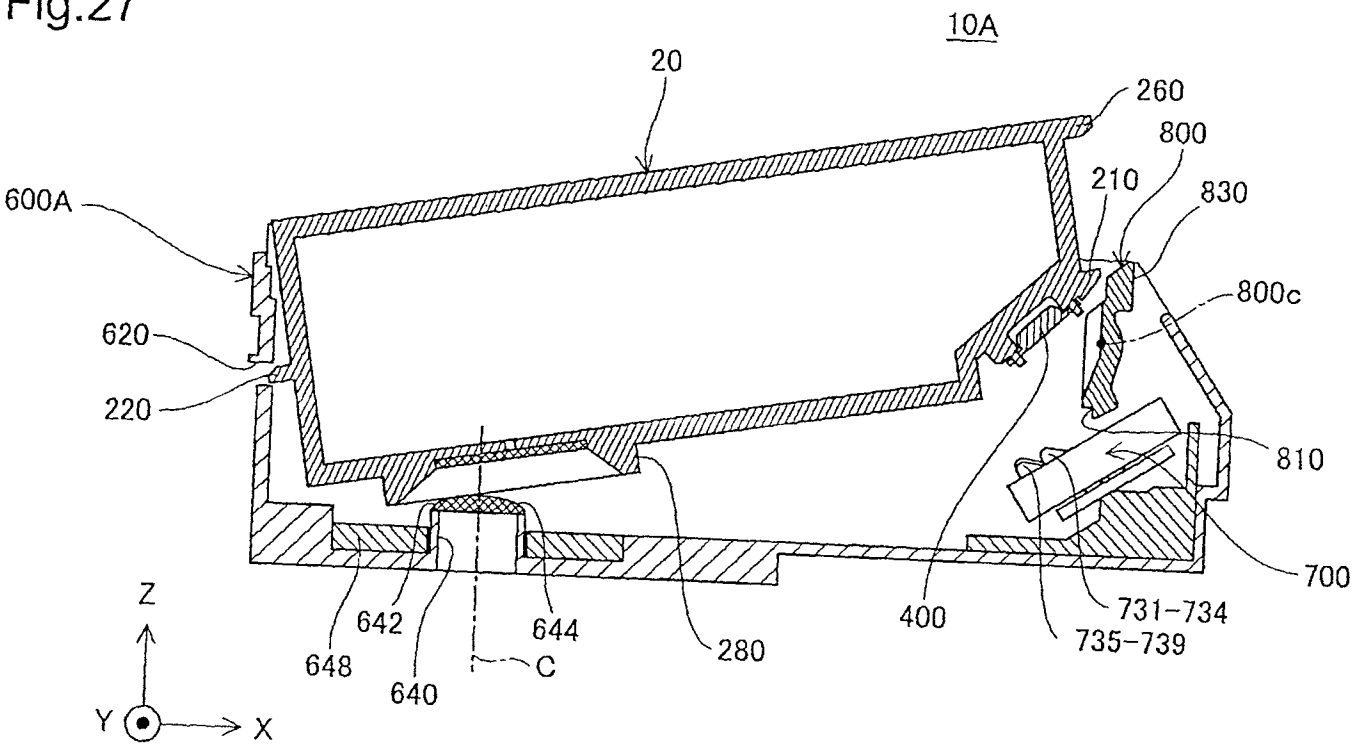
FIG. 27 illustrates attachment and detachment of the cartridge to and from the holder according to a second embodiment.
Figure 28:
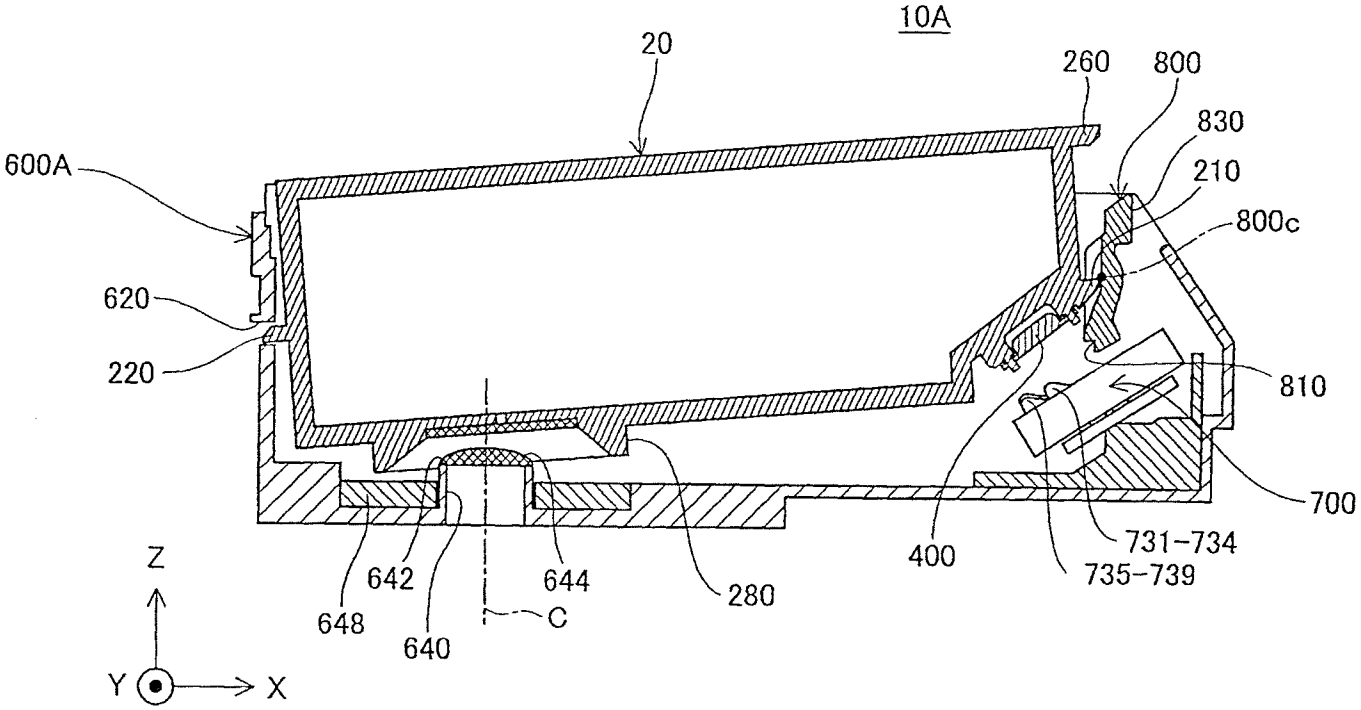
FIG. 28 illustrates attachment and detachment of the cartridge to and from the holder according to the second embodiment.
Figure 29:
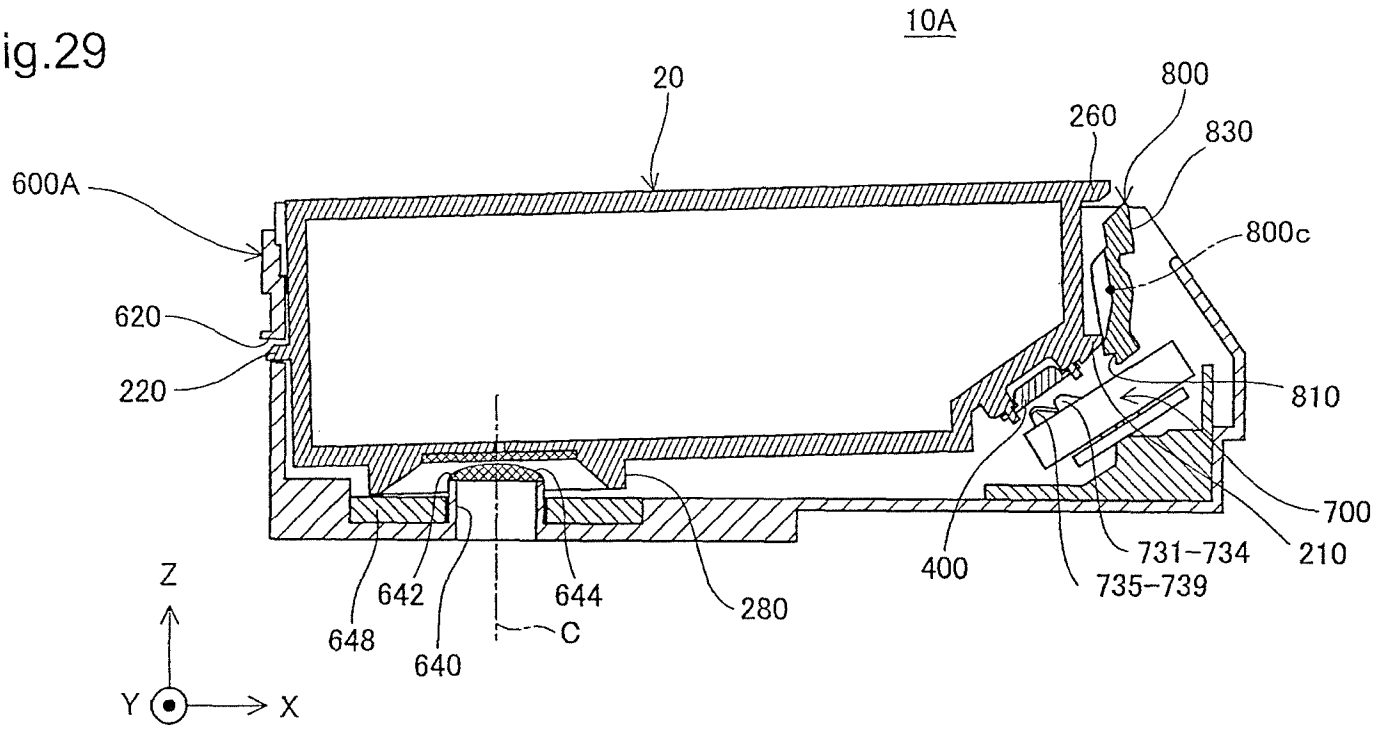
FIG. 29 illustrates attachment and detachment of the cartridge to and from the holder according to the second embodiment.
Figure 30:
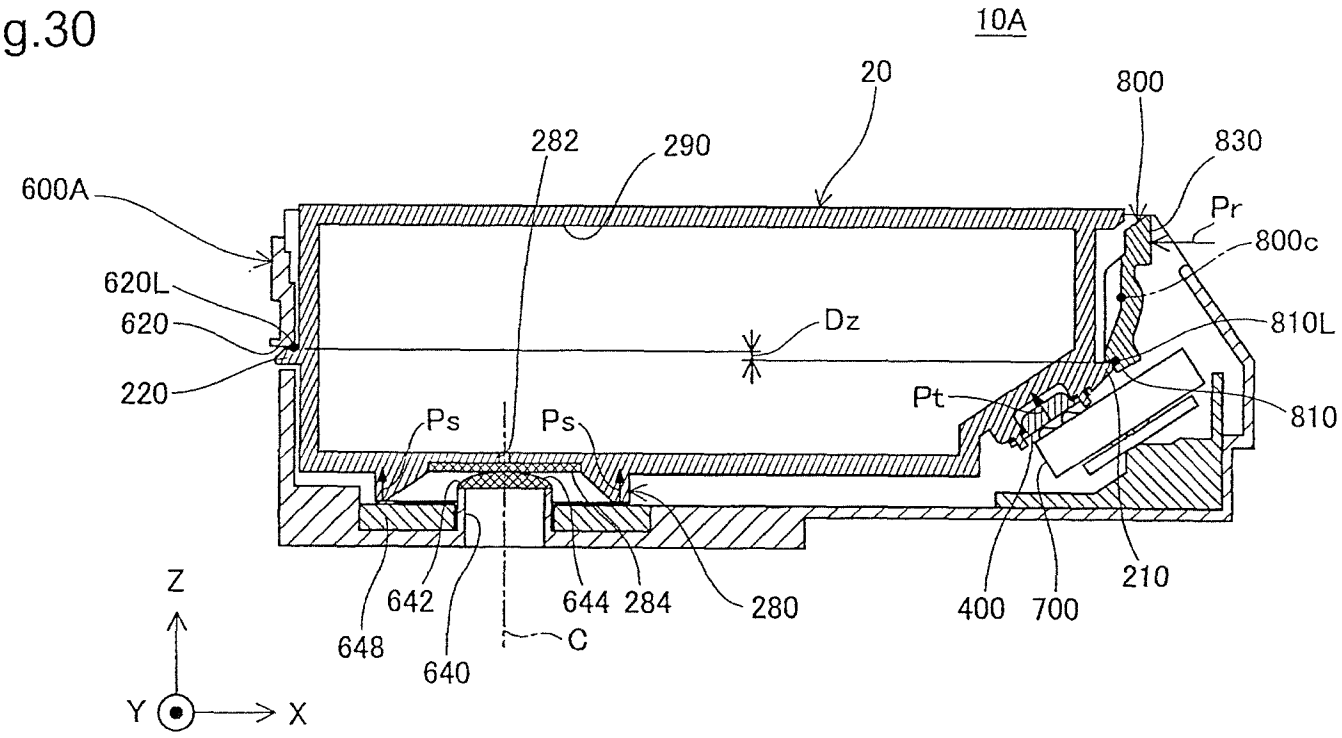
FIG. 30 illustrates attachment and detachment of the cartridge to and from the holder according to the second embodiment.

FIG. 27 corresponds to the state of FIG. 20 of the first embodiment. FIG. 28 corresponds to the state of FIG. 21 of the first embodiment. FIG. 29 corresponds to the state of FIG. 22 of the first embodiment. FIG. 30 corresponds to the state of FIG. 5 of the first embodiment and shows the attached state of the cartridge 20 to the holder 600A.

For attachment of the cartridge 20 to the holder 600A, as shown in FIG. 27, the second cartridge-side locking element 220 is inserted into the second device-side locking element 620, while the cartridge 20 is moved from its end with the second cartridge-side locking element 220 in the negative Z-axis direction into the holder 600A.

From the state of FIG. 27, the cartridge 20 is turned clockwise, viewed from the positive Y-axis direction, about the second cartridge-side locking element 220 inserted in the second device-side locking element 620 as the pivot point of rotation. As shown in FIG. 28, the first cartridge-side locking element 210 is then guided to between the pair of wall members 860 of the lever 800 and moves in the negative Z-axis direction on the flat surface 822 between the pair of wall members 860.

From the state of FIG. 28, the cartridge 20 is further turned to make the first cartridge-side locking element 210 move on the flat surface 822 to the sloped surface 824 of the lever 800. As shown in FIG. 29, rotating the lever 800 counterclockwise, viewed from the positive Y-axis direction, makes the sloped surface 824 of the lever 800 close to the orientation parallel to the Z axis. In the state of FIG. 29, the first cartridge-side locking element 210 moves in the negative Z-axis direction on the sloped surface 824 close to the orientation parallel to the Z axis.

When the cartridge 20 is further turned from the state of FIG. 29 to cause the first cartridge-side locking element 210 to move on through the sloped surface 824 of the lever 800 and go over the shallower sloped end portion 828, the lever 800 is returned to its original position by its dead weight as shown in FIG. 30, so that the first device-side locking element 810 moves to the first locking position 810L to lock the first cartridge-side locking element 210. This completes attachment of the cartridge 20 to the holder 600A.

For detachment of the cartridge 20 from the holder 600A, the user applies the operating force Pr in the negative X-axis direction to the operating member 830 of the lever 800 in the state of FIG. 30, so that the first device-side locking element 810 is disengaged from the first cartridge-side locking element 210 to the state of FIG. 29. The user subsequently moves the cartridge 20 in the positive Z-axis direction, while turning the cartridge 20 counterclockwise, viewed from the positive Y-axis direction, about the second cartridge-side locking element 220 inserted in the second device-side locking element 620 as the pivot point of rotation. This completes detachment of the cartridge 20 from the holder 600A.

The structure of the second embodiment described above has the similar advantageous effects to those of the first embodiment, except the functions by the elastic member 682. The printing material supply system 10A of the second embodiment without the elastic member 682 allows reduction of the manufacturing cost, compared with the printing material supply system 10 of the first embodiment.

C. Third Embodiment

Figure 31:
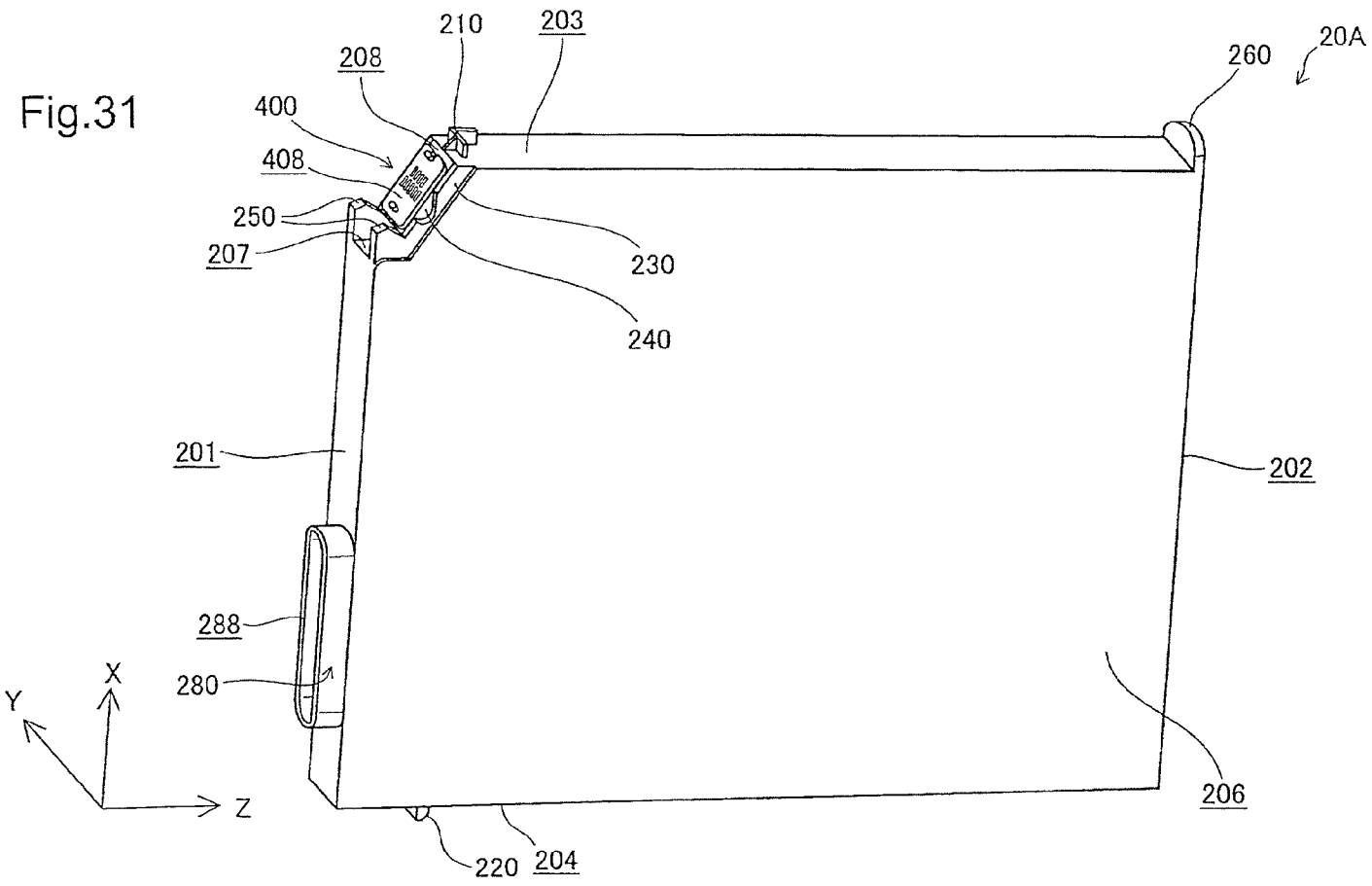
FIG. 31 is a perspective view illustrating the structure of a cartridge according to a third embodiment.

FIG. 31 is a perspective view illustrating the structure of a cartridge 20A according to a third embodiment. The differences from the cartridge 20 of the first embodiment (FIG. 7) include the dimensions of the cartridge 20A and the horizontal orientation of attachment of the cartridge 20A to the holder (not shown) instead of the vertical orientation of attachment described above. Otherwise the cartridge structure is similar to the cartridge structure of the first embodiment. The like elements to those of the first embodiment are expressed by the like symbols and are not specifically explained here. Due to the different dimensions and attachment orientation of the cartridge 20A from those of the first embodiment, the printer of the third embodiment also adapts the different dimensions of the holder and the different position and orientation of the holder in the printer from those in the printer of the first embodiment. The individual parts and components of the holder according to the third embodiment are, however, identical with those of the first embodiment and are thus not specifically described here. While the cartridge 20 of the first embodiment is especially suitable for the on-carriage type printers and the small-size printers, the cartridge 20A of the third embodiment is especially suitable for the off-carriage type printers and the large-size printers. Both the cartridges 20 and 20A are, however, applicable to any types of printers, i.e., on-carriage type and off-carriage type, and small size and large size.

As shown in FIG. 31, the cartridge 20A according to the third embodiment has the similar structure to that of the cartridge 20 according to the first embodiment, except that the third face 203 to the sixth face 206 are extended in the positive Z-axis direction. According to the third embodiment, the Z-axis direction length, the X-axis direction length and the Y-axis direction length of the cartridge 20A descend in this order. According to the third embodiment, the cartridge 20A is attached to and detached from the holder 600 in the Z-axis direction that is the horizontal direction and upward in the direction of gravity (vertical direction) that is the positive X-axis direction.

The structure of the third embodiment has the similar advantageous effects to those of the structure of the first embodiment.

D. Modifications

The foregoing has described the invention in detail with reference to the illustrative embodiments. The invention is, however, not limited to the above embodiments, but a multiplicity of variations and modifications may be made to the embodiments without departing from the scope of the invention.

D-1. Modifications of First Cartridge-Side Locking Element

FIGS. 32A to 32F illustrate modifications of the first cartridge-side locking element 210. More specifically, FIGS. 32A to 32F show six different shapes of first cartridge-side locking elements 210A to 210F.

Figure 32A:
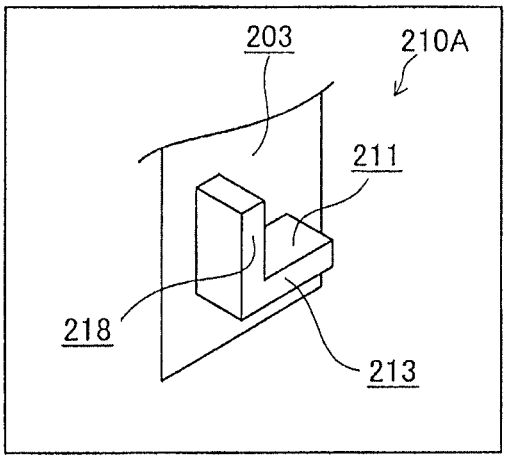
FIGS. 32A to 32F illustrate modifications of first cartridge-side locking element.
Figure 32B:
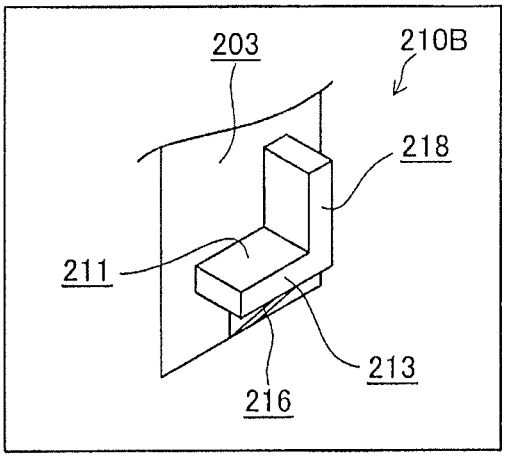
Figure 32C:
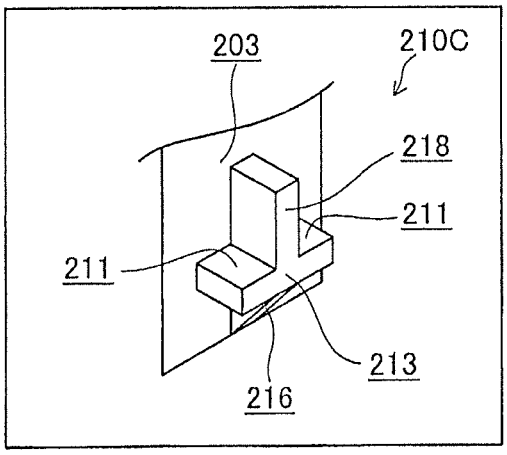

The first cartridge-side locking element 210A shown in FIG. 32A does not have the sloped surface 216, but otherwise has the similar structure to that of the first embodiment. The first cartridge-side locking element 210B shown in FIG. 32B has the extended surface 218 formed on the negative Y-axis side, but otherwise has the similar structure to that of the first embodiment. The first cartridge-side locking element 210C shown in FIG. 32C has the extended surface 218 formed in the middle of the Y-axis direction, but otherwise has the similar structure to that of the first embodiment.

Figure 32D:
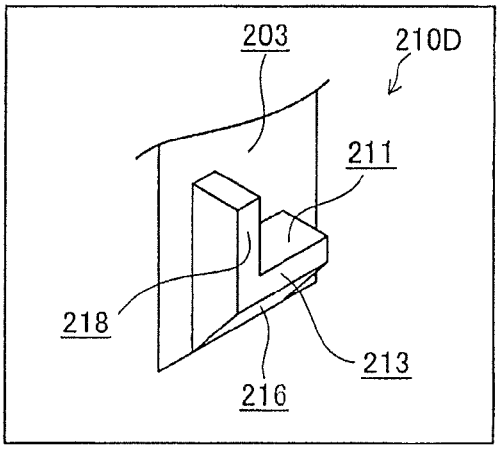
Figure 32E:
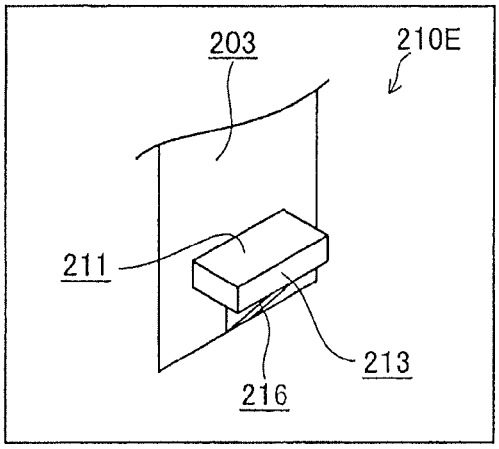
Figure 32F:
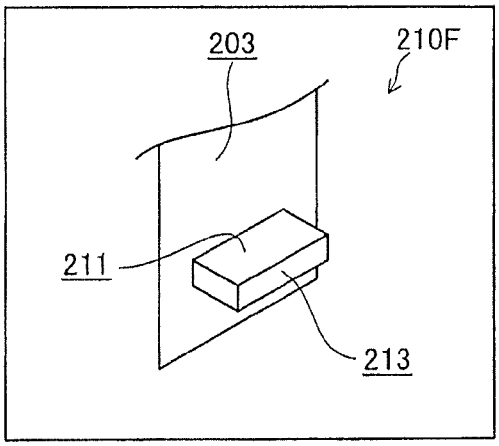

The first cartridge-side locking element 210D shown in FIG. 32D has the sloped surface 216 formed along the whole negative Z-axis end, but otherwise has the similar structure to that of the first embodiment. The first cartridge-side locking element 210E shown in FIG. 32E does not have the extended surface 218, but otherwise has the similar structure to that of the first embodiment. The first cartridge-side locking element 210F shown in FIG. 32F does not have the sloped surface 216 or the extended surface 218, but otherwise has the similar structure to that of the first embodiment.

The lever 800 adopted for the modifications of FIGS. 32A and 32D has the same structure as that of the lever 800 of the first embodiment. The lever 800 adopted for the modifications of FIGS. 32B and 32C has the undercut surface 870 formed at different positions, but otherwise has the similar structure to that of the first embodiment. The lever 800 adopted for the modifications of FIGS. 32E and 32F may not have the undercut surface 870, but otherwise has the similar structure to that of the first embodiment.

Figure 33A:
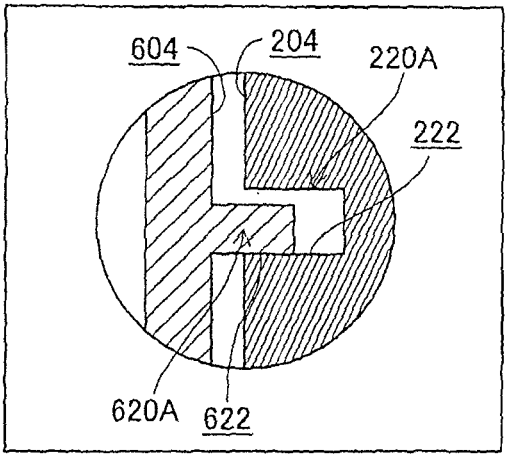
FIGS. 33A to 33C illustrate modifications of second cartridge-side locking element and second device-side locking element.
Figure 33B:
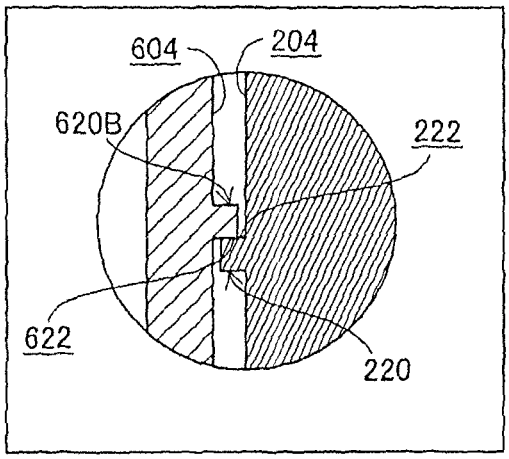
Figure 33C:
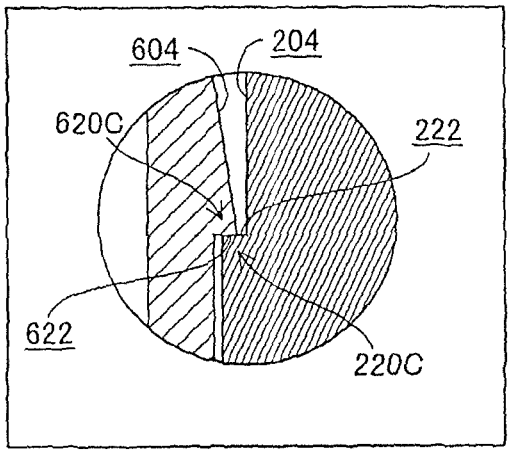

D-2. Modifications of Second Cartridge-Side Locking Element and Second Device-Side Locking Element FIGS. 33A to 33C illustrate modifications of the second cartridge-side locking element 220 and the second device-side locking element 620. More specifically, FIGS. 33A to 33C show three different structures of the second cartridge-side locking element 220 and the second device-side locking element 620.

The modification of FIG. 33A has a second cartridge-side locking element 220A formed as a recess and a second device-side locking element 620A formed as a projection, but otherwise has the similar structure to that of the first embodiment.

The modification of FIG. 33B has a second device-side locking element 620B formed as a projection, which engages with the second cartridge-side locking element 220 of the same shape as that of the first embodiment, but otherwise has the similar structure to that of the first embodiment.

The modification of FIG. 33C has a second cartridge-side locking element 220C formed as a step on the negative Z-axis side rising in the negative X-axis direction and a second device-side locking element 620C formed as a step on the positive Z-axis side rising in the positive X-axis direction, but otherwise has the similar structure to that of the first embodiment.

D-3. Modifications of Cartridge Outer Shape

FIGS. 34A to 34F illustrate modifications of the cartridge outer shape. More specifically, FIGS. 34A to 34F show eight different cartridge outer shapes. The like elements to those of the first embodiment are expressed by the like symbols and are not specifically explained here.

Figure 34A:
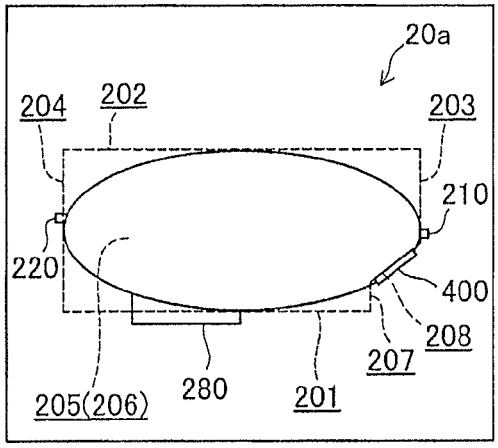
FIGS. 34A to 34H illustrate modifications of cartridge outer shape.

A cartridge 20*a* shown in FIG. 34A has a housing of an elliptical or oval side face. The cartridge 20*a* has the first cartridge-side locking element 210 and the circuit board 400 on its front face, the ink supply port 280 on its bottom face, and the second cartridge-side locking element 220 on its rear face. The cartridge 20*a* has a fixed width, viewed from its front face.

Figure 34B:
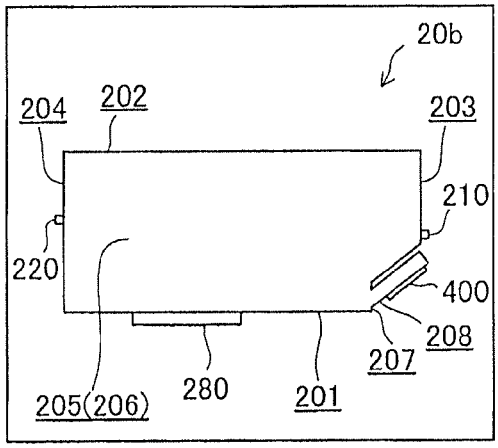

A cartridge 20*b* shown in FIG. 34B has the eighth face 208 that is discontinuous from the negative Z-axis end of the third face 203, but otherwise has the same structure as that of the cartridge 20 of the first embodiment. Cartridge 20L shown in FIG. 34G is similar in shape and design to cartridge 20*b* with the placement of the first cartridge-side restriction element 210 provided closer to the cartridge-side sloped surface 408.

Figure 34C:
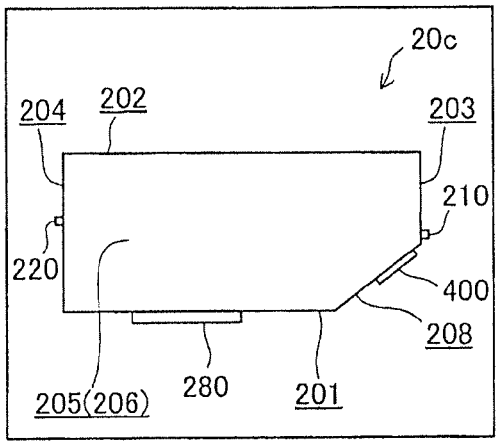

A cartridge 20*c* shown in FIG. 34C has the eighth face 208 extended to the first face 201 with omission of the seventh face 207, but otherwise has the same structure as that of the cartridge 20 of the first embodiment.

Figure 34D:
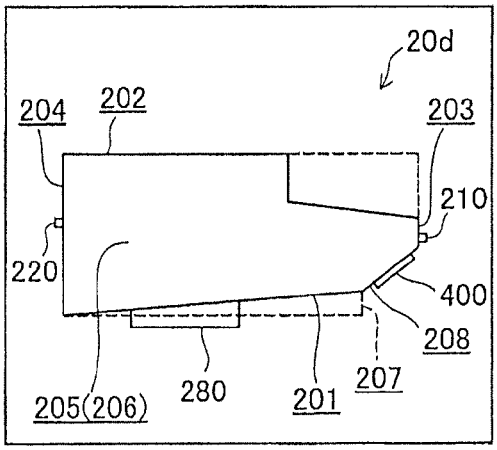

A cartridge 20*d* shown in FIG. 34D has a cutout portion at the intersection between the second face 202 and the third face 203 and the first face 201 inclined to the eighth face 208 with omission of the seventh face 207, but otherwise has the same structure as that of the cartridge 20 of the first embodiment.

Figure 34E:
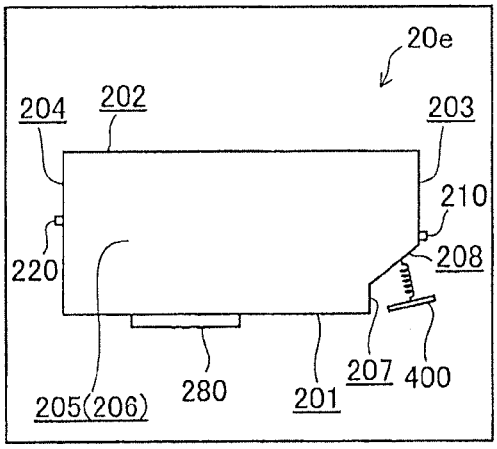

A cartridge 20*e* shown in FIG. 34E has the circuit board 400 attached to the eighth face 208 by means of a spring, but otherwise has the same structure as that of the cartridge 20 of the first embodiment.

Figure 34F:
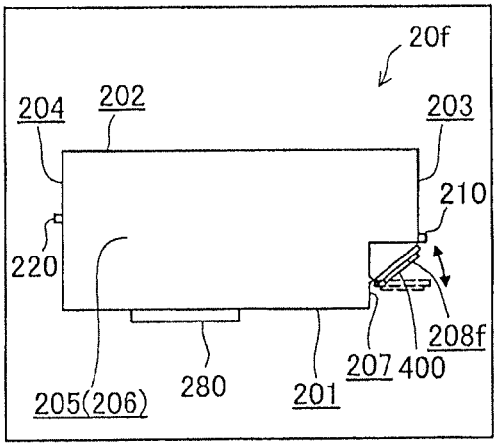
Figure 34G:
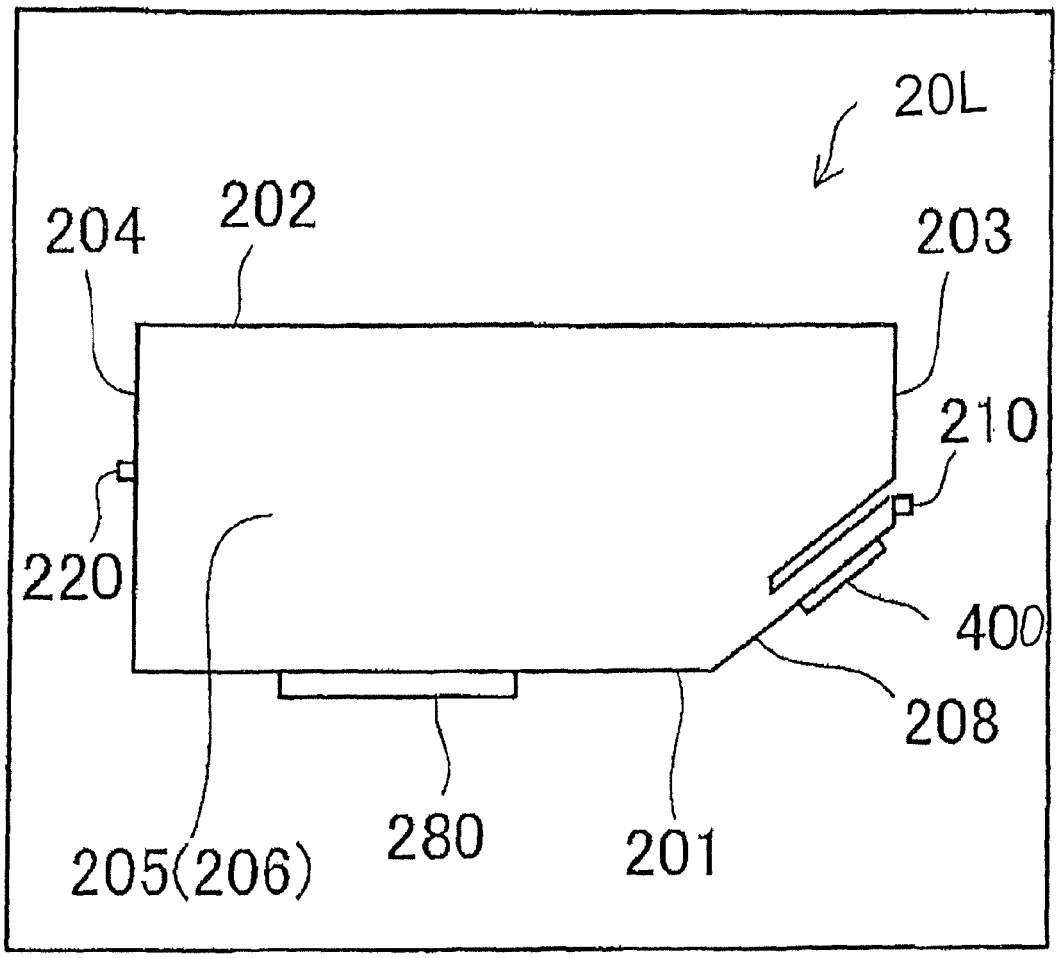

A cartridge 20*f* shown in FIG. 34F has a movable face 208*f*, instead of the eighth face 208, and the circuit board 400 mounted on this movable face 208*f*, but otherwise has the same structure as that of the cartridge 20 of the first embodiment.

Figure 34H:
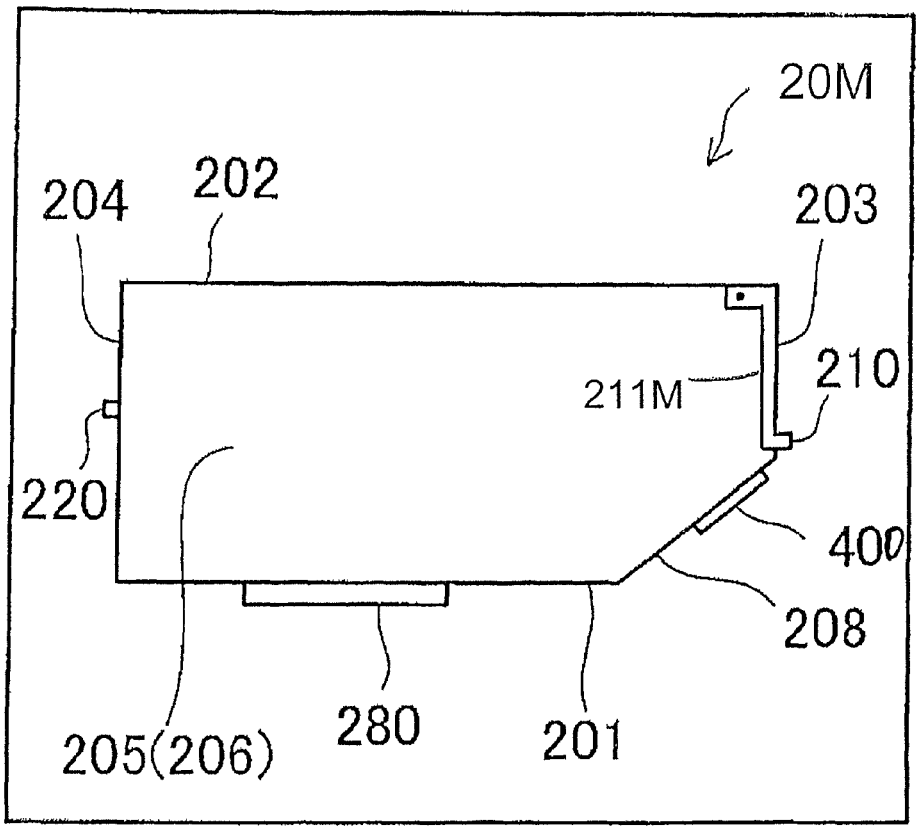

A cartridge 20*m* shown in FIG. 34H has an elongated member 211*m* which is connected at one end to the first cartridge-side restriction element 210 and at the other end to the top of the cartridge 202 via a hinge or other pivotable mechanism.

All the cartridges 20*a* to 20*f* according to the modifications of FIGS. 34A to 34F have the first cartridge-side locking element 210, the second cartridge-side locking element 220, the ink supply port 280 and the circuit board 400 at the positions corresponding to those of the cartridge 20 of the first embodiment. The cartridges 20*a* to 20*f* of the respective modifications are thus all compatible with the cartridge 20 of the first embodiment.

As clearly understood from the examples shown in FIGS. 34A to 34F, there are various other modifications of cartridge outer shape. In the case of the cartridge having the outer shape other than the approximate rectangular parallelepiped, as shown by the broken lines in FIGS. 34A and 34D, the six faces of the rectangular parallelepiped, i.e., the first face (bottom face) 201, the second face (top face) 202, the third face (front face) 203, the fourth face (rear face) 204, the fifth face (left side face) 205 and the sixth face (right side face) 206 shown in FIGS. 7 and 8, can be virtually assumed. In the specification hereof, the terms "face" and "plane" mean both the virtual plane or the non-actual plane as shown in FIG. 34A or 34D and the actual plane as shown in FIGS. 7 and 8. The terms "face" and "plane" include both planar surfaces and curved surfaces.

D-4. Cartridge with Adapter

Figure 35:
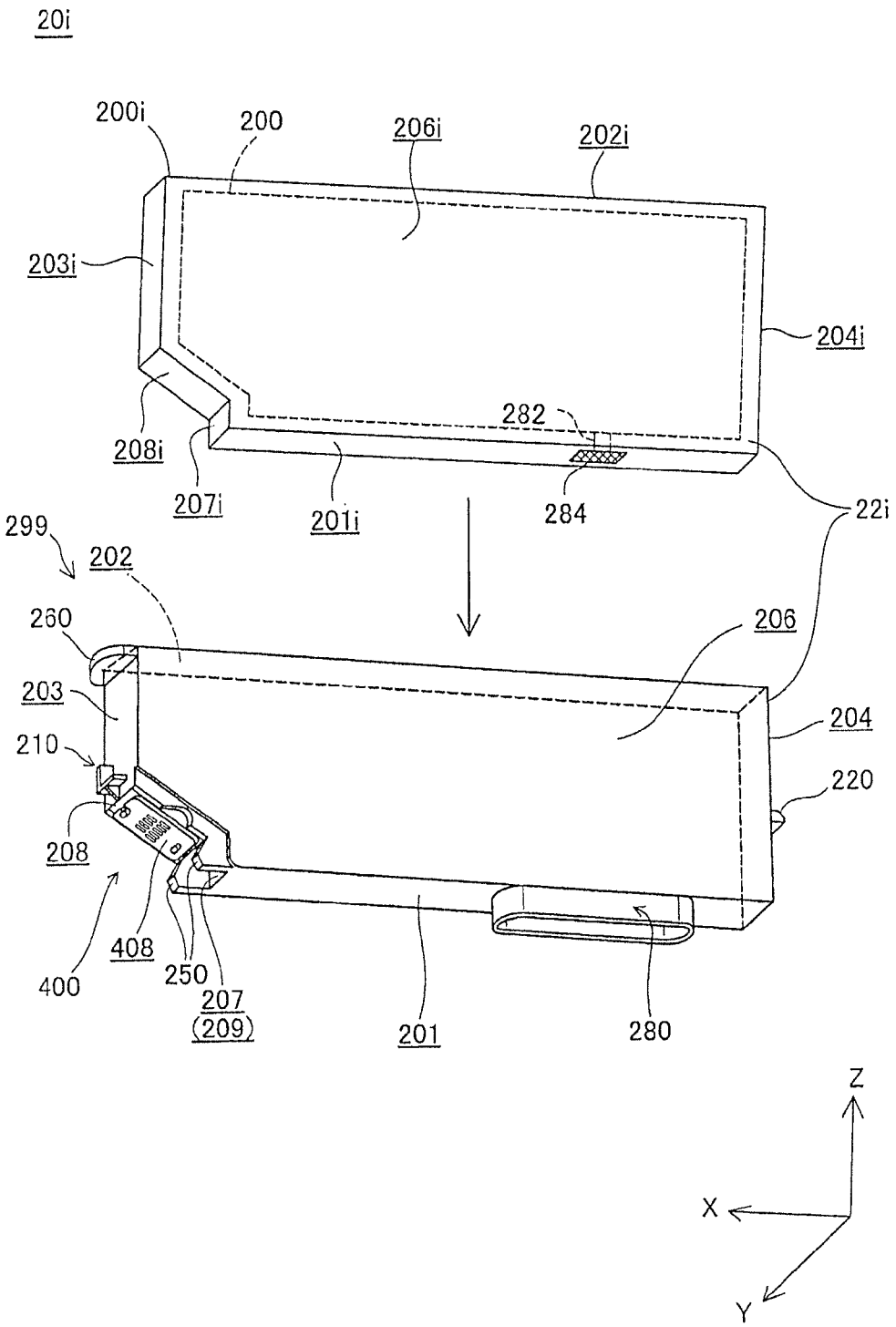
FIG. 35 is a perspective view illustrating the structure of a cartridge with an adapter.

FIG. 35 is a perspective view illustrating the structure of a cartridge 20*i* with an adapter 299. The cartridge 20*i* is configured to be separable to a container assembly 200*i* and the adapter 299. The container assembly 200*i* has a printing material chamber 200 structured to contain printing material. When the printing material in the printing material chamber 200 is used up, the user may replace the container assembly 200*i* with a new one or may refill the printing material into the printing material chamber 200 of the container assembly 200*i*. The adapter 299 is reusable with the replaced container assembly 200*i* or with the container assembly 200*i* having the printing material refilled. The cartridge 20*i* of FIG. 35 is compatible with the cartridge 20 of the first embodiment shown in FIG. 7.

A housing 22*i* for the cartridge 20*i* is structured as a combination of a housing for the container assembly 200*i* and a housing for the adapter 299. The container assembly 200*i* has an ink flow path 282 and a resin foam 284, in addition to the printing material chamber 200.

The container assembly 200*i* of the cartridge 20*i* has a second face 202*i* corresponding to the second face 202 of the cartridge 20*i*. The container assembly 200*i* also has a first face 201*i*, a third face 203*i*, a fourth face 204*i*, a fifth face (not shown), a sixth face 206*i*, a seventh face 207*i* and an eighth face 208*i* respectively corresponding to the first face 201 and the third to the eighth faces 203 to 208 of the cartridge 20*i*.

The first face 201*i* and the second face 202*i* are opposed to each other in the Z-axis direction; the first face 201*i* is located on the negative Z-axis side and the second face 202*i* is located on the positive Z-axis side. The third face 203*i* and the fourth face 204*i* are opposed to each other in the X-axis direction; the third face 203*i* is located on the positive X-axis side and the fourth face 204*i* is located on the negative X-axis side. The fifth face (not shown) and the sixth face 206*i* are opposed to each other in the Y-axis direction; the fifth face (not shown) is located on the negative Y-axis side and the sixth face 206*i* is located on the positive Y-axis side. The seventh face 207*i* and the eighth face 208*i* form the connection faces to connect the first face 201*i* with the third face 203*i*.

The seventh face 207*i* is perpendicular to the first face 201*i* and forms a plane parallel to the Y axis and the Z axis (YZ plane). The seventh face 207*i* is the step vertical-angled relative to the first face 201*i*. The seventh face 207*i* is accordingly extended from the first face 201*i* in the positive Z-axis direction. The seventh face 207*i* is located on the negative X-axis side and on the negative Z-axis side of the eighth face 208*i*.

The eighth face 208*i* connects the seventh face 207*i* with the third face 203*i* and is a sloped surface inclined in the direction including a positive X-axis component and a negative Z-axis component. The eighth face 208*i* is inclined to the first face 201*i* and the third face 203*i* and is perpendicular to the fifth face (not shown) and the sixth face 206*i*. In other words, the eighth face 208*i* is inclined to the XY plane and the YZ plane and is perpendicular to the XZ plane.

The adapter 299 of the cartridge 20*i* has the faces forming the first face 201, the third face 203, the fourth face 204, the fifth face 205, the sixth face 206, the seventh face 207 and the eighth face 208 of the cartridge 20*i*. The face of the adapter 299 forming the second face 202 of the cartridge 20*i* is an opening. The adapter 299 has an inner space to receive the container assembly 200*i*. The first face 201 of the adapter 299 has an ink supply port 280.

The structure of the cartridge 20*i* shown in FIG. 35 is similar to that of the cartridge 20 of the first embodiment shown in FIG. 7 and those of its modifications, except that the cartridge 20*i* is separable to the container assembly 200*i* and the adapter 299 as explained above. According to other embodiments and other modifications, the cartridge may be configured to be separable to a container assembly and an adapter, like the cartridge 20*i* of FIG. 35. The cartridge 20*i* illustrated in FIG. 35 is configured to have different dimensions and ratios in some parts and components from those of the cartridge 20 of the first embodiment, but may be configured to have the same dimensions and ratios to those of the cartridge 20 of the first embodiment.

Figure 36:
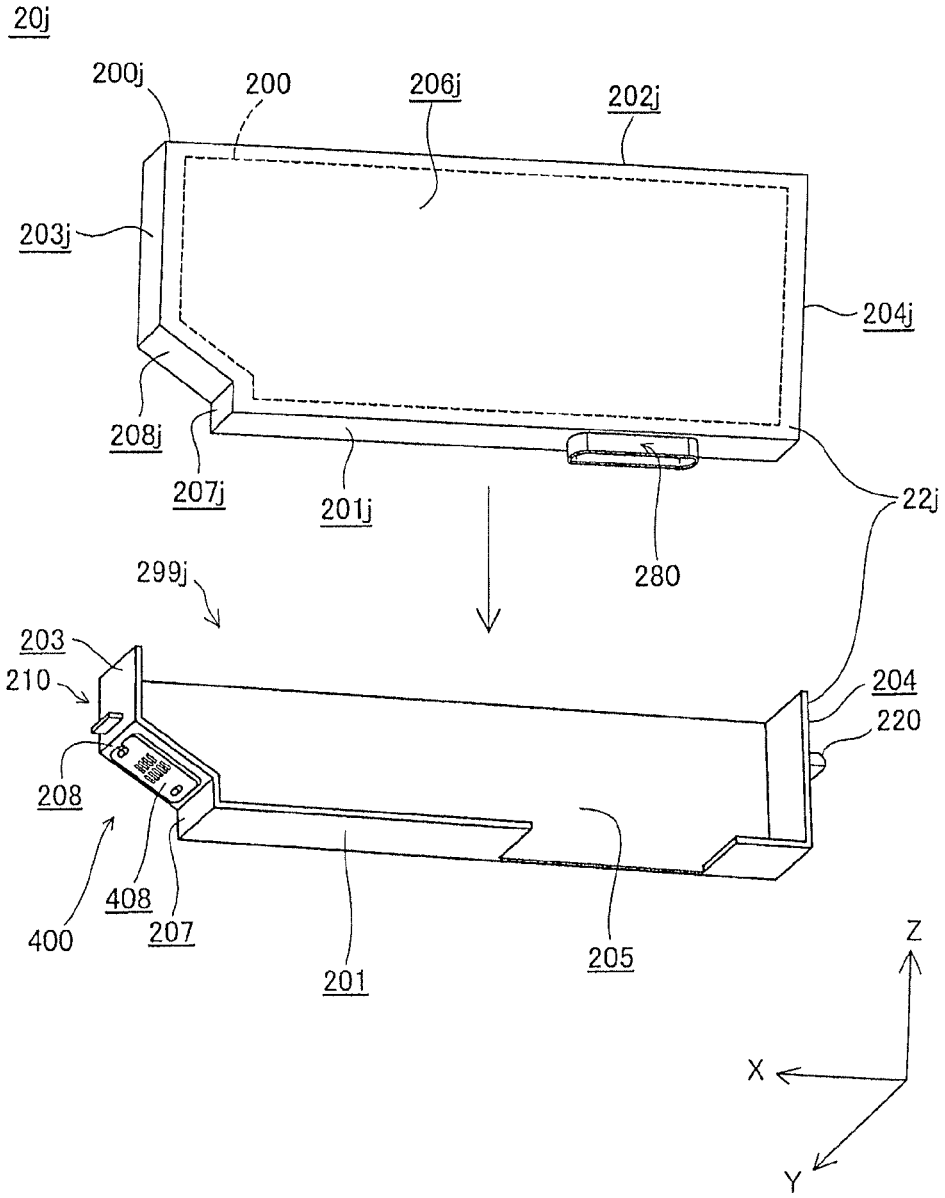
FIG. 36 is a perspective view illustrating the structure of another cartridge with an adapter.

FIG. 36 is a perspective view illustrating the structure of a cartridge 20*j* with an adapter. The cartridge 20*j* is configured to be separable to a container assembly 200*j* and an adapter 299*j*. The container assembly 200*i* has a printing material chamber 200 structured to contain printing material. When the printing material in the printing material chamber 200 is used up, the user may replace the container assembly 200*j* with a new one or may refill the printing material into the printing material chamber 200 of the container assembly 200*j*. The adapter 299*j* is reusable with the replaced container assembly 200*j* or with the container assembly 200*j* having the printing material refilled. The cartridge 20*j* of FIG. 36 is compatible with the cartridge 20 of the first embodiment shown in FIG. 7.

A housing 22*j* for the cartridge 20*j* is structured as a combination of a housing for the container assembly 200*j* and a housing for the adapter 299*j*. The container assembly 200*j* has the printing material chamber 200 and an ink supply port 280.

The container assembly 200*j* of the cartridge 20*j* has a second face 202*j* and a sixth face 206*j* respectively corresponding to the second face 202 and the sixth face 206 of the cartridge 20*j*. The container assembly 200*j* also has a first face 201*j*, a third face 203*j*, a fourth face 204*j*, a fifth face (not shown), a seventh face 207*j* and an eighth face 208*j* respectively corresponding to the first face 201, the third face 203, the fourth face 204, the fifth face 205, the seventh face 207 and the eighth face 208 of the cartridge 20*j*.

The first face 201*j* and the second face 202*j* are opposed to each other in the Z-axis direction; the first face 201*j* is located on the negative Z-axis side and the second face 202*j* is located on the positive Z-axis side. The third face 203*j* and the fourth face 204*j* are opposed to each other in the X-axis direction; the third face 203*j* is located on the positive X-axis side and the fourth face 204*j* is located on the negative X-axis side. The fifth face (not shown) and the sixth face 206*j* are opposed to each other in the Y-axis direction; the fifth face (not shown) is located on the positive Y-axis side and the sixth face 206*j* is located on the negative Y-axis side. The seventh face 207*j* and the eighth face 208*j* form the connection faces to connect the first face 201*j* with the third face 203*j*.

The seventh face 207*j* is perpendicular to the first face 201*j* and forms a plane parallel to the Y axis and the Z axis (YZ plane). The seventh face 207*j* is the step vertical-angled relative to the first face 201*j*. The seventh face 207*j* is accordingly extended from the first face 201*j* in the positive Z-axis direction. The seventh face 207*j* is located on the negative X-axis side and on the negative Z-axis side of the eighth face 208*j*.

The eighth face 208*j* connects the seventh face 207*j* with the third face 203*j* and is a sloped surface inclined in the direction including a positive X-axis component and a negative Z-axis component. The eighth face 208*j* is inclined to the first face 201*j* and the third face 203*j* and is perpendicular to the fifth face (not shown) and the sixth face 206*j*. In other words, the eighth face 208*j* is inclined to the XY plane and the YZ plane and is perpendicular to the XZ plane.

The adapter 299*j* of the cartridge 20*i* has the faces forming the first face 201, the third face 203, the fourth face 204 and the fifth face 205 of the cartridge 20*j*. The faces of the adapter 299*j* forming the second face 202 and the sixth face 206 of the cartridge 20*j* are openings. The adapter 299*j* has an inner space to receive the container assembly 200*j*. The adapter 299*j* also has an opening in part of the first face 201. The ink supply port 280 provided in the container assembly 200*j* is exposed on the opening and is connected with the ink supply tube 640.

The structure of the cartridge 20*j* shown in FIG. 36 is similar to that of the cartridge 20 of the first embodiment shown in FIG. 7 and those of its modifications, except that the cartridge 20*j* is separable to the container assembly 200*j* and the adapter 299*j* as explained above. According to other embodiments and other modifications, the cartridge may be configured to be separable to a container assembly and an adapter, like the cartridge 20*j* of FIG. 36.

The cartridge 20*j* of FIG. 36 has the first cartridge-side locking element 210 of the simpler structure than that of the first embodiment (FIG. 7) but may have the first cartridge-side locking element 210 of the same structure as that of the first embodiment (FIG. 7). The cartridge 20*j* illustrated in FIG. 36 is configured to have different dimensions and ratios in some parts and components from those of the cartridge 20 of the first embodiment, but may be configured to have the same dimensions and ratios to those of the cartridge 20 of the first embodiment. The cartridge 20*j* of FIG. 36 does not have the projection 260 but may have the projection 260 like the first embodiment.

Figure 37:
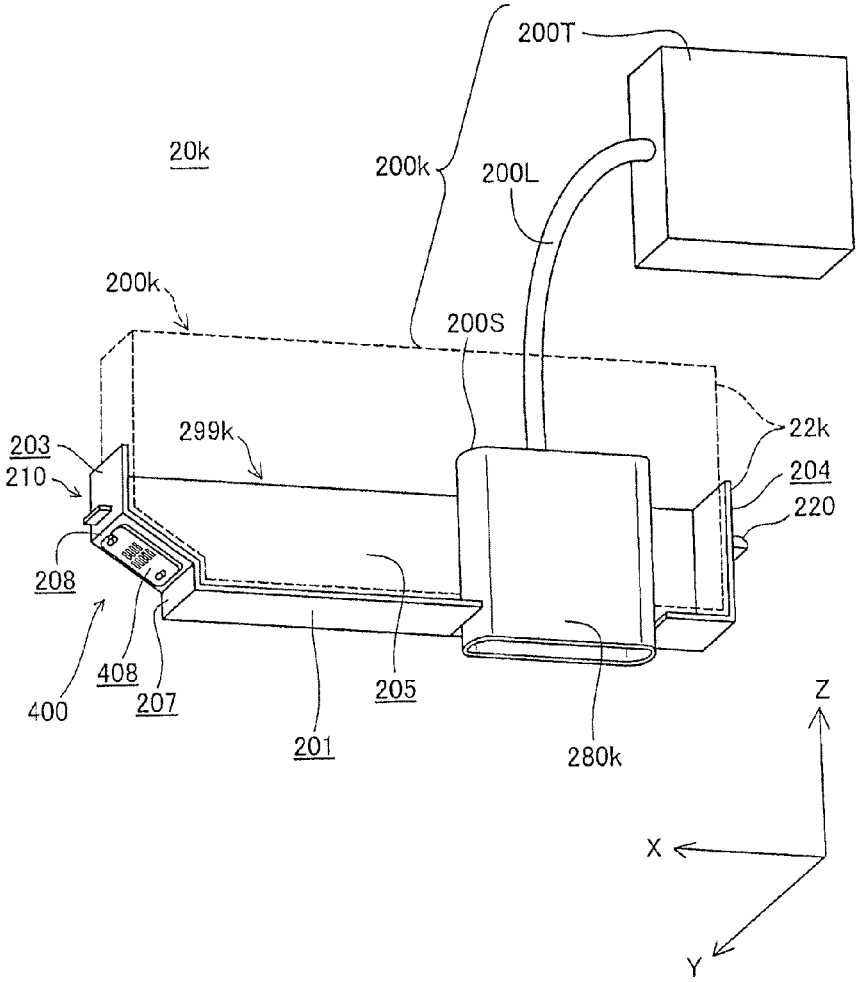
FIG. 37 is a perspective view illustrating the structure of another cartridge with an adapter.

FIG. 37 is a perspective view illustrating the structure of a cartridge 20*k* with an adapter. The cartridge 20*k* includes an adapter 299*k*, an external tank 200T, a tube 200L and an auxiliary adapter 200S. The adapter 299*k* of the cartridge 20*k* has the same structure as that of the adapter 299*j* of FIG. 36 and those of its modifications.

The external tank 200T of the cartridge 20*k* contains printing material and is located outside the printer 50 shown in FIG. 1 according to this modification. The printing material contained in the eternal tank 200T is supplied to the auxiliary adapter 200S via the tube 200L. The auxiliary adapter 200S of the cartridge 20*k* has an ink supply port 280*k*, which corresponds to the ink supply port 280 of the first embodiment.

The external tank 200T, the auxiliary adapter 200S and the tube 200L serve as a container assembly 200*k* configured to contain ink. As shown by the broken line, the cartridge 20*k* of FIG. 37 is assumed to have the container assembly 200*k*. A housing 22*k* of the cartridge 20*k* is structured as a combination of a housing for the virtual container assembly 200*k* and a housing for the adapter 299*k*.

The cartridge 20*k* of FIG. 37 is thus separable to the container assembly 200*k* and the adapter 299*k*, like the cartridge 20*i* shown in FIG. 35 and the cartridge 20*j* shown in FIG. 36. When the printing material in the external tank 200T is used up, the user may replace the external tank 200T with a new one or may refill the printing material into the external tank 200T. The adapter 299*k* is reusable with the replaced external tank 200T or with the external tank 200T having the printing material refilled. The cartridge 20*k* of FIG. 37 is compatible with the cartridge 20 of the first embodiment shown in FIG. 7.

The structure of the cartridge 20*k* shown in FIG. 37 is similar to that of the cartridge 20 of the first embodiment shown in FIG. 7 and those of its modifications, except that the cartridge 20*k* is separable to the container assembly 200*k* and the adapter 299*k* as explained above. According to other embodiments and other modifications, the cartridge may be configured to be separable to a container assembly and an adapter, like the cartridge 20*k* of FIG. 37.

D-5. Modifications of Circuit Board 400 and Terminal Array

The cartridge 20 has the circuit board 400 according to the above embodiments, but may not have the circuit board 400 according to other embodiments. The cartridge-side terminals may be formed directly on the eighth face 208. In this application, the eighth face 208 forms the cartridge-side sloped surface 408.

Part of wiring and the memory unit 420 on the circuit board 400 may be provided at any suitable location other than the eighth face 208. For example, part of wiring, the memory unit 420 and the cartridge-side terminals 431 to 439 may be provided on a flexible printed circuit board having the larger area than the circuit board 400. The flexible printed circuit board may be folded, so as to locate the cartridge-side terminals 431 to 439 on the eighth face 208. In another example, part of wiring and the memory unit 420 may be provided on the fifth face 205 adjacent to the eighth face 208.

Each of the cartridge-side terminals and the device-side terminals may be arrayed in one single line or in three or more lines, instead of the two lines.

Figure 38A:
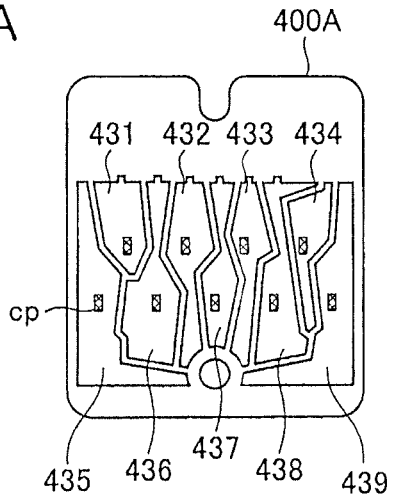
FIGS. 38A to 38C illustrate modifications of terminal shape.
Figure 38B:
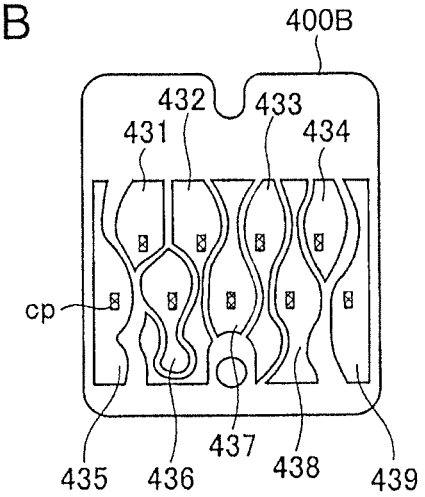
Figure 38C:
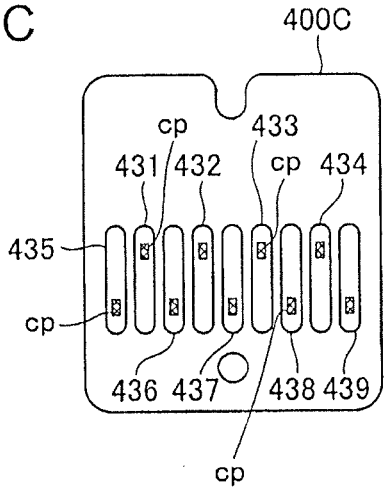

The shape and the array of the cartridge-side terminals 431 to 439 are not limited to those shown in FIG. 12A. FIGS. 38A to 38C show modifications of the shape of the cartridge-side terminals. Circuit boards 400A, 400B and 400C of FIGS. 38A, 38B and 38C according to the modifications have the same structure as that of the circuit board 400 of FIG. 12A according to the first embodiment, except the outer shape of the cartridge-side terminals 431 to 439.

The cartridge-side terminals 431 to 439 on the circuit board 400A shown in FIG. 38A have irregular polygonal shapes, instead of the approximate rectangular shape of the cartridge-side terminals 431 to 439 on the circuit board 400 of FIG. 12A.

The cartridge-side terminals 431 to 439 on the circuit board 400B shown in FIG. 38B have shapes defined by irregular straight lines and curves, instead of the approximate rectangular shape of the cartridge-side terminals 431 to 439 on the circuit board 400 of FIG. 12A.

The cartridge-side terminals 431 to 439 on the circuit board 400C shown in FIG. 38C have an identical straight line shape of a predetermined width and are arrayed in one line in its width direction. The cartridge-side terminals (attachment detection terminals) 435 and 439 are located on both ends of the array of the aligned cartridge-side terminals 431 to 439. The cartridge-side terminal (attachment detection terminal) 431 is located between the cartridge-side terminal (attachment detection terminal) 435 and the cartridge-side terminal (power terminal) 436. The cartridge-side terminal (attachment detection terminal) 434 is located between the cartridge-side terminal (attachment detection terminal) 439 and the cartridge-side terminal (data terminal) 438.

In these circuit boards 400A, 400B and 400C shown in FIGS. 38A, 38B and 38C according to the modifications, the contact portions "cp" of these terminals 431 to 439, which are in contact with the corresponding device-side terminals, have the same arrangement as that of the circuit board 400 shown in FIG. 12A according to the first embodiment. The individual terminals may have the outer shapes of various variations as long as the contact portions "cp" have the same arrangement.

E. Other Modifications

The foregoing has described the invention in detail with reference to the illustrative embodiments. The invention is, however, not limited to the above embodiments, but a multiplicity of variations and modifications may be made to the embodiments without departing from the scope of the invention. Some examples of possible modifications are described below.

Among the various constituents, components and parts according to the above embodiments, those non-relevant to any of specific objects, functions, operations, effects and advantages may be omitted. For example, the memory unit 420 of the cartridge 20 may be replaced by another electric device.

Some of separate members and parts according to the above embodiments may not be necessarily structured as discrete members and parts, but a plurality of members or parts may be integrally formed as appropriate. On the contrary, a single member or part according to the above embodiments may be constructed as a combination of a plurality of members or parts as appropriate.

Some of the benefits of the different embodiments will now be discussed. Terminals must be precisely positioned and stably fixed while the ink cartridge is mounted in the printer, in order to ensure reliable electrical communication between the cartridge and the printer. Because the first engagement portion is located adjacent to the terminal bearing structure, positioning action of the first restriction portion occurs close to where positioning is most needed (i.e., the terminals of the terminal bearing structure). The elastic force from the printer-side terminals can be properly counteracted against. Also, positional shift of the terminals, which can occur due to vibration during printing operations, can be suppressed. Therefore, positioning of the terminals is more stable, thus maintaining the stable electrical connection between the cartridge-side terminals and the device-side terminals.

Moreover, because the lever is not made integral with the cartridge, the material for producing the cartridge can be different from the material used for producing the lever. Also, the material of the cartridge can be selected with less concern for flexibility and durability requirements, and with greater focus on other properties such as resistance to ink.

Additionally, because the lever is not on the cartridge, no special care is needed to prevent creep deformation of the lever in packaging of the cartridge for transportation and distribution. This simplifies packaging requirements and improves the user's convenience. Because the lever is not an integral part of the cartridge, the cartridge can be made smaller. This further allows size reduction of the packaging material, such as paper or box, used to package the cartridge for transportation or distribution of the cartridge, thus advantageously reducing transportation and parts costs. Also because the lever is not integral with the cartridge, the first cartridge-side restriction element can be made with a small size and simple structure, and with higher rigidity, compared with the structures described in U.S. Publication No. 2005/0151811, for example. This results in significantly reducing the possibility of plastic deformation of the first cartridge-side restriction element. In the attached or mounted state, the cartridge can be kept at the proper position in the cartridge mounting structure, which maintains normal or good contact between the cartridge-side terminals and the printer-side terminals and reduces the possibility of poor electrical communication. Since the first cartridge-side restriction element can have a small size and simple structure, no special care to prevent creep deformation of the lever is required in packaging for transportation and distribution of the cartridge, unlike the cartridges of U.S. Publication No. 2005/0151811. This reduces packaging requirements and also improves the user's convenience.

It is possible for the structure that connects the cartridge terminal structure and the cartridge's engagement portion to each other, to be only rigid structure (which is not the case with the flexible levers of U.S. Publication No. 2005/0151811). In this case, less vibration is transmitted from the engagement portion to the cartridge terminals, so electrical communication is more stable.

Because the terminal plane (TP) of the terminals is neither parallel nor perpendicular to the leading edge plane (BP), the surface of the cartridge terminals can be properly wiped during insertion of the cartridge into the printer. In addition, this configuration reduces or eliminates insulation fragments (dust) that can be generated if the printer terminals scrape for long distances against the circuit board during installation of the cartridge.

Because the printer terminals apply, against the cartridge terminals, an elastic force which includes a vector component in the direction in which the cartridge is detached from the printer, there is no need to provide a spring like the spring 103 described in U.S. Pat. No. 6,955,422. In other words, the elastic force from the printer side terminals serves to both press the printer side and cartridge side terminals together, and also to move the cartridge in the direction for removal from the printer when engagement between the first restriction portion and the printer lever is released. So there is no need to provide an additional spring as in the case of the U.S. Pat. No. 6,955,422, which enables a simpler structure and reduced costs.

Because the first restriction portion is adapted to engage with the engagement portion of the lever so as to restrict movement of the cartridge in the direction opposite to the mounting direction, as a result, the position of the cartridge terminals will be maintained in place with respect to the mounting direction by the elastic force of the apparatus-side contact forming members, and with respect to the direction opposite to the mounting direction by the first restriction portion, when the cartridge is mounted in the printer. Since the cartridge terminals are "sandwiched" in this way, they are firmly fixed from moving in both the mounting direction and the direction opposite from the mounting direction. There is thus less likelihood of misalignment or disconnection between the cartridge terminals and the apparatus-side contact forming members, compared with the one-sided restriction by the elastic piece 40 and related configuration of U.S. Pat. No. 7,008,053.

When the second engagement portion is located farther from the leading edge plane than the terminals the possibility that the restriction portions will become disengaged from the printer engagement portion can be more effectively reduced, compared with the case when the second engagement portion is located closer to the leading edge plane than the terminals.

When the ink cartridge is mounted on the printing apparatus, if the cartridge is held too securely, then contact with some of the apparatus-side contact forming members might not be secure. By locating the first engagement portion to the left of the rightmost contact portion of the plurality of terminals and to the right of the leftmost contact portion of the plurality of terminals the ink cartridge can tilt sufficiently so that the electrical connection between the plurality of terminals and the apparatus-side contact forming members can be even more stable.

When the first engagement portion and second engagement portion are positioned so that a plane can intersect the ink supply structure (280), the first engagement portion, the second engagement portion and the widthwise center of the cartridge body the possibility that the first side restriction portion will become disengaged from the printer engagement portion can be more effectively reduced.

When the first engagement portion includes first and third locking surfaces and more specifically when the first and third locking surfaces form the shape of a letter "L" or a letter "T", the connection between the cartridge and the printing apparatus is strengthened and the possibility that the first side restriction portion will become disengaged from the printer engagement portion can be more effectively reduced.

When the distance between the first engagement portion and leading edge plane is less than the distance between a pivot point of the lever and leading edge plane when the cartridge is mounted, the lever serves to restrict the motion of the cartridge. This reduces the possibility of the first restriction portion becoming unlocked or disengaged from the engagement portion of the lever, thus creating a stable electrical connection between the plurality of terminals and the contact forming members and reducing the possibility of poor continuity. The first restriction portion can move about the axis of rotation of the lever when force is applied from the contact forming members to the mounted cartridge. This reduces the possibility that the first engagement portion becomes uncoupled from the engagement portion of the lever.

When the cartridge is mounted so that the first engagement portion is to the left of a pivot point of the lever when viewing the cartridge from the side with the first engagement portion to the right and the ink supply structure facing down, the first restriction portion generates rotational moment on the lever to turn the lever about the axis of rotation of the lever in the reverse direction to the unlocking direction. This reduces the possibility that the first engagement portion is unlocked from the engagement portion of the lever and further ensures the stable electrical connection between the plurality of terminals and the apparatus side contact forming members. Even when the cartridge receives force, the first restriction portion would move with the cartridge. Such moving reduces the possibility that the first engagement portion is unlocked from the engagement portion of the lever.

By providing the first restriction portion in such a position so that at least a portion of the first engagement portion is located substantially at the widthwise center of the ink cartridge, the first restriction portion is located extremely near to the plurality of terminals so that the electrical connection between the plurality of terminals and the apparatus side contact forming members can be stable.

When the second restriction portion is located farther from the leading edge plane than is the engagement portion of the first restriction portion, the possibility that the first side restriction portion will become disengaged from the printer engagement portion can be more effectively reduced, compared with the case when the first engagement portion is farther from leading edge plane than is engagement portion of the second restriction portion from the leading edge plane (BP).

When the second engagement portion is located farther from the leading edge plane than is the first engagement portion, the possibility that the first side restriction portion will become disengaged from the printer engagement portion can be more effectively reduced, compared with the case when the first engagement portion is farther from the leading edge plane than is the second engagement portion from the leading edge plane.

The invention is not restricted to the inkjet printer and its ink cartridge but is applicable to any of various liquid ejection devices configured to eject a liquid other than ink and its liquid container, for example, liquid ejection devices and their liquid containers given below:

image recording device, such as a facsimile machine;

color material ejection device used to manufacture color filters for image display devices, e.g., liquid crystal displays;

electrode material ejection device used to form electrodes of, for example, organic EL (electroluminescence) displays and field emission displays (FED);

liquid ejection device configured to eject a bioorganic material-containing liquid used for manufacturing biochips;

sample ejection device used as a precision pipette;

lubricating oil spray device;

resin solution spray device;

liquid spray device for pinpoint spray of lubricating oil at precision machinery including watches and cameras;

liquid ejection device configured to eject transparent resin solution, such as ultraviolet curable resin solution, onto the substrate, so as to manufacture a hemispherical microlens (optical lens) used for, for example, optical communication elements;

liquid spray device configured to spray an acidic or alkaline etching solution, in order to etch the substrate; and liquid ejection device equipped with liquid ejection head for ejecting a very small volume of droplets of another arbitrary liquid.

The "liquid droplet" means a state of liquid ejected from the liquid ejection device and may include granular liquid, teardrop liquid and tapered threadlike liquid. The "liquid" herein may be any material ejectable by the liquid ejection device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The "ink" includes general water-based inks and oil-based inks, as well as various liquid compositions, such as gel inks and hot-melt inks.

While the invention has been described with reference to exemplary embodiments thereof, it is to be understood that the invention is not limited to the disclosed embodiments or constructions. On the contrary, the invention is intended to cover various modifications and equivalent embodiments. In addition, while the various elements of the disclosed invention are shown in various combinations and configurations, which are exemplary, other combinations and configurations, including more, less or only a single element, are also within the spirit and scope of the invention.

It should also be appreciated that the features described herein can be part of a cartridge itself, as part of a combination of a cartridge and a printing apparatus or in other words when the cartridge is installed and/or as part of a system for supplying ink or other printing material to a printing apparatus without departing from the spirit of the invention.

The matters described in the respective aspects according to any parts of the invention may be added to any of the various variations described above.

Those skilled in the art will recognize that the present invention has many applications, may be implemented in many manners and, as such is not to be limited by the foregoing embodiments and examples. Any number of the features of the different embodiments described herein may be combined into one single embodiment and alternate embodiments having fewer than or more than all of the features herein described are possible. Functionality may also be, in whole or in part, distributed among multiple components, in manners now known or to become known.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims. While there had been shown and described fundamental features of the invention as applied to being exemplary embodiments thereof, it will be understood that omissions and substitutions and changes in the form and details of the disclosed invention may be made by those skilled in the art without departing from the spirit of the invention. Moreover, the scope of the present invention covers conventionally known, future developed variations and modifications to the components described herein as would be understood by those skilled in the art. It is the intention, therefore, to be limited only as indicated by the scope of the claims appended hereto. It is also to be understood that the following claims are intended to cover all of the generic and specific features of the invention herein disclosed and all statements of the scope of the invention that, is a matter of language, might be said to fall therebetween.

What is claimed is:

1. An ink cartridge for attachment and detachment to or from a holder of an ink jet printing apparatus, the ink jet printing apparatus comprising one or more device side terminals, a head, and a lever having a pair of wall members facing each other and a first device side locking element, the ink cartridge comprising:

an ink chamber;

an ink supply port configured to supply ink from the ink chamber to the head;

a first cartridge side locking element having a first locking surface;

an electrical circuit device;

a circuit board; and one or more cartridge side terminals provided on the circuit board configured to be coupled to the electrical device and to be electrically connected with the one or more device side terminals in an attached state of the cartridge to the holder, wherein the first cartridge side locking element is configured to be guided between the pair of wall members of the lever in the course of attachment or detachment of the cartridge to or from the holder as the lever and pair of wall members rotate together as the first cartridge side locking element is guided by the pair of wall members of the lever, wherein a positive Z-axis direction is an upward direction with respect to gravity, and a negative Z-axis direction is a direction opposite to the positive Z-axis direction, and the first device side locking element has a first device side locking surface facing in the negative Z-axis direction, wherein the circuit board is configured to receive a pressing force from the one or more device side terminals, the pressing force including a positive Z-axis component in the attached state of the cartridge to the holder, and wherein the first locking surface of the first cartridge side locking element is configured to engage with the first device side locking element to restrict the motion of the cartridge in the positive Z-axis direction in the attached state of the cartridge to the holder.

2. The ink cartridge of claim 1, wherein a Y-axis direction represents a facing direction of the pair of wall members facing each other and the distance between the pair of wall members along the Y-axis is greater than the length of the first cartridge side locking element along the Y-axis.

3. The ink cartridge of claim 2, wherein the first cartridge side locking element is configured to be guided between the pair of wall members to restrict the motion of the cartridge in the Y-axis direction in the course of attachment or detachment of the cartridge to or from the holder.

4. The ink cartridge of claim 1, the ink jet printing apparatus further comprising an ink supply tube and an elastic member provided around the ink supply tube, wherein the ink supply port is configured to receive a pressing force including a positive Z-axis component from the elastic member in the attached state of the cartridge to the holder.

5. The ink cartridge of claim 4, the lever further comprising a flat surface and a sloped surface which is provided between the pair of wall members as a plane linked with the flat surface, and when a negative X-axis represents a facing direction of the flat surface, and an X-axis is orthogonal to the Y-axis direction and the Z-axis direction, the sloped surface is inclined in the negative X-axis direction, the cartridge is configured to be turned along a plane parallel to the Z-axis and the X-axis for attachment of the cartridge to the holder, and the first cartridge side locking element is configured to be guided by the sloped surface to restrict the motion of the cartridge in the X-axis direction in the course of the attachment of the cartridge to the holder.

6. The ink cartridge of claim 5, the ink cartridge further comprising a structure facing in the positive X-axis direction and configured to prevent the lever from running on the positive Z-axis side of the first locking surface in the course of attachment of the cartridge to the holder.

7. The ink cartridge of claim 6, the lever further comprising an undercut surface; and wherein the structure configured to be accommodated in a space above the undercut surface in the state that the first cartridge element locks the device side locking element.

8. The ink cartridge of claims 6 and 7, wherein the first cartridge side locking element and the structure are configured to be integrally formed.

9. The ink cartridge of claims 4 to 7, wherein the first cartridge side locking element and the circuit board are configured to be integrally formed.

10. The ink cartridge one of claims 4 to 7, the first cartridge side locking element and the circuit board configured to be constructed as a combination of plurality of members.

11. The ink cartridge of claims 6 and 7, wherein the structure and the circuit board are configured to be integrally formed.

12. The ink cartridge one of claims 6 and 7, the first cartridge side locking element and the structure configured to be constructed as a combination of plurality of members.

13. The ink cartridge one of claims 6 and 7, the structure and the circuit board configured to be constructed as a combination of plurality of members.

14. The ink cartridge of claim 1, when a Y-axis direction represents a facing direction of the pair of wall members each other, the first cartridge side locking element configured to be guided to between the pair of wall members to restrict the motion of the cartridge in the Y-axis direction in the course of attachment or detachment of the cartridge to or from the holder.

15. The ink cartridge of claim 14, when a positive Z-axis direction represents a facing direction of the first locking surface in the attached state of the cartridge to the holder, and a negative Z-axis direction represents a reverse direction to the positive Z-axis direction, the first device side locking element has a first device side locking surface facing in the negative Z-axis direction, and wherein the first locking surface configured to engage with the first device locking surface of the first device side locking element to restrict the motion of the cartridge in the positive Z-axis direction in the attached state of the cartridge to the holder.

16. The ink cartridge of claim 15, the ink jet printing apparatus further comprising device side terminals, and the ink cartridge further comprising an electrical device, circuit board, and cartridge side terminals provided on the circuit board, the cartridge side terminals configured to be coupled to the electrical device and to be electrically connected with the device side terminals in the attached state of the cartridge to the holder, wherein the circuit board configured to be applied a pressing force including the positive Z-axis component from the device side terminals in the attached state of the cartridge to the holder.

17. The ink cartridge of claims 16, the first cartridge side locking element and the circuit board configured to be integrally formed.

18. The ink cartridge of claim 15, the ink jet printing apparatus further comprising an ink supply tube and an elastic member provided around the ink supply tube, wherein the ink supply port configured to be applied a pressing force including the positive Z-axis component from the elastic member in the attached state of the cartridge to the holder.

19. The ink cartridge of claims 16, the first cartridge side locking element and the circuit board configured to be constructed as a combination of plurality of members.

20. The ink cartridge of claim 1, the lever further comprising a flat surface and a sloped surface which provided between the pair of the wall members as a plane linked with the flat surface, and when a negative X-axis represents a facing direction of the flat surface (0193, 0200), a Z-axis direction represents the axis along the direction of gravity, a Y-axis direction represents a facing direction of the pair of wall members each other, and a X-axis represents orthogonal to the Y-axis direction and the Z-axis direction, the sloped surface inclined in the negative X-axis direction, the cartridge configured to be turned along a plane parallel to the Z-axis and the X-axis for attachment of the cartridge to the holder, and the first cartridge side locking element configured to be guided by the sloped surface to restrict the motion of the cartridge in the X-axis direction in the course of the attachment of the cartridge to the holder.

21. The ink cartridge of claim 1, when a positive Z-axis direction represents a facing direction of the first locking surface in the attached state of the cartridge to the holder, the ink cartridge further comprising a structure facing in the positive X-axis direction and configured to prevent the lever from running on the positive Z-axis side of the first locking surface in the course of attachment of the cartridge to the holder.

22. The ink cartridge of claim 21, the lever further comprising an undercut surface;

wherein the structure configured to be accommodated in a space above the undercut surface in the state that the first cartridge element locks the device side locking element.

23. The ink cartridge one of claims 21 and 22, the first cartridge side locking element and the structure configured to be integrally formed.

24. The ink cartridge one of claims 21 and 22, the first cartridge side locking element and the structure configured to be constructed as a combination of plurality of members.

25. The ink cartridge of claim 1, wherein the circuit board has a sloped surface, and the sloped surface of the circuit board is configured to receive the pressing force from the device side terminals including the positive Z-axis component in the attached state of the cartridge to the holder.

26. The ink cartridge of claim 1, wherein the first device side locking surface facing in the negative Z-axis direction is a planar surface, and the first locking surface of the first cartridge side locking element is configured to engage the planar first device side locking surface.

* * * * *